US008443891B2

(12) United States Patent
Lewis et al.

(10) Patent No.: US 8,443,891 B2
(45) **Date of Patent: *May 21, 2013**

(54) METHODS OF FRACTURING A WELL USING VENTURI SECTION

(75) Inventors: Ray Lewis, Dallas, TX (US); Herbert Hunt, Dallas, TX (US)

(73) Assignee: Petro-Hunt, L.L.C., Dallas, TX (US)

( * ) Notice: Subject to any disclaimer, the term of this patent is extended or adjusted under 35 U.S.C. 154(b) by 50 days.

This patent is subject to a terminal disclaimer.

(21) Appl. No.: 12/770,440

(22) Filed: Apr. 29, 2010

(65) Prior Publication Data

US 2011/0146995 A1 Jun. 23, 2011

Related U.S. Application Data

(60) Provisional application No. 61/288,108, filed on Dec. 18, 2009.

(51) Int. Cl.
*E21B 43/26* (2006.01)

(52) U.S. Cl.
USPC ..... 166/308.1; 166/177.5

(58) Field of Classification Search
USPC ..... 166/308.1, 313, 177.5, 222, 50
See application file for complete search history.

(56) References Cited

U.S. PATENT DOCUMENTS 3,825,071 A * 7/1974 Veatch, Jr. ..... 166/308.1
4,047,569 A 9/1977 Tagirov et al.
7,111,681 B2 * 9/2006 Detournay et al. ..... 166/250.1
2005/0061508 A1 3/2005 Surjaatmadja et al.
2006/0124310 A1 * 6/2006 Lopez de Cardenas et al. ..... 166/313
2006/0196667 A1 * 9/2006 Alba et al. ..... 166/308.1
2008/0179060 A1 7/2008 Surjaatmadja et al.
2008/0264640 A1 10/2008 Eslinger

FOREIGN PATENT DOCUMENTS

WO 03/056131 A1 7/2003

OTHER PUBLICATIONS

PCT International Search Report, PCT/US2010/033177, issued Dec. 16, 2010.

* cited by examiner

*Primary Examiner* — David Bagnell
*Assistant Examiner* — Richard Alker

(57) ABSTRACT

Methods of fracturing a well can include the steps of: (A) obtaining a fracturing job design having at least one treatment interval; (B) running a tubular string into the treatment interval; (C) before or after the step of running, forming one or more tubular string openings in the tubular string, wherein after the step of running, the one or more tubular string openings are positioned in the treatment interval; (D) except for the axial passageway of the tubular string, blocking at least 86% of the nominal cross-sectional area of the treatment interval that is between one of the ends of the treatment interval and the axially closest of the one or more tubular string openings, and, except for the axial passageway of the tubular string, leaving unblocked at least 4% of the nominal cross-sectional area of the treatment interval; and (E) pumping a fracturing fluid through the one or more tubular string openings at a rate and pressure sufficient to initiate at least one fracture in the subterranean formation surrounding the treatment interval.

20 Claims, 26 Drawing Sheets

METHODS OF FRACTURING A WELL USING VENTURI SECTION

CROSS-REFERENCE TO RELATED APPLICATIONS

This application claims priority from U.S. Provisional Patent Application No. 61/288,108 filed Dec. 18, 2009 entitled "METHOD OF FRACTURING A WELL USING VENTURI SECTION," which is hereby incorporated by reference in its entirety.

SUMMARY OF THE INVENTION

In general, the inventions are directed to methods of fracturing a well. The methods can include the steps of: (A) obtaining a fracturing job design having at least one treatment interval; (B) running a tubular string into the treatment interval; (C) before or after the step of running, forming one or more tubular string openings in the tubular string, wherein after the step of running, the one or more tubular string openings are positioned in the treatment interval; (D) except for the axial passageway of the tubular string, blocking at least 86% of the nominal cross-sectional area of the treatment interval that is between one of the ends of the treatment interval and the axially closest of the one or more tubular string openings, and, except for the axial passageway of the tubular string, leaving unblocked at least 4% of the nominal cross-sectional area of the treatment interval; and (E) pumping a fracturing fluid through the one or more tubular string openings at a rate and pressure sufficient to initiate at least one fracture in the subterranean formation surrounding the treatment interval.

According to a first invention, a method of fracturing an openhole wellbore portion of a well is provided, the method comprising the steps of:

(A) obtaining a fracturing job design having at least one treatment interval for the openhole wellbore portion, wherein the treatment interval:

(1) has a nominal cross-sectional area defined by the nominal wellbore diameter of the openhole wellbore portion; and (2) has an uphole end and a downhole end;

(B) running a tubular string into the treatment interval, wherein the tubular string has an axial passageway;

(C) before or after the step of running, forming one or more tubular string openings in the tubular string, wherein after the step of running, the one or more tubular string openings are positioned in the treatment interval;

(D) except for the axial passageway of the tubular string, blocking at least 86% of the nominal cross-sectional area of the treatment interval that is between one of the ends of the treatment interval and the axially closest of the one or more tubular string openings, wherein the blocking is along a summational axial length that is at least 7 times the nominal wellbore diameter, and, except for the axial passageway of the tubular string, leaving unblocked at least 4% of the nominal cross-sectional area of the treatment interval that is along an entire axial length between the end of the treatment interval and the axially closest of the one or more tubular string openings; and (E) pumping a fracturing fluid through the tubular string and through the one or more tubular string openings at a rate and pressure sufficient to initiate at least one fracture in the subterranean formation surrounding the treatment interval.

Preferably, prior to the step of pumping, no packing of the tubular string is set uphole within 1,500 feet of the treatment interval.

Preferably, the step of blocking an openhole wellbore portion is with a Venturi section to create a Venturi effect.

According to a second invention, a method of fracturing an openhole wellbore portion of a well is provided. The openhole wellbore portion has a nominal wellbore diameter defining a nominal cross-sectional area of the openhole wellbore portion. The method comprises the steps of:

(A) running a tubular string having a Venturi section into the openhole wellbore portion of the well;

(B) before or after the step of running, forming one or more tubular string openings in the tubular string to be located downhole relative to the Venturi section of the tubular string, wherein:

(1) the one or more tubular string openings allow fluid to flow from the tubular string to outside the tubular string;

(2) the Venturi section has a generally tubular wall that has a passageway extending axially therein, wherein the passageway of the Venturi section is in fluid communication with the one or more tubular string openings; and (3) the one or more tubular string openings and the Venturi section are not axially separated by a closed internal plug within the tubular string; and (C) pumping a fracturing fluid through the tubular string and through the one or more tubular string openings at a rate and pressure sufficient to initiate at least one fracture in the subterranean formation surrounding the openhole wellbore portion.

Preferably, prior to the step of pumping, no packing of the tubular string is set uphole within 1,500 feet of the Venturi section.

According to an embodiment of the second invention, the generally tubular wall of the Venturi section:

(a) has a cross-sectional area including the cross-sectional area of the passageway that:

(i) during the step of running, blocks an area equal to or greater than 86% of the nominal cross-sectional area of the openhole wellbore portion;

(ii) extends for a summational axial length that is at least 7 times the nominal wellbore diameter, wherein the summational axial length is along an axial span of the tubular string that is equal to or less than 30 times the nominal wellbore diameter; and (iii) before or during the step of pumping, is not increased by greater than 1% from the cross-sectional area during the step of running; and (b) does not have any opening in the tubular wall along the axial span of the summational axial length thereof that would allow fluid to flow from the passageway to outside the tubular string.

According to a third invention, a method of fracturing a cased wellbore portion of a well is provided, the method comprising the steps of:

(A) obtaining a fracturing job design having at least one treatment interval for the cased wellbore portion, wherein the treatment interval:

(1) has a nominal cross-sectional area defined by the nominal casing inside diameter of the casing of the cased wellbore portion; and (2) has an uphole end and a downhole end;

(B) running a tubular string into the treatment interval, wherein the tubular string has an axial passageway;

(C) before or after the step of running, forming one or more tubular string openings in the tubular string, wherein after the step of running, the one or more tubular string openings are positioned in the treatment interval;

(D) before or after the step of running, forming one or more casing openings in the casing of the treatment interval;

(E) except for the axial passageway of the tubular string, blocking at least 86% of the nominal cross-sectional area of the treatment interval that is between one of the ends of the treatment interval and the axially closest of the one or more tubular string openings, wherein the blocking is along a summational axial length that is at least one inch, and, except for the axial passageway of the tubular string, leaving unblocked at least 4% of the nominal cross-sectional area of the treatment interval that is along an entire axial length between the end of the treatment interval and the axially closest of the one or more tubular string openings; and (F) pumping a fracturing fluid through the tubular string, through the one or more tubular string openings, and through the one or more casing openings at a rate and pressure sufficient to initiate at least one fracture in the subterranean formation surrounding the treatment interval, wherein prior to the step of pumping, no packing of the tubular string is set uphole within 1,500 feet of the treatment interval.

Preferably, the step of blocking a cased wellbore portion:

extends for a summational axial length that is continuous for at least 2 times the nominal casing inside diameter; and does not have any opening in the tubular wall along the summational axial length thereof that would allow fluid to flow from the passageway to outside the tubular string.

Preferably, the step of blocking a cased wellbore portion is with a Venturi section to create a Venturi effect.

According to a fourth invention, a method of fracturing a cased wellbore portion of a well is provided. The cased wellbore portion has a nominal casing inside diameter defining a nominal cross-sectional area of the cased wellbore portion. The method comprises the steps of:

(A) running a tubular string having a Venturi section into the cased wellbore portion of the well;

(B) before or after the step of running, forming one or more tubular string openings in the tubular string to be located downhole relative to the upper end of the Venturi section of the tubular string, wherein:

(1) the one or more tubular string openings allow fluid to flow from the tubular string to outside the tubular string;

(2) the Venturi section has a generally tubular wall that has a passageway extending axially therein, wherein the passageway of the Venturi section is in fluid communication with the one or more tubular string openings;

(3) the one or more tubular string openings and the Venturi section are not axially separated by a closed internal plug within the tubular string; and (C) before or after the step of running, forming one or more casing openings in the casing to be located downhole relative to the upper end of the Venturi section of the tubular string; and (D) pumping a fracturing fluid through the tubular string, through the one or more tubular string openings, and through the one or more casing openings at a rate and pressure sufficient to initiate at least one fracture in the subterranean formation surrounding the cased wellbore portion, wherein prior to the step of pumping, no packing of the tubular string is set uphole within 1,500 feet of the Venturi section.

Preferably, the generally tubular wall of the Venturi section:

extends for a summational axial length that is continuous for at least 2 times the nominal casing inside diameter; and does not have any opening in the tubular wall along the summational axial length thereof that would allow fluid to flow from the passageway to outside the tubular string.

According to an embodiment of the fourth invention, the generally tubular wall of the Venturi section:

(a) has a cross-sectional area including the cross-sectional area of the passageway that:

(i) during the step of running, blocks an area equal to or greater than 86% of the nominal cross-sectional area of the inside of the casing of the cased wellbore portion; and (ii) before or during the step of pumping, is not increased by greater than 1% from the cross-sectional area during the step of running.

As used herein, the words "comprise," "have," "include," and all grammatical variations thereof are each intended to have an open, non-limiting meaning that does not exclude additional elements or steps.

It is also to be understood that, as used herein, "first," "second," "third," etc., are assigned arbitrarily and are merely intended to differentiate between two or more steps, elements, portions, etc., as the case may be, and do not necessarily indicate any sequence. Furthermore, the mere use of the term "first" does not require that there be any "second," and the mere use of the word "second" does not require that there be any "third," etc.

BRIEF DESCRIPTION OF THE DRAWING

The drawing is incorporated into and forms a part of the specification to illustrate at least one embodiment and example of the present invention. Together with the written description, the drawing serves to explain the principals of the invention. The drawing is only for the purpose of illustrating at least one preferred example of at least one embodiment of the invention and is not to be construed as limiting the invention to only the illustrated and described example or examples. In the drawing, like references are used to indicate like or similar elements or steps. The various advantages and features of the various embodiments of the present invention will be apparent from a consideration of the drawing in which:

FIG. 3 illustrates the nominal wellbore diameter A (of a portion of the openhole wellbore portion 10 illustrated in FIG. 1A) having a tubular string 26 run in, the tubular string 26 including a joint 30, a collar 52, and a Venturi section 40.

FIG. 5 illustrates the ends of two tubular members, such as joints 30 having a nominal outside diameter D of about 4.5 inches (4.5"). The ends of the joints 30 are illustrated connected by a tubular collar 52 having a nominal outside diameter D' of 5.0 inches.

FIG. 6A is a side view (in a plane parallel to the axis) (not to scale) of an example of a tubular member, in this case a ±40 foot (40') non-perforated joint 30 having a nominal outside diameter D of about 4.5 inches. FIG. 6B is a side view (in a plane parallel to the axis) (not to scale) of a tubular member having a Venturi section 40 inserted into the cut joint 30 of FIG. 6A. The Venturi section 40 has a nominal outside diameter B of about 5.75 inches and has a summational axial length of about 4 feet long (excluding the 6 inch long tapered connector portions 64 and 66 at the downhole end 42 and uphole end 44, respectively, of the Venturi section 40). FIG. 6C is a side view (in a plane parallel to the axis) (not to scale) of a Venturi section 40 having box connectors 82 at each end. Each of the connectors can be of any suitable type and the type or types of connectors are not critical.

FIG. 11A is a cross-sectional view (in a plane including the axis) (not to scale) of a Venturi section 40, as a "Venturi member, slipped over a tubular member 30. FIG. 11B is a cross-sectional view (in a plane perpendicular to the axis) (not to scale) taken along lines 11B-11B of FIG. 11A. FIG. 11C is a cross-sectional view (in a plane including the axis) (not to scale) of a Venturi section 40, as a Venturi member 38, slipped over a tubular string joint 30. FIG. 11C illustrates the Venturi member 38 of FIGS. 11A and 11B in a slidable position on a tubular string, such as a 40-foot long joint 30.

FIG. 12 additionally illustrates the assembly concentrically positioned in an openhole wellbore portion 10 having a nominal wellbore diameter A.

FIG. 15B illustrates an axial passageway 62 through a Venturi section 40 of the Venturi member 38*b*, a Venturi annulus or area 92, and the casing 86.

FIG. 16B illustrates an axial passageway 62 through the joint 30, the end view of a collar 52, an end view a Venturi section 40 of the Venturi member 38*c*, an end view of a Venturi annulus or area 92, and the cross-section of the casing 86 with casing perforations 94.

FIG. 17B illustrates an axial passageway 62 through a Venturi section 40 of the Venturi member 38*b*, a Venturi annulus or area 92, and the casing 86 with casing perforations 94.

FIG. 18B is similar to FIG. 17B, except additionally illustrating an external sliding sleeve 96 over the casing perforations 94. As illustrated in FIG. 18B and will be appreciated by a person of skill in the art, the sliding sleeve has previously been moved to uncover and open the casing perforations 94 so that fluid can flow from inside the casing 86 through the casing perforations 94 to outside the casing.

FIGS. 12 through 19G illustrate a tubular string or tubular members as being centered in a wellbore; however, it is to be understood that the tubular string or any of the tubular members may be off-center of the wellbore, as illustrated, as other examples, in FIGS. 1A-E, 2-4, and 10.

DETAILED DESCRIPTION OF THE INVENTIONS

General Context

Figure 1A:
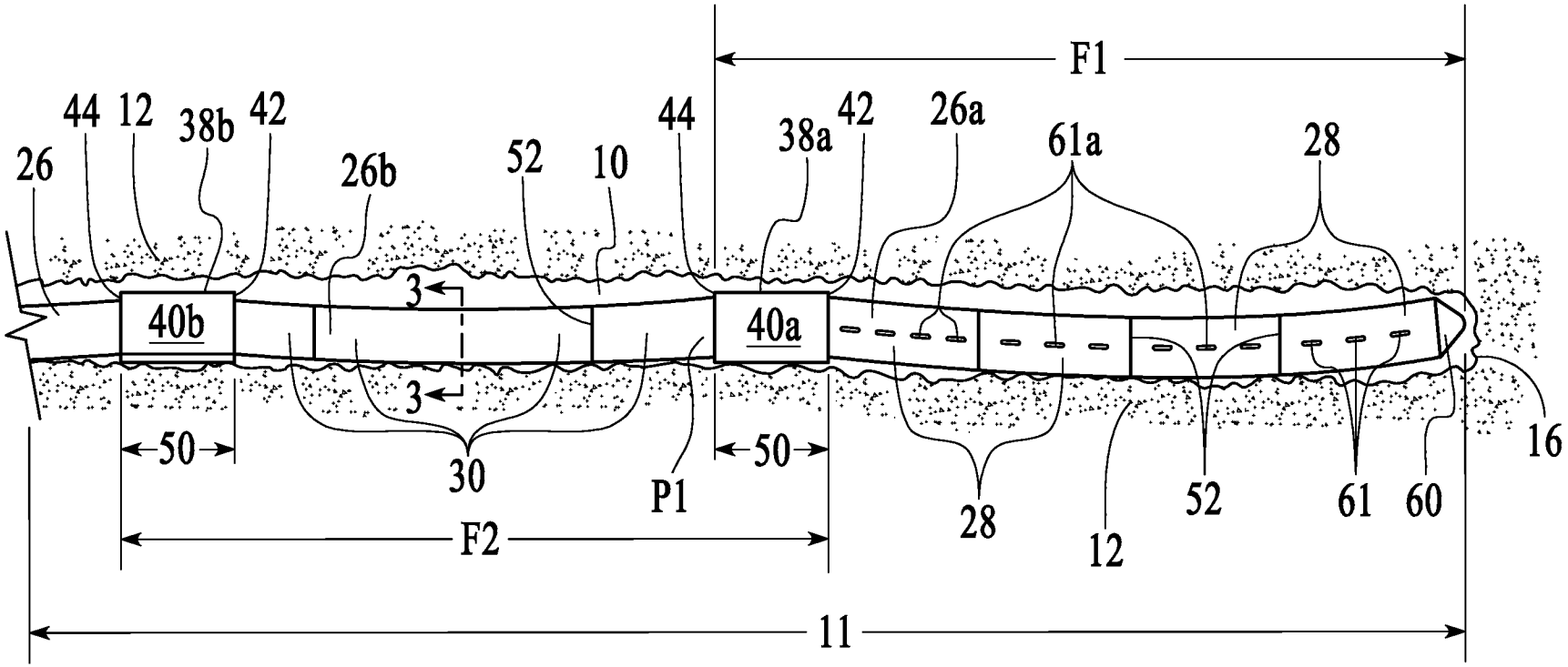
FIGS. 1A-1E are side views (in a vertical plane parallel to the axis) (not to scale) illustrating a method of fracturing an openhole wellbore portion 10 that is substantially horizontal. In this embodiment illustrated in FIG. 1A-1E, the openhole wellbore portion 10 includes a toe portion 11 extending into a subterranean formation 12.

Wells to Produce Oil, Gas, and Other Valuable Fluids from a Subterranean Formation Oil, gas, and other fluid substances are naturally occurring in certain subterranean formations. Examples of other valuable fluid substances include water, carbon dioxide gas, helium gas, and nitrogen gas.

A subterranean formation having sufficient porosity and permeability to store and transmit fluids is referred to as a reservoir. A subterranean formation that is a reservoir may be located under land or under a seabed offshore. A reservoir can be characterized by, among other characteristics, the fluid contained in the reservoir.

Oil or gas reservoirs are typically located in the range of a few hundred feet (shallow reservoirs) to a few tens of thousands of feet (ultra-deep reservoirs) below the ground or seabed. Although the present inventions can be used to stimulate production of any fluid from a subterranean formation, it has particular advantage for reducing the high costs of oil or gas production.

In order to produce a fluid from a reservoir, a wellbore is drilled into a subterranean formation that is a reservoir. A wellbore can be straight, curved, or branched.

A wellbore can have various wellbore portions. A wellbore portion is an axial length of a wellbore that can be identified by one or more characteristics or purposes. For example, a wellbore portion can be characterized as "vertical" or "horizontal," although the actual axial orientation can vary substantially from a true vertical or horizontal and the axial path of the wellbore may tend to "corkscrew" or otherwise vary.

After drilling a wellbore portion, a casing or liner can be positioned in the wellbore portion. A wellbore portion having a pre-existing casing or liner positioned therein is referred to herein as a "cased wellbore portion." The casing or liner can optionally be cemented into position in the wellbore portion. A wellbore portion without a pre-existing casing or liner positioned therein is referred to herein as an "openhole wellbore portion."

As used herein, the "wellbore" or "wellbore portion" refers to the wellbore itself (sometimes referred to as the borehole), regardless of whether the wellbore portion is openhole or cased.

As used herein, the words "uphole" and "downhole" are with reference to the direction of the flow of fluid through the wellbore toward the surface, regardless of the vertical, horizontal, or curved orientation of the particular section of the wellbore. For example, a fluid flowing through the wellbore toward the surface is moving "uphole," whereas running in a tubular string is moving the tubular string "downhole."

As used herein, "subterranean formation" refers to the fundamental unit of lithostratigraphy. A subterranean formation is a body of rock that is sufficiently distinctive and continuous that it can be mapped. In the context of formation evaluation, the term refers to the volume of rock seen by a measurement made through the wellbore, as in a log or a well test. These measurements indicate the physical properties of this volume, such as the property of porosity and permeability. As used herein, a "zone" refers to an interval of rock along a wellbore that is differentiated from surrounding rocks based on hydrocarbon content or other features, such as faults or fractures.

As used herein, a "well" includes a wellbore and the near-wellbore region of subterranean formation surrounding the wellbore. As used herein, "into a well" means and includes into any portion of the well, including into the wellbore of the well or into a near-wellbore region of a subterranean formation along a wellbore.

Tubular Members of a Tubular String

A tubular string is used to drill or access a wellbore. A tubular string provides mechanical access to the wellbore and a passageway extending axially through which fluid can pass, for example, through which a fluid can be injected into the wellbore or through which oil, gas, or other fluid can be produced from the subterranean formation surrounding a wellbore portion. A tubular string can be used, for example, as a drillpipe or as a casing, completion, treatment, production, or other wellbore tubing. It is to be understood that the passageway may be selectively or permanently closed, for example, by positioning a plug or closing a valve inside the passageway.

Joints and other tubular members are assembled to make up a "tubular string" for use in a wellbore. As used herein, a "joint" is a length of pipe, usually referring to drillpipe, casing, or tubing. A joint can be used to make up, for example, a drill string, casing, completion tubing, or production tubing. The most common drillpipe length is about 30 feet (9 meters). For casing, completion, or production tubing, the most common lengths of a joint are about 30 feet (9 meters) or about 40 feet (12 meters).

A joint or other tubular member that is used to make up a tubular string normally has a connection on each end. Commonly, the connection is a threaded connection. The threaded connection is used to connect or separate two tubular members to make up a tubular string.

There are several kinds of threaded connections. A tool joint is an example of a type of threaded connection for a tubing joint. An enlargement, known as an upset, is a part at the end of tubular members, such as drillpipe, casing, or other tubing joints, which has extra thickness and strength to compensate for the loss of metal in the threaded ends. The enlarged, threaded ends are adapted to provide mechanically strong connections and that withstand high pressure differentials between the inside and outside of the tubular string or across axial portions of a tubular string.

Another type of threaded connection is a collar, which is a female threaded coupling used to join two lengths of pipe such as casing or tubing. A collar has a short axial length compared to a tubular joint. Usually, the axial length of a collar is less than about 1.6 times the nominal outside diameter of the joints it is adapted to connect. The type of thread and style of collar varies with the specifications and manufacturer of the tubing.

Preferably, the tubular members consist essentially of metal. More preferably, the metal of the tubular members is steel or aluminum. These metals have the desired structural strength characteristics, which is especially important for the Venturi section of a tubular string. In some applications, however, other kinds of tubing or tubing of other material may be employed, such as coil tubing.

For a tubular member, the specifications of the tubing material, geometry of the tubular member, and design of the threaded connection on each end are selected based on many engineering factors depending on the application. For use in an openhole wellbore portion, the factors include, the nominal diameter of the wellbore at depth and the nature of the subterranean formations penetrated by the wellbore at depth. For use in a cased wellbore portion, the factors include, for example, the depth of the wellbore and the nominal inside diameter of the casing at depth. For use in either an openhole or cased wellbore portion, other engineering factors include the nature of the reservoir fluid, the bottom-hole temperature, and other wellbore conditions.

A blast joint is a section of heavy walled tubing that is designed to be placed across a perforated interval through which the production tubing must pass, such as may be required in multiple zone completions. A blast joint is heavier than normal completion components.

Downhole Tools

Downhole tools can be included in a tubular string or run into a tubular string. Examples of downhole tools include packers, plugs, valves, and sliding sleeves. In addition, a tubular member can include, for example, a slip-on tool on another tubular member.

Dimensions

As used herein, the word "axial" or "axially" is with reference to the geometric axis of a generally cylindrical or tubular shape, such as a wellbore or a casing or other tubular string. For example, an "axial length" is a length along the axis of a cylindrical or tubular shape. Accordingly, as used herein, "axially separated" means that two elements (which can be the same or different) are separated by an intervening axial length or have a third element (which can be the same or different from either of the two elements) located or positioned axially between the two elements.

As used herein, the adjective "nominal" or "nominally" mean of, being, or relating to a designated or theoretical size that may vary from the actual. The nominal size, however, is nevertheless used as the basis for calculations regarding a wellbore environment, a structure for use in a wellbore, or a well treatment.

For example, as used herein, the "nominal wellbore diameter" is the diameter of the largest drill bit or hole opener that made the openhole wellbore portion, although the actual diameter of a wellbore can vary depending on lithography and other factors. The shape a wellbore may not be perfectly circular, but rather the shape tends to deviate from circular and often may be slightly oval. In addition, for the purposes of this invention, it is important to recognize that the actual diameter or shape of an openhole wellbore portion tends to be irregular along the axis of the wellbore portion. In particular, there can be substantial portions of the wellbore that are substantially larger than the nominal diameter of the wellbore.

In addition, the adjective "nominal" or "nominally" regarding an outside diameter of a tubular member means of, being, or relating to the largest outside diameter across a generally circular cross-section of the tubular member. This is regardless of any minor radial variations inside a circle defined by the largest diameter, such as variations within manufacturing tolerance or such as small indentations, grooves, slots, or ports in a tubular wall.

Similarly, the adjective "nominal" or "nominally" regarding the inside diameter of a tubular wall relates to the means of, being, or relating to the largest inside diameter across a generally circular cross-section of the tubular member. This is regardless of any radial variations outside the largest diameter circle, such as variations within manufacturing tolerance or such as indentations, grooves, slots, or ports in a tubular wall.

Similarly, the adjective "nominal" or "nominally" regarding a thickness of a tubular wall relates to the thickness between the largest outside diameter and the smallest inside diameter across a generally circular cross-section of the tubular member. This is regardless of any minor radial variations inside the largest diameter circle, such as variations within manufacturing tolerance or such as inward indentations, grooves, slots, or ports in a tubular wall.

Furthermore, the adjective "nominal" or "nominally" regarding any diameter or tubular wall thickness along an axial length means of, being, or relating to the length-weighted average nominal diameter along the specified axial length. The axial length may be specified in absolute or in functional terms.

For example, the nominal outside or inside diameter of each axial length of a tubing string or a tubular member is weighted for its length to determine the length-weighted average nominal diameter or tubular wall thickness along the total specified axial length. Each axial length of a tubular member, which length may be defined or specified in functional terms or other terms, can have a nominal outside and inside diameter that may be the same or different from another axial length of the same tubular member or another tubular member of a tubular string. For the nominal outside diameter of a long tubular member, such as a casing joint or a tubing joint that is about 30 feet or 40 feet long, it is common to exclude from the determination of the nominal outside diameter of the tubular member the diameter along the length of any short threaded connector portion. The threaded connector portion is considered to be for a particular function that is different from the body of the long tubular member. Each of the connector portions of a tubular member may have a different nominal outside and inside diameter.

Regarding a nominal wellbore diameter of an openhole wellbore, the specified axial length may be defined in functional or other terms. For example, the relevant axial length can be specified to be between two other elements or structures in the wellbore portion Wellbore Portion A wellbore portion to be treated is preferably at a depth in the range of 1,000 feet to 30,000 feet below the wellhead. The wellbore portion to be treated can be vertical or horizontal, or anything in between, and a wellbore portion can be identified by other characteristics as discussed herein and known to those of skill in the art. It is to be understood that treating a wellbore portion can refer to treating the subterranean formation surrounding the wellbore portion. For example, fracturing a wellbore portion refers to fracturing the subterranean formation surrounding the wellbore portion.

As used herein, the bottomhole temperature ("BHT") is the downhole temperature measured or calculated at a point of interest, such as a wellbore portion or a portion of a subterranean formation to be treated. The BHT, without reference to circulating or static conditions, is typically associated with producing conditions.

Openhole Wellbore Portion

An openhole wellbore portion is a wellbore portion that does not have any pre-existing casing or liner. According to a preferred embodiment of the invention, the openhole wellbore portion has a nominal wellbore diameter in the range of 2.5 inches to 18 inches.

The openhole wellbore portion can be vertical, but need not be vertical. It is believed that the present invention will have particularly advantageous application in an openhole wellbore portion that is of a substantially horizontal wellbore, which often involves multiple sequential fracturing treatments.

Cased Wellbore Portion

A cased wellbore portion is a wellbore portion that has a pre-existing casing or liner. The casing or liner can optionally be cemented in position in the wellbore portion. An important difference between a cased wellbore portion and an openhole wellbore portion is that the inside wall of the casing of a cased wellbore portion is relatively smooth and uniform, whereas the inside wall of the wellbore of an openhole portion may be quite irregular and non-uniform.

According to a preferred embodiment of the invention, the cased wellbore portion has a nominal wellbore diameter in the range of 2.5 inches to 18 inches. A casing of an appropriate size is positioned in the wellbore. A casing can have a casing outside diameter in the range of about 2.5 inches to about 18 inches and a nominal inside diameter in the range of about 2 inches to about 17.5 inches.

The cased wellbore portion can be vertical, but need not be vertical. It is believed that the present invention will have particularly advantageous application in a cased wellbore portion that is of a substantially horizontal wellbore portion, which often involves multiple sequential fracturing treatments.

The cased wellbore portion can be a previously fractured wellbore portion that has a pre-existing tubular string positioned therein, which can be considered to be the pre-existing "casing" of the wellbore portion for a subsequent fracturing treatment of the cased wellbore portion. This pre-existing casing can be cemented or uncemented, previously perforated or not, and have set packing on the outside thereof or not.

Outer Diameter of Tubular String

According to the method of fracturing an openhole wellbore portion, the portion of the tubular string that is run in to the openhole wellbore portion preferably has a greatest nominal outside diameter that is less than the nominal wellbore diameter. This is to facilitate run in of the tubular string. Preferably, the portion of the tubular string that is run in to the openhole wellbore portion has a greatest nominal outside diameter that is equal to or less than 98% of the nominal wellbore diameter.

According to the method of fracturing a cased wellbore portion, the portion of the tubular string that is run in to the cased wellbore portion preferably has a greatest nominal outside diameter that is less than the nominal casing inside diameter of the pre-existing casing. This is to facilitate run in of the tubular string. Preferably, the portion of the tubular string that is run in to the cased wellbore portion has a greatest nominal outside diameter that is equal to or less than 98% of the nominal casing inside diameter.

Well Treatments and Treatment Fluids

Various types of treatments are commonly performed on wells or subterranean formations penetrated by wells. As used herein, the word "treatment" refers to a treatment of a well or subterranean formation that is adapted to achieve a specific purpose, such as stimulation, isolation, or conformance control, however, the word "treatment" does not necessarily imply any particular purpose. A treatment of a well or subterranean formation typically involves introducing a treatment fluid into a well.

As used herein, a "treatment fluid" refers to a fluid used in a treatment of a well or subterranean formation. A treatment fluid is typically adapted to be used to achieve a specific treatment purpose, such as stimulation, isolation, or conformance control, however, the word "treatment" in the term "treatment fluid" does not necessarily imply any particular action by the fluid. As used herein, a "treatment fluid" means the specific composition of a fluid at or before the time the fluid is introduced into a wellbore.

As used herein, a "fluid" refers to an amorphous substance having a continuous phase that tends to flow and to conform to the outline of its container when tested at a temperature of 25° C. (77° F.) and a pressure of 1 atmosphere. A fluid can be homogeneous or heterogeneous. A homogeneous fluid consists of a single fluid phase with uniform properties throughout. A heterogeneous fluid consists of at least one fluid phase and at least one other phase, which can be another fluid or a different phase, wherein the other phase has different properties. Examples of a homogeneous fluid include water, oil, or a solution of one or more dissolved chemicals. An example of a heterogeneous fluid is a dispersion. A dispersion is system in which one phase is dispersed in another phase. An example of a dispersion is a suspension of solid particles in a liquid phase. Another example of a dispersion is an emulsion. Further, a fluid can include an undissolved gas, which undissolved gas can be used, for example, for foaming the fluid. An aqueous fluid is a fluid that is either a homogeneous aqueous solution or a heterogeneous fluid wherein the continuous phase is an aqueous solution. An aqueous solution is a solution in which water is the solvent.

Hydraulic Fracturing and Proppant

In general, stimulation is a type of treatment performed on a subterranean formation penetrated by a wellbore portion to restore or enhance the productivity of oil or gas or other fluid from the subterranean formation. Stimulation treatments fall into two main groups: hydraulic fracturing and matrix treatments. "Hydraulic fracturing," sometimes simply referred to as "fracturing," is performed above the fracture pressure of a subterranean formation to create or extend a fracture in the subterranean formation. The fracture can be propped open with sand or other proppant to provide a highly permeable flow path between the formation and the wellbore. In an acid fracturing treatment, an acid can also create acid channels to provide a highly permeable flow path between the formation and the wellbore. In contrast, matrix treatments are performed below the fracture pressure of a subterranean formation.

A treatment fluid used in hydraulic fracturing is sometimes referred to as a "fracturing fluid" (or sometimes referred to as a "frac fluid). The fracturing fluid is pumped at a high flow rate and high pressure down into the wellbore and out into the subterranean formation. The pumping of the fracturing fluid is at a high flow rate and pressure that is much faster and higher than the fluid can escape through the permeability of the formation. Thus, the high flow rate and pressure creates or enhances a fracture in the subterranean formation. Creating a fracture means making a new fracture in the formation. Enhancing a fracture means enlarging a pre-existing fracture in the formation.

For pumping in hydraulic fracturing, a "frac pump" is used, which is a high-pressure, high-volume pump. Typically, a frac pump is a positive-displacement reciprocating pump. These pumps generally are capable of pumping a wide range of fluid types, including corrosive fluids, abrasive fluids and slurries containing relatively large particulates, such as sand. Using one or more frac pumps, the fracturing fluid may be pumped down into the wellbore at high rates and pressures, for example, at a flow rate in excess of 50 barrels per minute at a pressure in excess of 5,000 pounds per square inch ("psi"). The pump rate and pressure of the fracturing fluid may be even higher, for example, pressures in excess of 10,000 psi are not uncommon.

When the formation fractures or an existing fracture is enhanced, the fracturing fluid suddenly has a fluid flow path through the crack to flow more rapidly away from the wellbore. As soon as the fracture is created or enhanced, the sudden increase in flow of fluid away from the well reduces the pressure in the well. Thus, the creation or enhancement of a fracture in the formation is indicated by a sudden drop in fluid pressure, which can be observed at the well head.

After it is created, the newly-created fracture will tend to close after the pumping of the fracturing fluid is stopped. To prevent the fracture from closing, a material must be placed in the fracture to keep the fracture propped open. This material is usually in the form of an insoluble particulate, which can be suspended in the fracturing fluid, carried downhole, and deposited in the fracture. The particulate material holds the fracture open while still allowing fluid flow through the permeability of the particulate. A particulate material used for this purpose is often referred to as a "proppant." When deposited in the fracture, the proppant forms a "proppant pack," and, while holding the fracture apart, provides conductive channels through which fluids can flow to the wellbore. For this purpose, the particulate is typically selected based on two characteristics: size range and strength.

When used as a proppant, the particulate must have an appropriate size to prop open the fracture and allow fluid to flow through the particulate pack, i.e., in between and around the particles making up the pack. Appropriate sizes of particulate for use as a proppant are typically in the range from about 8 to about 100 U.S. Standard Mesh.

The particulate material of a proppant must be sufficiently strong, that is, have a sufficient compressive strength or crush resistance, to prop the fracture open without being deformed or crushed by the closure stress of the fracture in the subterranean formation.

Suitable proppant materials include, but are not limited to, sand (silica), walnut shells, sintered bauxite, glass beads, plastics, nylons, resins, other synthetic materials, and ceramic materials. Mixtures of proppants can be used as well. If sand is used, it typically will be from about 20 to about 100 U.S. Standard Mesh in size. With synthetic proppants, mesh sizes about 8 to about 100 are typically used. Also, any of the proppant particles can be coated with a resin or flow-back aid to potentially improve the strength, clustering ability, and flow-back properties of the proppant.

The concentration of proppant in the fluid can be any concentration known in the art, and preferably will be in the range of from about 0.01 to about 3 kilograms of proppant added per liter of liquid phase (about 0.1-25 lb/gal).

Accordingly, a fracturing fluid can optionally include a proppant, such as sand. In addition, a fracturing fluid can optionally include polymer for increasing the viscosity of the fluid, a polymer and crosslinker for forming a gelled fluid (which helps suspend and carry a proppant), a gas (for foaming the fluid), an acid, a surfactant, a corrosion inhibitor, a bactericide, or other chemical additives known in the art.

Hydraulic Isolation and Conventional Packing and Packing Methods

It has previously been believed necessary to hydraulically isolate a treatment interval of a wellbore portion for fracturing of the subterranean formation surrounding the treatment interval of the wellbore portion. This is to contain the pumped fracturing fluid within the axial length of the treatment interval so that the pressure within the treatment interval exceeds the fracturing pressure of the surrounding subterranean formation. This is sometimes referred to as "hydraulic isolation." Previously, a great deal of effort and money has been spent on achieving hydraulic isolation for fracturing.

To effect hydraulic isolation for fracturing, it has heretofore been believed to be necessary to design for "packing off" at least one end of a treatment interval of a wellbore portion. Typically, both the uphole and the downhole end of a treatment interval are packed off. Exceptions to packing both the uphole and downhole ends of a treatment interval include, for example: (a) if the downhole end is established by the terminal end of a wellbore portion, such as the toe end of a horizontal wellbore portion or the plugging of the downhole end of the wellbore without any portion of the tubular string extending below the plugging; (b) if the downhole end is established by a previously set packing and plugging of the tubular string in the downhole end of the wellbore; or (c) if the uphole end is established by a hanger packing for the tubular string. In a fracturing job design having more than one treatment interval for "staged fracturing," it has normally been thought necessary to create the sequence of hydraulically isolated treatment intervals by sequentially packing both the uphole and the downhole ends of each treatment interval.

Conventionally, an end of a treatment interval (uphole or downhole) has been defined by use of a packing. Conventionally, packing to effect hydraulic isolation of a treatment interval has been achieved either with a sealing device, such as a packer, or with a specialized plastic or fluid, such as a cement or other sealing compound.

In general, a packer is a type of downhole tool that can be run into a wellbore with a smaller initial outside that then expands externally to seal the wellbore or to seal an annulus from the production conduit, enabling controlled production, injection, or treatment. The common characteristic is that the outside of a packer is adapted to expand substantially. A wide variety of technologies are employed to expand the outside of a packer. Typically, a packer has one or more expandable packing elements.

The purpose of expanding the outside of packer is to create a fluid-tight seal. The ability of a packer to seal is typically rated by the fluid differential pressure that the packer can achieve. A packer is typically adapted to achieve a differential pressure of thousands of pounds per square inch, and often a packer is adapted to achieve a differential pressure of more than ten thousand pounds per square inch.

In drilling, a packer is a type of downhole tool that can be run into a wellbore with a smaller initial outside diameter that then expands externally to seal the wellbore. For example, some packers employ flexible, elastomeric elements that expand. One common type of packer is the production or test packer, which is expanded by squeezing the elastomeric elements (doughnut shaped) between two plates, forcing the sides to bulge outward. Another common type of packer is the inflatable packer, which is expanded by pumping a fluid into an elastomeric bladder. Yet another common type of packer is a swellable packer, which has elastomeric material that expands and forms an annular seal when immersed in certain wellbore fluids. The elastomers used in these packers are either oil-swellable or water-swellable. Their expansion rates and pressure ratings are affected by a variety of factors. Oil-activated elastomers, which work on the principle of absorption and dissolution, are affected by fluid temperature as well as the concentration and specific gravity of hydrocarbons in a fluid. Water-activated elastomers are typically affected by water temperature and salinity. This type of elastomer works on the principle of osmosis, which allows movement of water particles across a semi-permeable membrane based on salinity differences in the water on either side of the membrane. Production or test packers are normally used in cased holes. Inflatable or swellable packers are normally used in open or cased holes.

In well completion, a packer is a downhole tool used to isolate the annulus from the production conduit, enabling controlled production, injection, or treatment. A conventional packer assembly incorporates a means of securing the packer against the casing or liner wall, such as a slip arrangement, and a means of creating a reliable hydraulic seal to isolate the annulus, typically by means of an expandable elastomeric element. Packers are classified by application, setting method, and possible retrievability.

Drilling or completion packers can be run on wireline, pipe, or coiled tubing. Some packers are designed to be removable, while others are permanent. Permanent packers are usually constructed of materials that are easy to drill or mill out.

As used herein, a packer is considered to be at least beginning to "set" if it has been actuated or allowed to expand downhole by more than 2% from the nominal outside diameter at the time of running in.

Packing can be or include the use a cement or other sealing compound to effect hydraulic isolation of a treatment interval. The cement or other sealing compound is pumped to the location to be sealed and allowed to set. In this case, setting is the process of becoming solid by curing. As used herein, a cement or other sealing compound is considered to be at least beginning to "set" when it can no longer be characterized as a fluid.

Conventionally, a packing for the tubular string or a step of packing of the tubular string is almost invariably used as part of a fracturing treatment to help contain fracturing pressure within a desired treatment interval, as is known to those of skill in the art.

Creating a Venturi Effect Instead of Packing

The Venturi effect is the reduction in fluid pressure that results when a fluid flows from a relatively high-pressure side through a constricted cross-sectional area to a relatively low-pressure side.

According to the present inventions, instead of packing an end of a treatment interval for fracturing a subterranean formation surrounding a wellbore portion, it is believed that creating a Venturi effect is sufficient for defining a treatment interval. This allows for much simpler fracturing job designs and simpler methods of fracturing. (It should be understood that fracturing a wellbore portion refers to fracturing the subterranean formation of the wellbore portion.)

According to the present inventions, no packing for the tubular string is set to help effect hydraulic isolation of an end of a treatment interval prior to the step of pumping a fracturing fluid. For example, no packer is set as part of the tubular sting that is positioned in a treatment interval according to any method according to any of the present inventions. Similarly, no cement or other sealing compound, is set in a treatment interval in the annular space around the tubular string according to any method according to any of the present inventions.

Preferably, no packing of the tubular string is set within 1,500 feet uphole of the uphole end of a treatment interval. Preferably, no packing of the tubular string is set within 1,500 feet downhole of the downhole end of a treatment interval. The "uphole end" and "downhole end" of a treatment interval are hereinafter defined.

Methods of Fracturing an Openhole Wellbore Portion

According to a first invention, a method of fracturing an openhole wellbore portion of a well is provided, the method comprising the steps of:

(A) obtaining a fracturing job design having at least one treatment interval for the openhole wellbore portion, wherein the treatment interval:

(1) has a nominal cross-sectional area defined by the nominal wellbore diameter of the openhole wellbore portion; and (2) has an uphole end and a downhole end;

(B) running a tubular string into the treatment interval, wherein the tubular string has an axial passageway;

(C) before or after the step of running, forming one or more tubular string openings in the tubular string, wherein after the step of running, the one or more tubular string openings are positioned in the treatment interval;

(D) except for the axial passageway of the tubular string, blocking at least 86% of the nominal cross-sectional area of the treatment interval that is between one of the ends of the treatment interval and the axially closest of the one or more tubular string openings to the one of the ends, wherein the blocking is along a summational axial length that is at least 7 times the nominal wellbore diameter, and, except for the axial passageway of the tubular string, leaving unblocked at least 4% of the nominal cross-sectional area of the treatment interval that is along an entire axial length between the one of the ends of the treatment interval and the axially closest of the one or more tubular string openings to the one of the ends; and (E) pumping a fracturing fluid through the tubular string and through the one or more tubular string openings at a rate and pressure sufficient to initiate at least one fracture in the subterranean formation surrounding the treatment interval.

The step of obtaining a fracturing job design can further comprise the step of designing the fracturing job design. In other situations, a fracturing job design can be obtained from another party, such as an engineering firm or a consultant.

Preferably, prior to the step of pumping, no packing of the tubular string is set uphole within 1,500 feet of the treatment interval.

More preferably, the step of blocking an openhole wellbore portion is with a Venturi section. This is adapted to create a Venturi effect.

Preferably, the step of blocking comprises blocking at least 92% of the nominal cross-sectional area of the treatment interval that is between the one of the ends of the treatment interval and the axially closest of the one or more tubular string openings to the one of the ends, wherein the blocking is along a summational axial length that is at least 7 times the nominal wellbore diameter.

Preferably, the method further includes the step of: blocking at least 86% of the nominal cross-sectional area of the treatment interval that is between the other of the ends of the treatment interval and the axially closest of the one or more tubular string openings to the other of the ends, wherein the blocking is along a summational axial length that is at least 7 times the nominal wellbore diameter, and, except for the axial passageway of the tubular string, leaving unblocked at least 4% of the nominal cross-sectional area of the treatment interval that is along an entire axial length between the other of the ends of the treatment interval and the axially closest of the one or more tubular string openings to the other of the ends.

Preferably, prior to the step of pumping, no packing of the tubular string is set downhole within 1,500 feet of the treatment interval.

Preferably, the step of blocking of the treatment interval that is between the other of the ends of the treatment interval and the axially closest of the one or more tubular string openings comprises blocking at least 92% of the nominal cross-sectional area of the treatment interval that is between the other of the ends of the treatment interval and the axially closest of the one or more tubular string openings to the other of the ends, wherein the blocking is along a summational axial length that is at least 7 times the nominal wellbore diameter.

More preferably, the step of blocking of the treatment interval that is between the other of the ends of the treatment interval and the axially closest of the one or more tubular string openings is with a Venturi section.

According to a second invention, a method of fracturing an openhole wellbore portion of a well is provided. The openhole wellbore portion has a nominal wellbore diameter defining a nominal cross-sectional area of the openhole wellbore portion. The method comprises the steps of:

(A) running a tubular string having a Venturi section into the openhole wellbore portion of the well;

(B) before or after the step of running, forming one or more tubular string openings in the tubular string to be located downhole relative to the Venturi section of the tubular string, wherein:

(1) the one or more tubular string openings allow fluid to flow from the tubular string to outside the tubular string;

(2) the Venturi section has a generally tubular wall that has a passageway extending axially therein, wherein the passageway of the Venturi section is in fluid communication with the one or more tubular string openings; and (3) the one or more tubular string openings and the Venturi section are not axially separated by a closed internal plug within the tubular string; and (C) pumping a fracturing fluid through the tubular string and through the one or more tubular string openings at a rate and pressure sufficient to initiate at least one fracture in the subterranean formation surrounding the openhole wellbore portion.

Preferably, prior to the step of pumping, no packing of the tubular string is set uphole within 1,500 feet of the Venturi section.

Preferably, no tubular string opening is formed uphole relative to the Venturi section.

According to a first embodiment of the second invention, the generally tubular wall of the Venturi section:

(a) has a nominal outside diameter that:

(i) during the step of running, is equal to or greater than 93% of the nominal wellbore diameter;

(ii) extends for a summational axial length that is continuous for at least 7 times the nominal wellbore diameter; and (iii) before the step of pumping, is not increased by greater than 1% from the nominal outside diameter during the step of running;

(b) has a cross-sectional profile that is circular along the summational axial length; and (c) does not have any opening in the tubular wall along the summational axial length thereof that would allow fluid to flow from the passageway to outside the tubular string.

According to a second embodiment of the second invention, the generally tubular wall of the Venturi section:

(a) has a nominal outside diameter that:

(i) during the step of running, is equal to or greater than 93% of the nominal wellbore diameter;

(ii) extends for a summational axial length that is at least 7 times the nominal wellbore diameter, wherein the summational axial length is along an axial span of the tubular string that is equal to or less than 30 times the nominal wellbore diameter; and (iii) during the step of running, the step of pumping, is not increased by greater than 1% from the nominal outside diameter during the step of running;

(b) does not allow contiguous fluid flow that is:

(i) along the axial span of the summational axial length; and (ii) between the outside surface of the generally tubular wall and the nominal outside diameter of the summational axial length of the Venturi section; and (c) does not have any opening in the tubular wall along the axial span of the summational axial length thereof that would allow fluid to flow from the passageway to outside the tubular string.

According to a third embodiment of the second invention, the generally tubular wall of the Venturi section:

(a) has a cross-sectional profile that:

(i) defines an area equal to or greater than 86% of the nominal cross-sectional area of the openhole wellbore portion;

(ii) extends for a summational axial length that is at least 7 times the nominal wellbore diameter, wherein the summational axial length is along an axial span of the tubular string that is equal to or less than 30 times the nominal wellbore diameter; and (iii) before the step of pumping, is not increased by greater than 1% from the cross-sectional profile during the step of running;

(b) does not allow contiguous fluid flow that is:

(i) along the summational axial length; and (ii) between the passageway and the outside surface of the generally tubular wall; and (c) does not have any opening in the tubular wall along the axial span of the summational axial length thereof that would allow fluid to flow from the passageway to outside the tubular string.

According to a fourth embodiment of the second invention, the generally tubular wall of the Venturi section:

(a) has a cross-sectional area including the cross-sectional area of the passageway that:

(i) blocks an area equal to or greater than 86% of the nominal cross-sectional area of the openhole wellbore portion;

(ii) extends for a summational axial length that is at least 7 times the nominal wellbore diameter, wherein the summational axial length is along an axial span of the tubular string that is equal to or less than 30 times the nominal wellbore diameter; and (iii) before the step of pumping, is not increased by greater than 1% from the cross-sectional area during the step of running; and (b) does not have any opening in the tubular wall along the axial span of the summational axial length thereof that would allow fluid to flow from the passageway to outside the tubular string.

According to a fifth embodiment of the second invention, the generally tubular wall of the Venturi section is adapted to provide at least a sufficient Venturi effect at least one axial position along the summational axial length thereof between the tubular string and the wall of the openhole wellbore portion so that during the step of pumping a fracturing fluid, the Venturi effect contains a sufficient pressure of the fracturing fluid in the openhole wellbore portion to initiate the at least one fracture.

As described herein, the actual outside diameter or cross-sectional area can vary from the nominal along the summational axial length of a Venturi section.

FIGS. 1A-1E are side views (in a vertical plane parallel to the axis) (not to scale) illustrating an embodiment of the method of fracturing an openhole wellbore portion 10. In this embodiment illustrated in FIGS. 1A-1E, the openhole wellbore portion 10 includes a toe portion 11 extending into a subterranean formation 12. The cross-sectional shape of the openhole wellbore portion 10 is substantially circular, but the shape can be irregular and can vary along the axial length of any portion (such as the toe portion 11) of the openhole wellbore portion. The toe portion 11 of a horizontal wellbore terminates at a toe end 16.

FIG. 1A illustrates a step of running in an end portion of a tubular string 26 into the toe portion 11 of the horizontal openhole wellbore portion 10. The tubular string 26 includes a plurality of tubular members.

The tubular members of the tubular string 26 can include, for example, joints, one or more Venturi members, and connecting collars. More particularly, the tubular members of the tubular string 26 can include, for example, perforated joints 28 or non-perforated joints 30.

As used herein, a "Venturi member" is a tubular member, generally referred to by the reference 38, that includes at least one Venturi section, generally referred to by the reference 40. If more than one Venturi member 38 is employed according to a method of the invention, a first Venturi member is referred to by the reference 38*a*, a second Venturi member is referred to by the reference 38*b*, etc. Similarly, if more than one Venturi section 40 is employed according to a method of the invention, a first Venturi section is referred to by the reference 40*a*, a second Venturi member is referred to by the reference 40*b*, etc.

Each Venturi section 40, such as first and second Venturi sections 40*a* and 40*b*, has a downhole end 42 and an uphole end 44. In the case of a Venturi section 40 having an axially continuous nominal circumference between the downhole end 42 and the uphole end 44 thereof, the downhole end 42 and the uphole end 44 define a summational axial length 50 that is continuous. As is hereinafter explained in detail, a Venturi section 40 can have an axially discontinuous nominal circumference between the downhole end 42 and the uphole end 44 thereof, in which case only the axial portions that meet the requirements for the Venturi section are included in determining the summational axial length of such a Venturi section.

Continuing to refer to FIG. 1A of the drawing, the tubular string 26 includes first and second Venturi members 38*a* and 38*b*, which can be the same or different. Each of the first and second Venturi members 38*a* and 38*b* has a Venturi section, designated as first and second Venturi sections 40*a* and 40*b*, which can be the same or different. Each of the Venturi sections 40*a* and 40*b* has a summational axial length 50, which can be the same or different. In the illustrated treatment plan of FIG. 1A, the first Venturi member 38*a* is downhole relative to the second Venturi member 38*b*. Similarly, the first Venturi section 40*a* is downhole relative to the second Venturi section 40*b*.

The joints 28 and 30 and the Venturi members 38*a* and 38*b* can be connected to form the tubing string 26. A connection can be a integrally formed tool joint on a joint or Venturi member or can be as a separate, axially short tubular member as a collar 52. The connections at the collars 52 are preferably threaded. The tubing string 26 may optionally have an end cap 60.

The treatment method illustrated in FIGS. 1A-1E includes a plurality of treatment intervals, in particular including a first treatment interval F1 adjacent the toe end 16 of the openhole wellbore portion 10 and a second treatment interval F2 in the toe portion 11 uphole of the first treatment interval F1. It is to be observed that the two adjacent illustrated treatment intervals F1 and F2 can be considered to overlap based on the summational axial length 50 of Venturi section 40*a*. This is because the Venturi effect provided by a Venturi section can be expected to be maximized along at least one axial location of any portion of the summational axial length 50 of the Venturi section between downhole end 42 and uphole end 44. Preferably, the Venturi sections 40*a* and 40*b* do not include any openings in the tubular walls of the Venturi sections between the downhole end 42 and the uphole end 44, respectively.

Perforations or other openings in a tubular member, such as a joint, of a tubular string 26 are generally referred to by the reference 61. If such perforations or other openings are in different treatment sections of a tubular string 26, a first one or more of such perforations or openings in a treatment section 26*a* may be referred to by the reference 61*a*, a second one or more of such perforations or openings in a treatment section 26*b* may be referred to by the reference 61*b*, etc. A treatment section, such as treatment sections 26*a* and 26*b*, may be extremely short or extend axially for up to hundreds of feet.

Perforated joints 28 have one or more pre-perforated openings 61*a* formed therein. A treatment section 26*a* of the tubular string 26 in the first treatment interval F1 at the toe end 16 can have a plurality of pre-formed openings 61*a* therein. For example, a treatment section 26*a* can include a plurality of perforated joints 28.

A treatment section 26*b* of the tubular string 26 for the treatment interval F2 preferably does not have any open pre-formed openings therein. For example, a treatment section 26*b* can include a plurality of joints 30 that are not pre-perforated. As will be appreciated by a person of skill in the art, a treatment section 26*b* can include a plurality of pre-formed openings that are temporarily closed with a sliding sleeve or rupture disks (not shown).

Figure 1B:
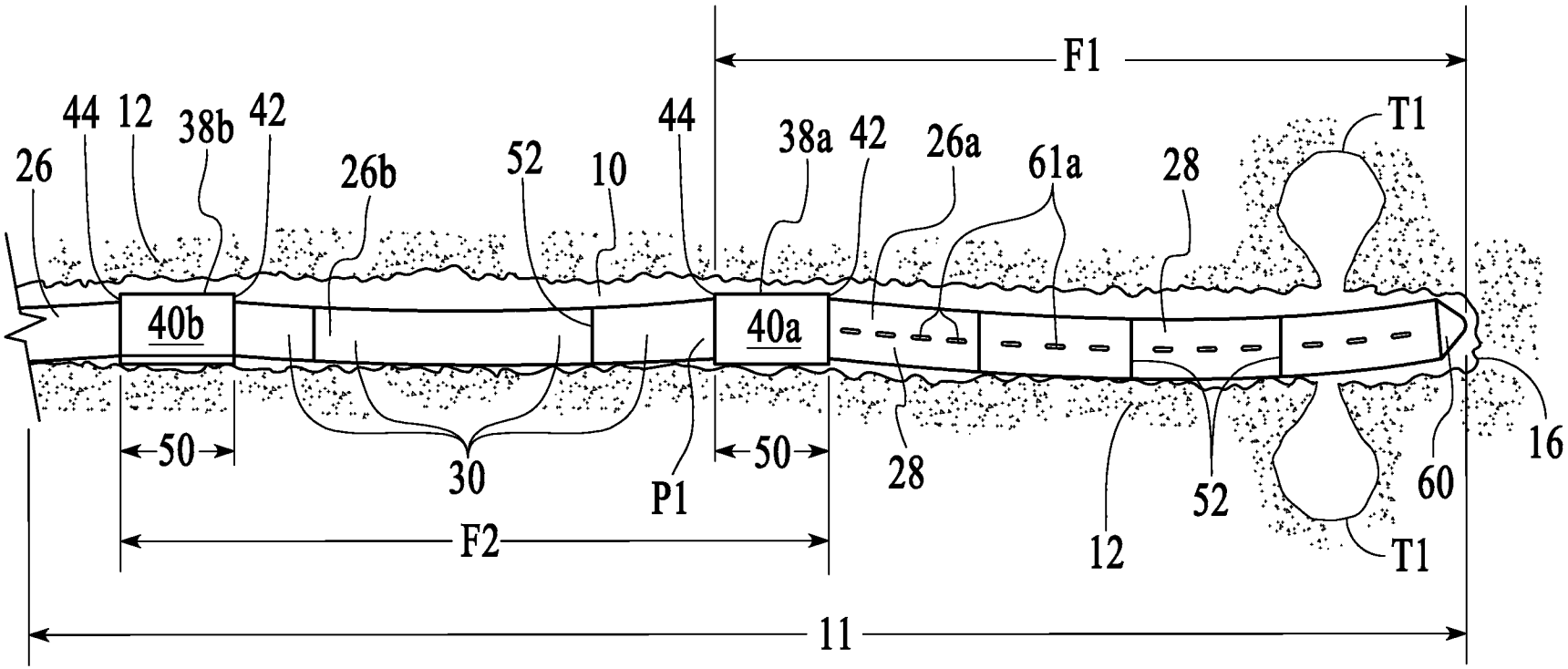

FIG. 1B illustrates a step of pumping a fracturing fluid down from the wellhead (not shown) and through tubular string 26 to the treatment section 26*a* and through the perforated openings 61*a*. The fracturing fluid is pumped into the openhole wellbore portion 10 in the first treatment interval F1 at a rate and pressure at least sufficient to initiate at least one fracture T1 in the surrounding subterranean formation 12. Depending on the nature of the surrounding subterranean formation 12, the fracture T1 can be formed anywhere along the length of the first treatment interval F1. The first Venturi section 40*a* helps maintain fluid pressure within the first treatment interval F1 of the openhole wellbore portion 10 so that substantial amounts of the fracturing fluid and treatment pressure does not escape uphole of the treatment interval F1.

As is hereinafter explained in detail, after fracturing the first treatment interval F1, the interior passageway (not shown) of the tubular string 26 can be plugged in the downhole first Venturi section 40*a* or uphole of the first Venturi section 40*a*, for example, at about a position of P1 illustrated in FIG. 1A to prevent any pumped fluid from reaching the tubular string openings 61*a* in the first treatment interval F1. The internal plug positioned at P1 is adapted to prevent fluid from reaching the treatment section 26*a*.

Figure 1C:
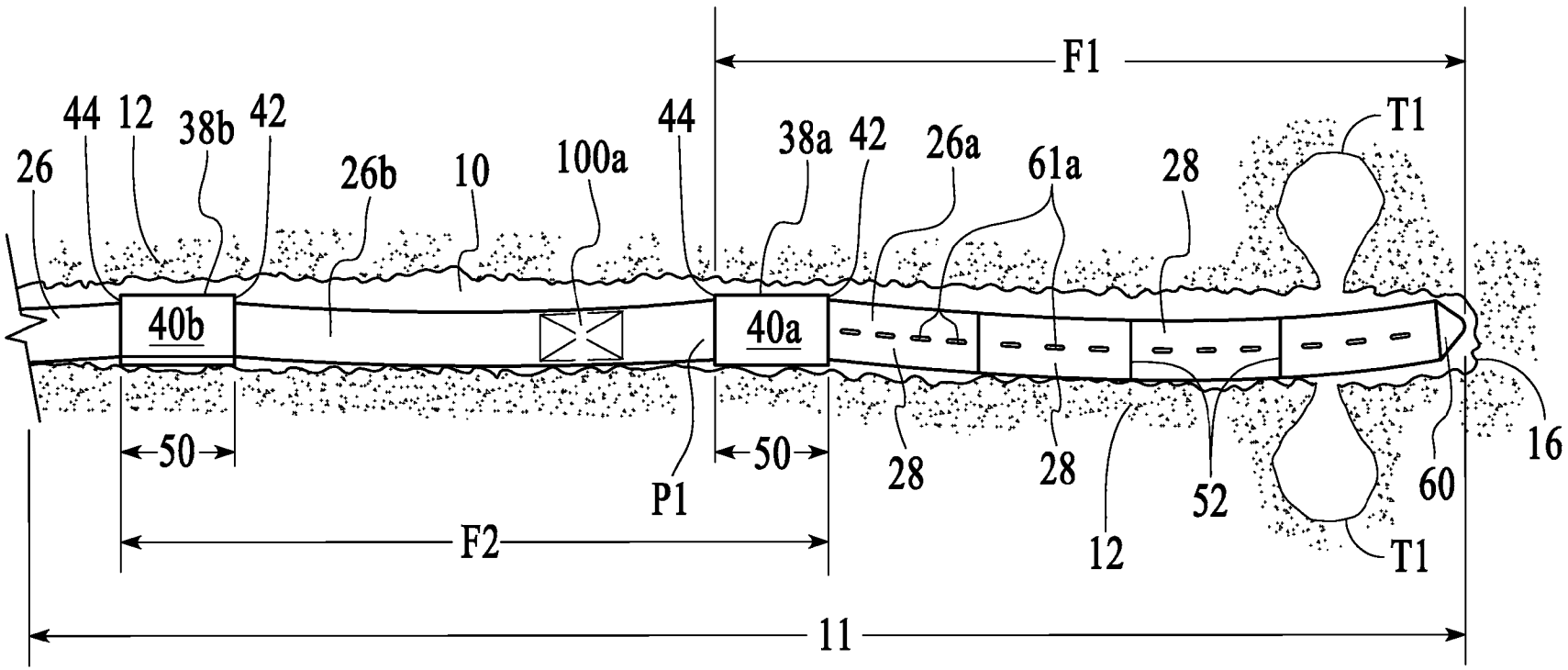

FIG. 1C illustrates a step of plugging the interior passageway of the tubular string 26 with a plug 100*a*. The plug 100*a* can be of any conventional design, such as temporary or removable.

Figure 1D:
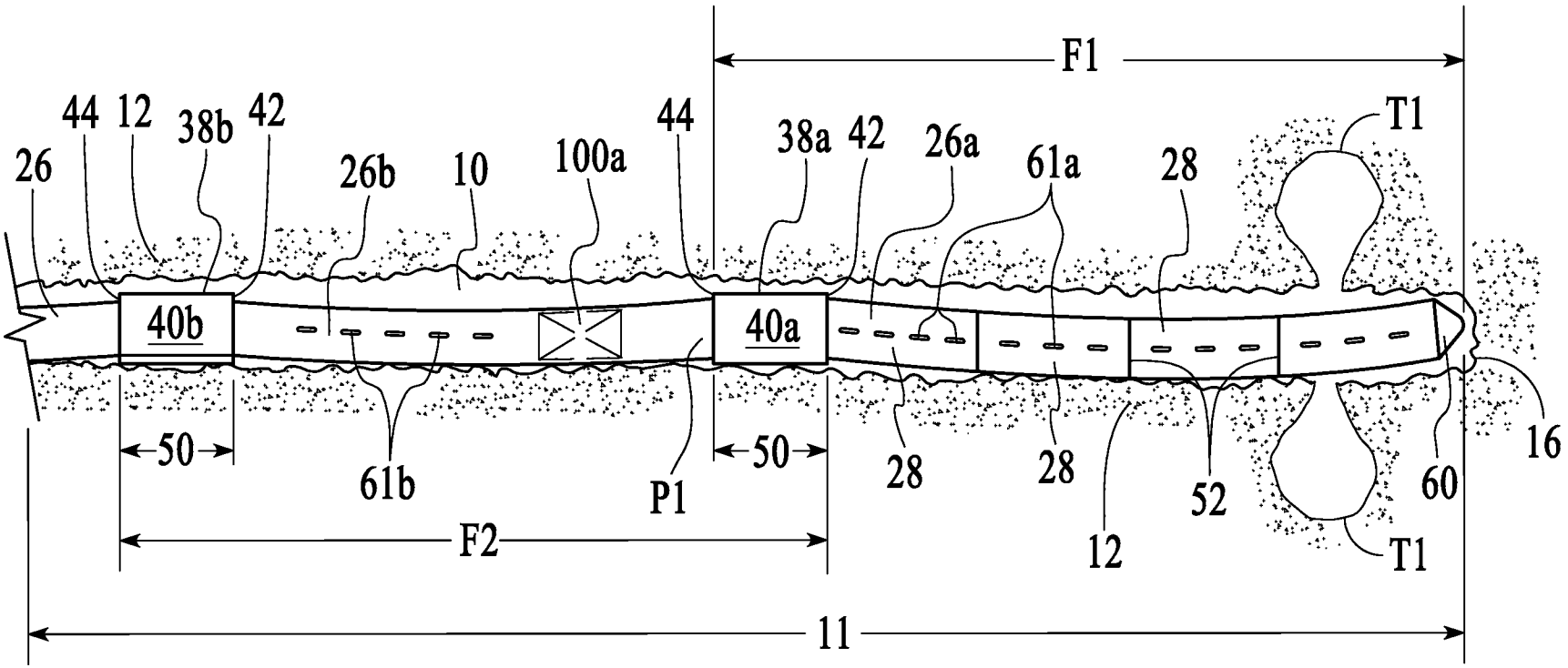

FIG. 1D illustrates a step of opening or creating openings 61*b* in the treatment section 26*b* of the tubular string 26 for the second treatment interval F2 between the two Venturi sections 40*a* and 40*b*. As will be appreciated by a person of skill in the art, a step of perforating to create the openings 61*b* can be accomplished, for example, with a perforating charge mounted on a perforating gun (not shown) run into or positioned in the tubular string 26. It is contemplated that the openings 61*b* can be pre-formed before running in the tubular string 26 into the openhole wellbore portion 10, provided that the openings 61*b* are initially blocked or closed during the prior step of pumping a fracturing fluid down from the wellhead (not shown) and through tubular string 26 to the treatment section 26*a* and through the perforated openings 61*a* Moreover, it is contemplated that the step of opening pre-formed openings 61*b* could be accomplished, for example, by moving a sliding sleeve or bursting a rupture disk to uncover or unblock the pre-formed openings 61*b*.

The sequence of the steps of plugging the interior passageway of the tubular string and opening or creating openings 61*b* is not critical, but may be performed in any practical order.

Figure 1E:
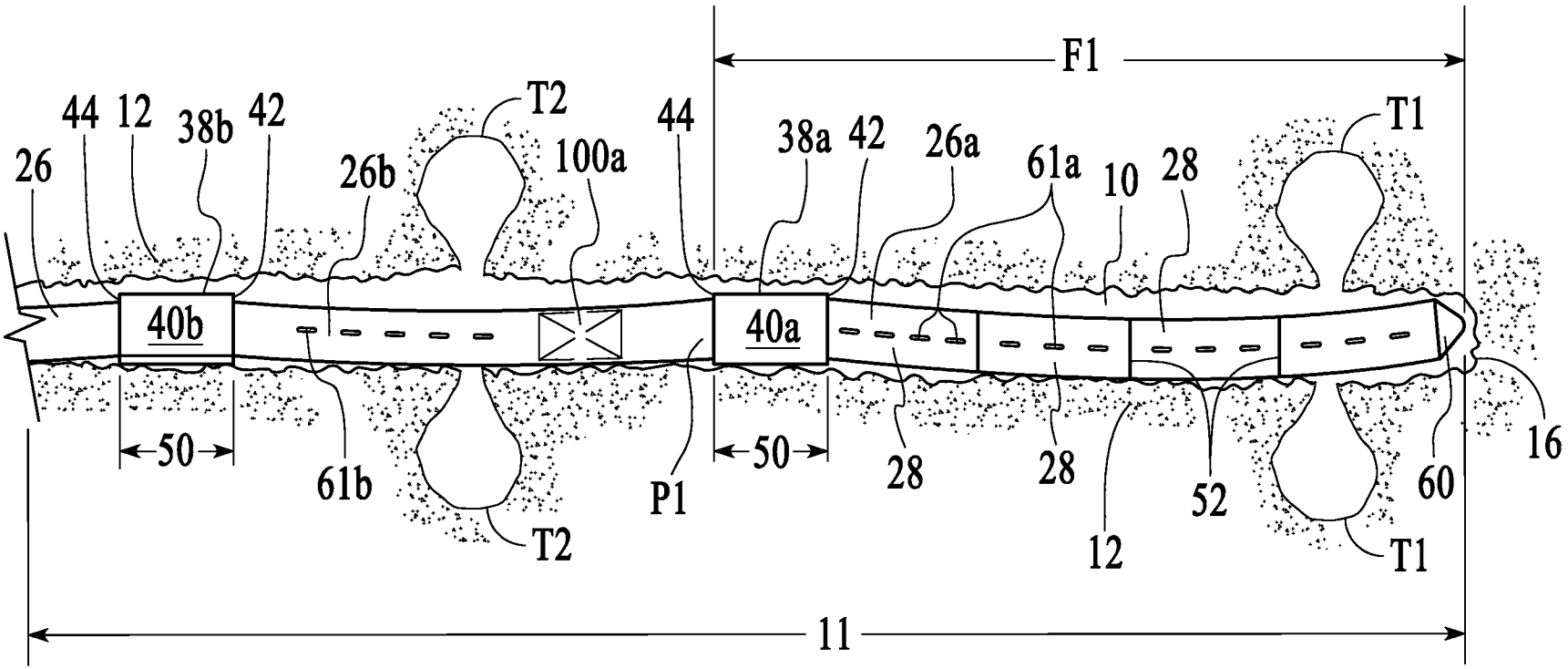

FIG. 1E illustrates a step of pumping a fracturing fluid down from the wellhead (not shown) and through the tubular string 26 to the treatment section 26*b* for the second treatment interval F2 and through the newly created perforations 61*b*. The fracturing fluid is pumped into the openhole wellbore portion 10 in the second treatment interval F2 (indicated in FIGS. 1A-D) at a rate and pressure at least sufficient to initiate at least one fracture T2 in the surrounding subterranean formation 12. In this step, the downhole and uphole Venturi sections 40*a* and 40*b* illustrated in FIG. 1A are adapted to help maintain fluid pressure within the second treatment interval F2. Depending on the nature of the surrounding subterranean formation 12, the fracture T2 can be formed anywhere along the length of the second treatment interval F2. As will be appreciated by a person of skill in the art, no packing in the annular space between the tubular string and the borehole of the openhole wellbore portion is set downhole relative to the first Venturi section to effect hydraulic isolation of the second treatment interval F2 for the step of pumping.

As will be appreciated by a person of skill in the art, the various steps according to the method can be repeated in any practical sequence to fracture additional uphole treatment intervals. For example, the steps of the process illustrated in FIGS. 1C-E can be sequentially repeated one or more additional times in additional treatment intervals (not shown in FIGS. 1A-1E) that are located uphole of the treatment interval F2 to fracture multiple treatment intervals along the openhole wellbore portion 10.

Figure 2:
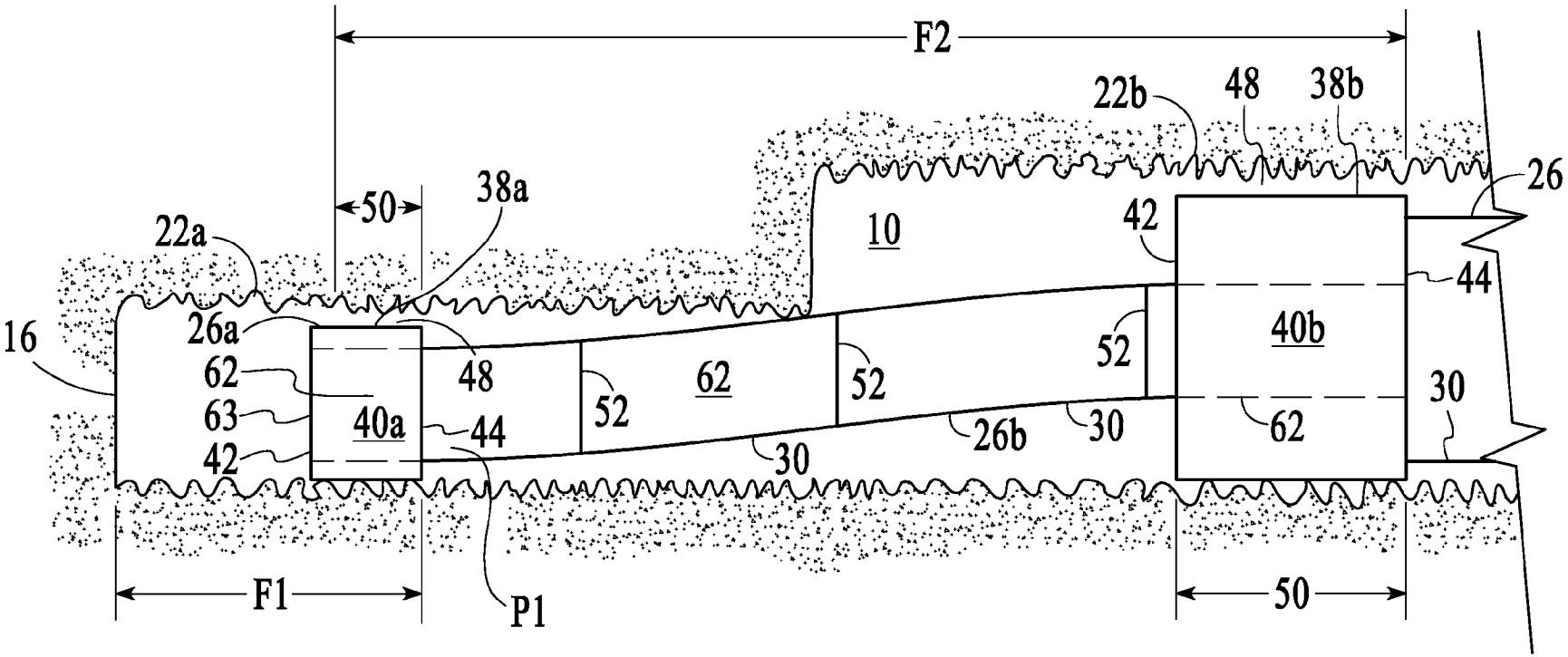
FIG. 2 is side view (not to scale) similar to FIG. 1A, but illustrating that a openhole wellbore portion 10 (for example, as a toe portion 11 of a openhole wellbore portion 10 that is horizontal) can have portions with different wellbore diameters, for example, for a first wellbore portion 22*a* and a second wellbore portion 22*b*.

FIG. 2 is side view (not to scale) similar to FIG. 1, but illustrating that an openhole wellbore portion 10 (for example, a toe portion 11 of a horizontal openhole wellbore portion 10) can have portions with different wellbore diameters, for example, for a first wellbore portion 22*a* and a second wellbore portion 22*b*.

More particularly, FIG. 2 is a side view (in a vertical plane parallel to the axis) illustrating part of a treatment plan for a toe portion 11 of an openhole wellbore portion 10. A tubular string 26 is run into the toe portion 11 of the openhole wellbore portion 10. In this case, the tubular string 26 includes, for example, a plurality of non-perforated joints 30, a first Venturi member 38*a* having a first Venturi section 40*a*, a second Venturi member 38*b* having a second Venturi section 40*b*, and a plurality of connecting collars 52. Each of the Venturi sections 40*a* and 40*b* has a downhole end 42 and an uphole end 44. In this embodiment, like in the embodiment illustrated in FIGS. 1A-E, the Venturi sections 40*a* and 40*b* have axially continuous nominal outside diameters, such that the downhole end 42 and an uphole end 44 thereof, respectively, define a summational axial length 50 for each of the Venturi sections. As illustrated in FIG. 2, an axial passageway 62 extends through the tubular members of the tubular string 26.

It is to be observed that the tubular string opening for the treatment interval F1 adjacent the toe end 16 of the openhole wellbore portion can be merely an end opening 63 at the downhole end 42 of the most downhole Venturi section 40*a*. The tubular string opening for the second treatment interval F2 uphole relative to the first treatment interval can be one or more openings anywhere along the tubular portion between the Venturi sections 40*a* and 40*b* illustrated in FIG. 2.

In addition, although the view of FIG. 2 is not to scale, the uphole Venturi section 40*b* is both larger in diameter and axially longer than the downhole Venturi section 40*a*. This is because of the nominal wellbore diameter of wellbore portion 22*b* in which the uphole Venturi section 40*b* is positioned is larger than the nominal wellbore diameter of wellbore portion 22*a* in which the downhole Venturi section 40*a* is positioned.

The steps of the treatment plan in FIG. 2 are otherwise similar to those described for the treatment plan of FIGS. 1A-E.

Creating Venturi Effect in an Openhole Wellbore Portion

Constricted Cross-Sectional Area for Fluid Flow

According to the method of fracturing an openhole wellbore portion, creating a small cross-sectional area between the outer wall of a Venturi section and the wall of an openhole wellbore portion along at least one axial position causes a constricted cross-sectional area through which fluid can flow. This creates a Venturi effect, which creates a back-pressure across the constricted cross-sectional area.

According to an embodiment, preferably the nominal outside diameter of the summational length of the Venturi section is equal to or greater than 96% of the nominal wellbore diameter for fracturing of an openhole wellbore portion.

According to another embodiment, preferably the cross-sectional profile of the Venturi section defines an area equal to or greater than 92% of the nominal cross-sectional area of the openhole wellbore portion. According to yet another embodiment, preferably the cross-sectional area of the Venturi section, including the passageway therein, blocks an area equal to or greater than 92% of the nominal cross-sectional area of the openhole wellbore portion.

Length of Venturi Section for Openhole Wellbore Portion

According to the method of fracturing an openhole wellbore portion, the Venturi section has at least a sufficient summational length so that, despite "normal" variations in the nominal wellbore diameter, the nominal outside diameter of the Venturi section is highly probable to form an actual constricted cross-sectional area that is equal to or less than the nominally constricted cross-sectional area. Preferably, the length of the Venturi section is at least sufficient such that it has a probability of at least 95% of forming an actual constricted cross-sectional area in the nominal diameter of the wellbore.

For example, it is currently believed that for most wellbore applications and environments in a wellbore having a nominal diameter of 3.5", the Venturi section should have an effective or summational length of at least 2 feet, which is at least a factor of 7, that is, 24"/3.5". For example, it is currently believed that for most wellbore applications and environments in a wellbore having a nominal diameter of 6", the Venturi section should have an effective or summational length of at least 3.5 feet, which is at least a factor of 7, that is, 42"/6".

More preferably, this factor is at least 10. For example, it is currently believed that for most wellbore applications and environments in a wellbore having a nominal diameter of 6", the Venturi section should have an effective or summational length of at least 5 feet, which is at least a factor of 10, that is, 60"/6". In a wellbore penetrating a subterranean formation that may have particularly poor structural integrity, it may be necessary or desirable to have higher length factor.

In addition, a longer axial length of a constricted cross-sectional area through which fluid can flow provides a back pressure due to fluid flow resistance, which also increases as the viscosity of the fluid increases. For this additional reason, it is preferable that the length factor for the Venturi section be at least 10 relative to the nominal wellbore diameter.

It is to be understood that the profile or cross-sectional area can vary along the summational axial length of the Venturi section.

Summational Axial Length can be Continuous or Discontinuous

As used herein, a "summational axial length" recognizes that a Venturi section can have a discontinuous outside diameter wherein some axial length portions of the Venturi section can be separated by axial length portions having a nominal outside diameter that is substantially less than required for a Venturi section or to create a substantial Venturi effect. The summational axial length of the Venturi section can be, but need not be, axially contiguous. Preferably, the cross-sectional profile along the summational axial length of the Venturi section is circular. Most preferably, the summational axial length of the Venturi section is contiguous and the cross-sectional outside profile of the tubular wall along the summational axial length of the Venturi section is circular.

Preferably, the summational axial length of the Venturi section is within an axial span that is equal to or less than 20 times the nominal wellbore diameter for fracturing of an openhole wellbore portion.

Strength & Materials of Venturi Section

Preferably, the Venturi section of the tubular string consists essentially of metal. Preferably, the Venturi section has at least sufficient structural strength to withstand a pressure differential of at least 1,000 psi across any axially contiguous portion of the summational axial length.

Preferably, the nominal outside diameter of the Venturi section does not substantially increase by the swelling of the material of the Venturi section. More preferably, the material of the Venturi section does not swell greater than 5% by volume in the presence of any of deionized water, 9.6 lb/gal NaCl water, or diesel when tested at the bottomhole temperature and pressure for 10 days. Most preferably, the material of the Venturi section does not swell greater than 1% by volume in the presence of any of deionized water, 9.6 lb/gal NaCl water, or diesel when tested at the bottomhole temperature and pressure for 10 days.

Preferably, the Venturi section of the tubular string is non-swellable, non-inflatable, and non-expandable.

Preferred Embodiments of a Venturi Section for Use in an Openhole Wellbore Portion The generally tubular wall of a Venturi section can have a nominally thicker cross-section along the summational length of the Venturi section than the nominal thickness of a generally tubular wall of an axially adjacent treatment section of the tubular string.

Figure 3:
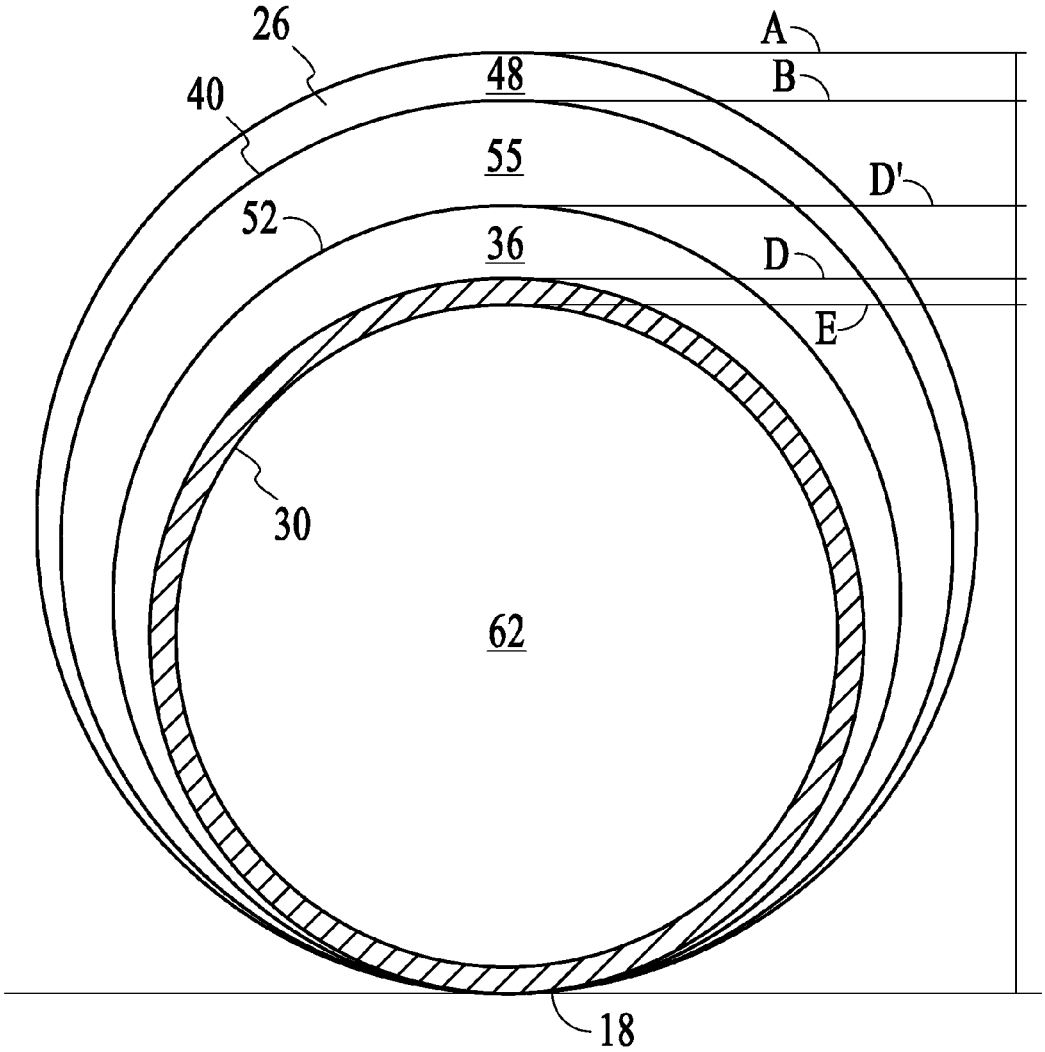
FIG. 3 is a cross-sectional view (in a plane perpendicular to the axis) (approximately to scale) taken along lines 3-3 of FIG. 1A.

FIG. 3 is a cross-sectional view (in a plane perpendicular to the axis) (approximately to scale) taken along lines 3-3 of FIG. 1. FIG. 3 illustrates the nominal wellbore diameter A (of a portion of the openhole wellbore portion 10 illustrated in FIG. 1A) having a tubular string 26 run in, the tubular string 26 including a joint 30, a collar 52, and a Venturi section 40. The cross-sectional view is taken at about a mid-point of the 40-foot joint 30 such that the middle portion of the tubular members of the tubular string 26 are illustrated sagged toward the bottom wall 18 of the openhole wellbore portion 10, which is illustrated as being a horizontal wellbore portion An axial passageway 62 extends through the tubular members of the tubular string 26. In the illustrated embodiment of FIG. 3, the openhole wellbore portion 10 has a nominal wellbore diameter A of 6 inches, the Venturi section 40 has a nominal outside diameter B of 5.75 inches, the joint 30 has a nominal outside diameter D of 4.5 inches, the collar 52 has a nominal outside diameter D' of 5 inches, and the axial passageway 62 has through the tubular members has a nominal inside diameter E of 4.0 inches.

The combined cross-sectional crescent-shaped areas 36, 55, and 48 between the nominal outside diameter D of a joint 30 and the nominal wellbore diameter A of an openhole wellbore portion 10 illustrates a cross-sectional crescent-shaped area, which can be in a treatment interval of the openhole wellbore portion 10. The cross-sectional crescent-shaped area 48 between the nominal outside diameter B of the Venturi section 40 and the nominal wellbore diameter A illustrates a nominally constricted cross-sectional area provided by the Venturi section. The nominally constricted cross-sectional area 48 reduces fluid flow from the treatment interval. The nominally constricted cross-section area 48 is for creating a Venturi effect at least one axial location across the summational axial length of a Venturi section 40. At some point axially along the summational axial length of a Venturi section 40 (not shown in FIG. 3) depending on the varying shape of the openhole wellbore portion 10, the nominally constricted cross-sectional area 48 should be actually achieved to produce the desired Venturi effect.

Figure 4:
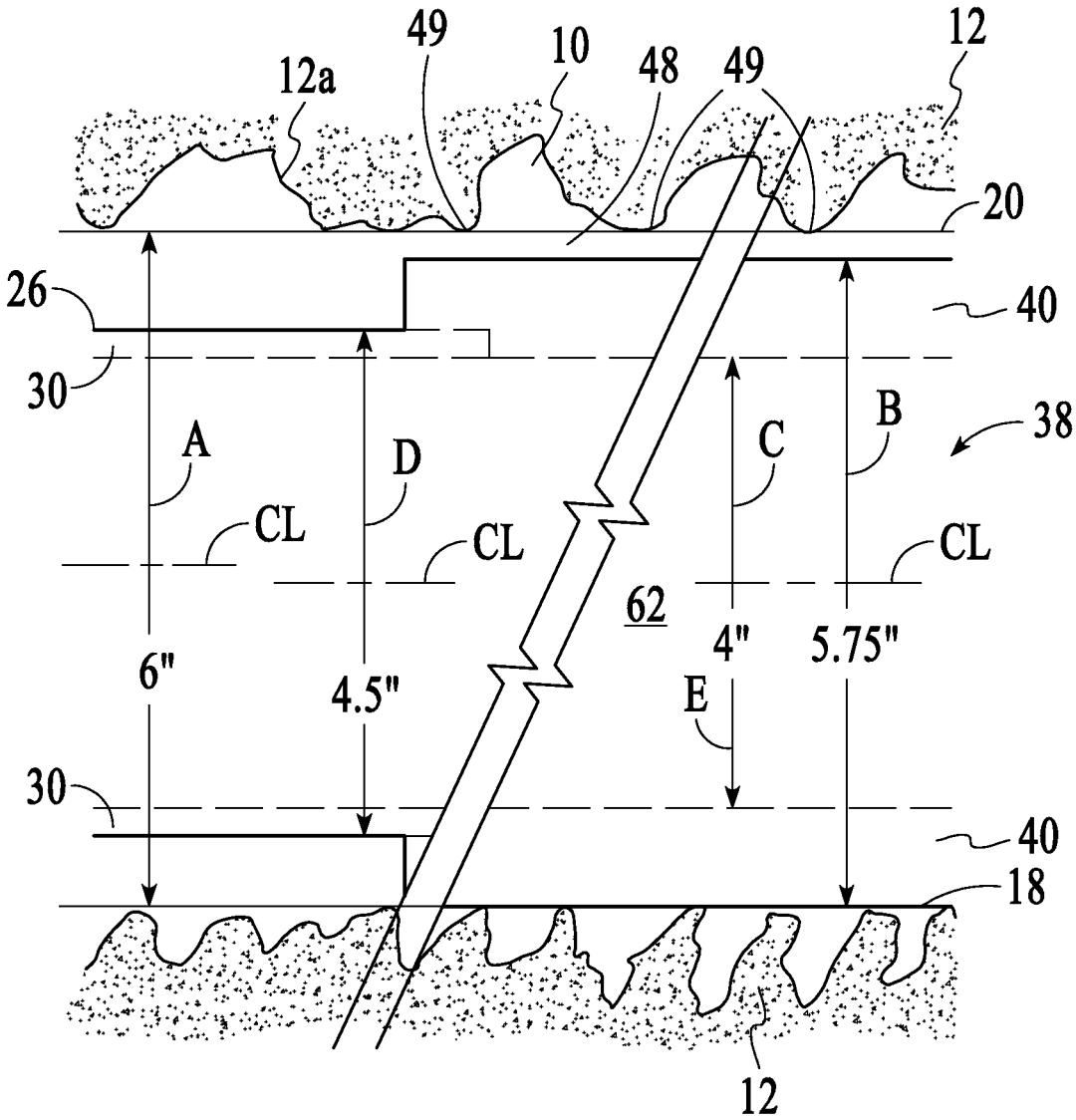
FIG. 4 is a side view (in a vertical plane parallel to the axis) (approximately to scale) of a wellbore portion 10 having a nominal wellbore diameter A of 6 inches (6"), a nominal bottom wall 18, and a nominal top wall 20, but illustrating that the wellbore wall 12*a* (sometimes referred to as the borehole) is actually irregular. A tubular string 26 is illustrated run into the openhole wellbore portion 10. The tubular string 26 includes a joint 30 having a nominal outside diameter D of 4.5 inches (4.5"), and a Venturi section 40 having a nominal outside diameter B of 5.75 inches (5.75").

FIG. 4 is a side view (in a vertical plane parallel to the axis) (approximately to scale) of an openhole wellbore portion 10 having a nominal wellbore diameter A ("hole") of 6 inches (6"). The openhole wellbore portion 10 is illustrated as being substantially horizontal. The wellbore portion 10 has a nominal bottom wall 18, and a nominal top wall 20, but illustrating that the wellbore wall 12*a* of the openhole wellbore portion 10 is actually irregular.

Continuing to refer to FIG. 4, a tubular string 26 is illustrated run into the openhole wellbore portion 10. The tubular string 26 can includes a joint 30 having a nominal outside diameter D of 4.5 inches (4.5") and a nominal inside diameter E of 4.0 inches (4.0"), and a Venturi section 40 having a nominal outside diameter B of 5.75 inches (5.75"). The joint 30 and the Venturi section 40 can be integrally formed or connected via a threaded connection (not shown). An axial passageway 62 extends through the tubular string 26. In the embodiment of illustrated in FIG. 4, the Venturi section 40 has a nominal inside diameter C, which in this case is the same as the nominal inside diameter E of the joint 30, and which is the diameter of the portion of the passageway 62 extending through the Venturi section 40 of the tubular string 26. The Venturi section 40 is illustrated lying on the bottom irregular wall of the wellbore.

As indicated in FIG. 4, the actual constricted cross-sectional area 48 (the area between the top outside diameter B of the Venturi section 40 and the upper wellbore wall 12*a* of the horizontal openhole wellbore portion 10) along much of the axial length (not completely illustrated in FIG. 4) of the Venturi section 40 may not be equal to or less than the nominally constricted cross-sectional area 48. The summational axial length of the Venturi section is adapted to be at least sufficient so that there is a high probability that at least one cross-sectional location 49 along the summational axial length of the Venturi section the actual constricted cross-section area is in fact equal to or less than the nominally constricted cross-sectional area, thereby providing the full expected Venturi effect. In addition, the axial length of the constricted cross-sectional area(s) at or along such one or more locations 49 along such a Venturi section helps maintain fluid pressure within a treatment interval.

Figure 5:
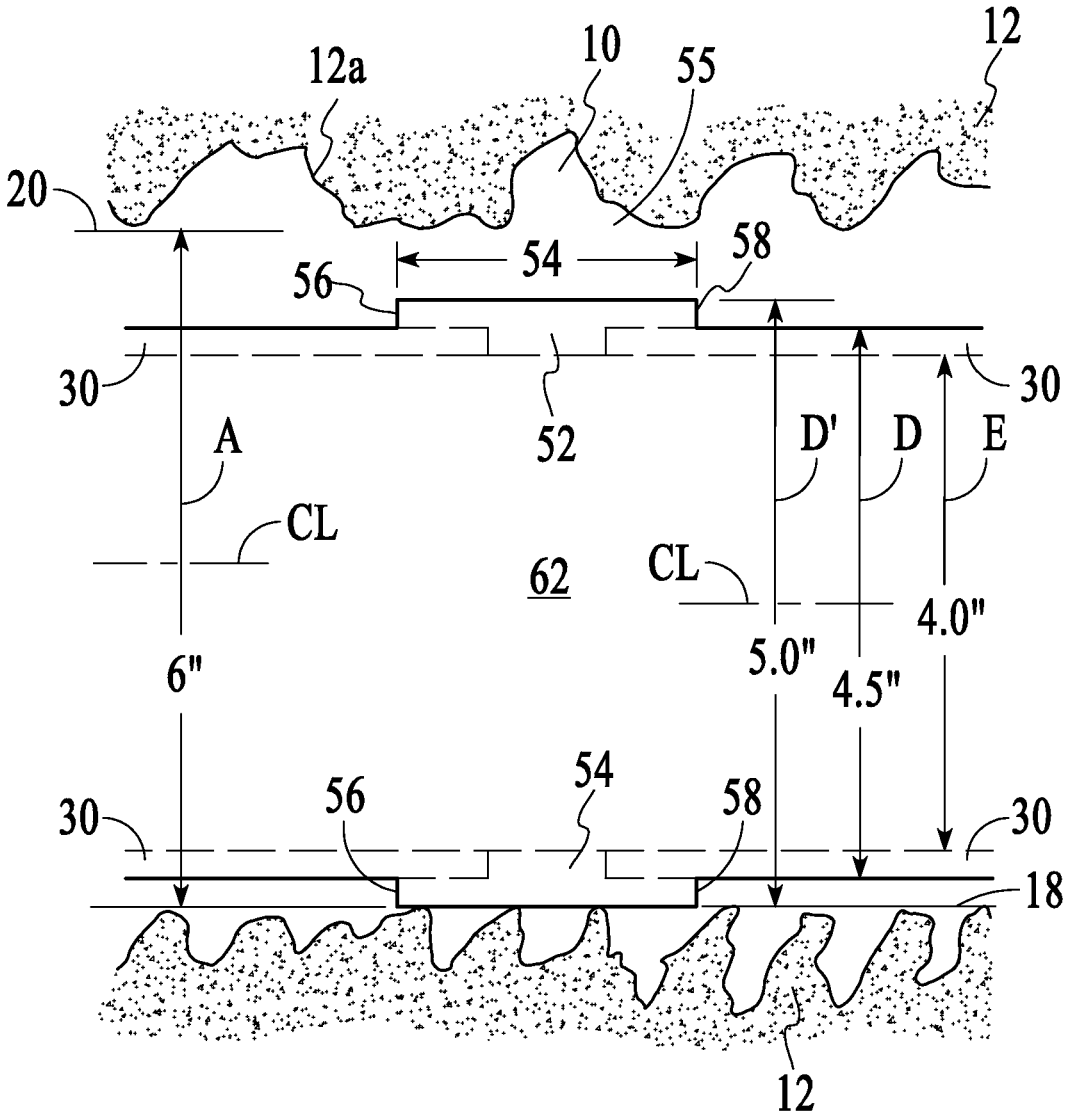
FIG. 5 is a side view (in a vertical plane parallel to the axis) (approximately to scale) of an openhole wellbore portion 10 formed in a subterranean formation 12. The wellbore portion 10 has a nominal wellbore diameter A of 6 inches (6").

FIG. 5 is a side view (in a vertical plane parallel to the axis) (approximately to scale) of an openhole wellbore portion 10 formed in a subterranean formation 12. The wellbore portion 10 has a nominal wellbore diameter A (sometimes referred to as a "hole") of 6 inches (6"). FIG. 5 illustrates the ends of two tubular members, such as joints 30 having nominal outside diameters D of about 4.5 inches (4.5"). The ends of the joints 30 are illustrated connected by a tubular collar 52 having a nominal outside diameter D' of 5.0 inches. FIG. 5 again illustrates that that the wall 12*a* of the openhole wellbore portion 10 may be irregular. It is believed that the tubular collar 52 has either a nominal outside diameter D' or an axial length 54 between downhole end 56 and uphole end 58 that is too small to provide an appreciable Venturi effect in the cross-sectional area 55 along and between the tubular collar 52 and the wall 12*a* of the openhole wellbore portion 10. A conventional collar 52 is believed to not appreciably help maintain fluid pressure within any treatment interval.

Figure 6A:
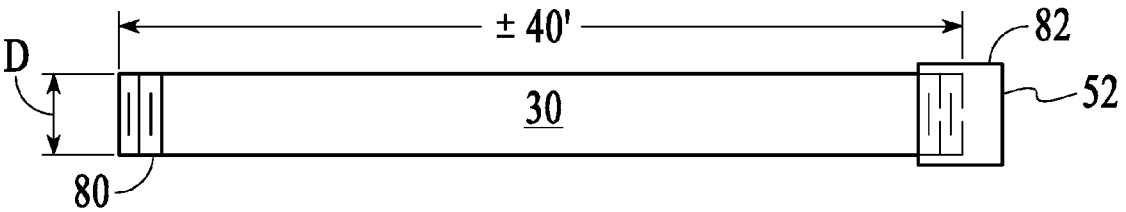
FIGS. 6A-6C are side views (in a plane parallel to the axis) of a tubular member, which together illustrate an example of a processes for making a tubular member 38 to include a Venturi section 40. In particular.
Figure 6B:
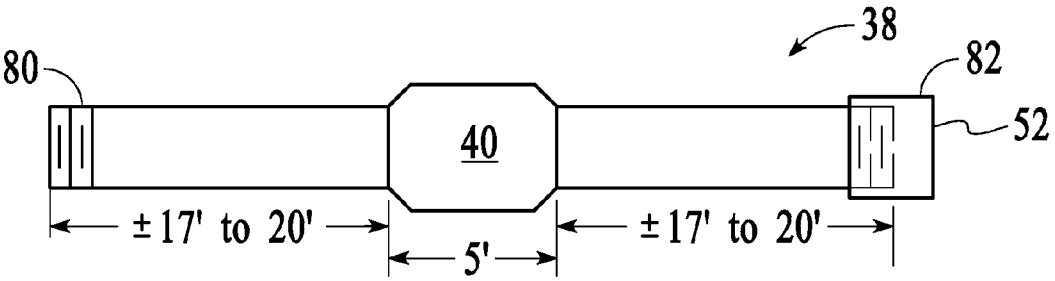
Figure 6C:
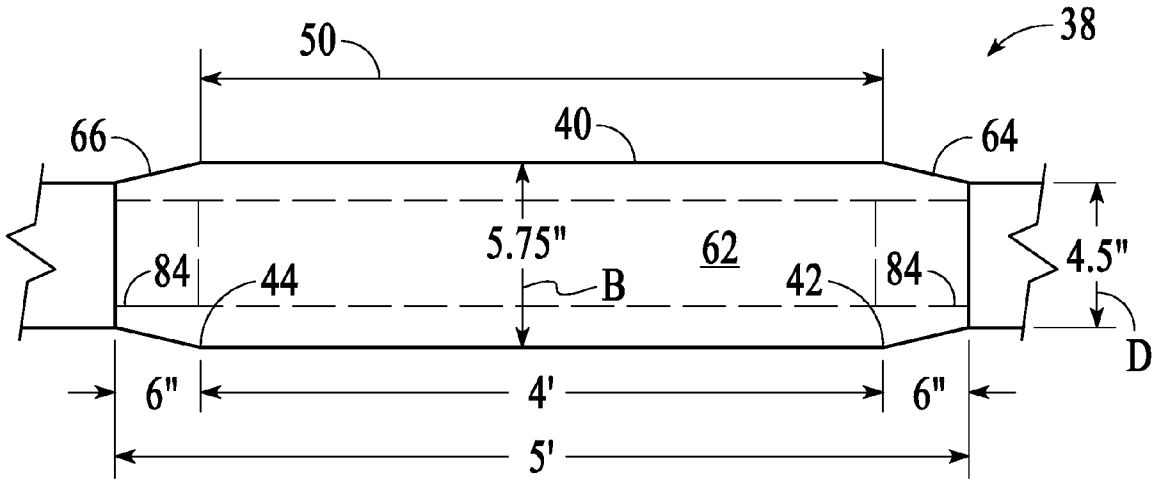

A presently most-preferred embodiment for a Venturi section for use in a method according to the invention is structurally similar to a blast joint. FIGS. 6A-C are side views (in a plane parallel to the axis) of a tubular member, which together illustrate an example of a processes for making a tubular member to include a Venturi section 40. In particular, FIG. 6A is a side view (in a plane parallel to the axis) (not to scale) of an example of a tubular member, in this case a ±40 foot (40') non-perforated joint 30 having a nominal outside diameter D of about 4.5 inches. This joint 30 can have a pin connector 80 at either end (for connection through, for example, a collar 52, as illustrated at one end), however, any suitable connector can be used at either end of the joint 30.

A length can be cut out of a central section of the joint 30, for example, a length of about 5 feet, into which a Venturi section 40 can be inserted, as shown in FIG. 6B. FIG. 6B is a side view (in a plane parallel to the axis) (not to scale) of a tubular member having a Venturi section 40 inserted into the cut joint 30 of FIG. 6A. The Venturi section 40 has a nominal outside diameter B of about 5.75 inches and has a summational axial length of about 4 feet long (excluding the 6 inch long tapered connector portions 64 and 66 at the downhole end 42 and uphole end 44, respectively, of the Venturi section 40). This nominal outside diameter B is believed to be about the minimum suitable nominal outside diameter along a minimum summational axial length 50 for use in a portion of an openhole wellbore having a nominal wellbore diameter A of 6 inches. Smaller dimensions for a Venturi section for use in a wellbore having a nominal wellbore diameter A of 6 inches would not be expected to provide a sufficient Venturi effect for maintain fluid pressure within a treatment interval.

FIG. 6C is a side view (in a plane parallel to the axis) (not to scale) of a Venturi section 40 having connections 84 at each end to the remainder of the Venturi member 38 (as illustrated in FIG. 6B). Each of the connections 84 can be of any suitable type, for example, welded or threaded.

Figure 7:
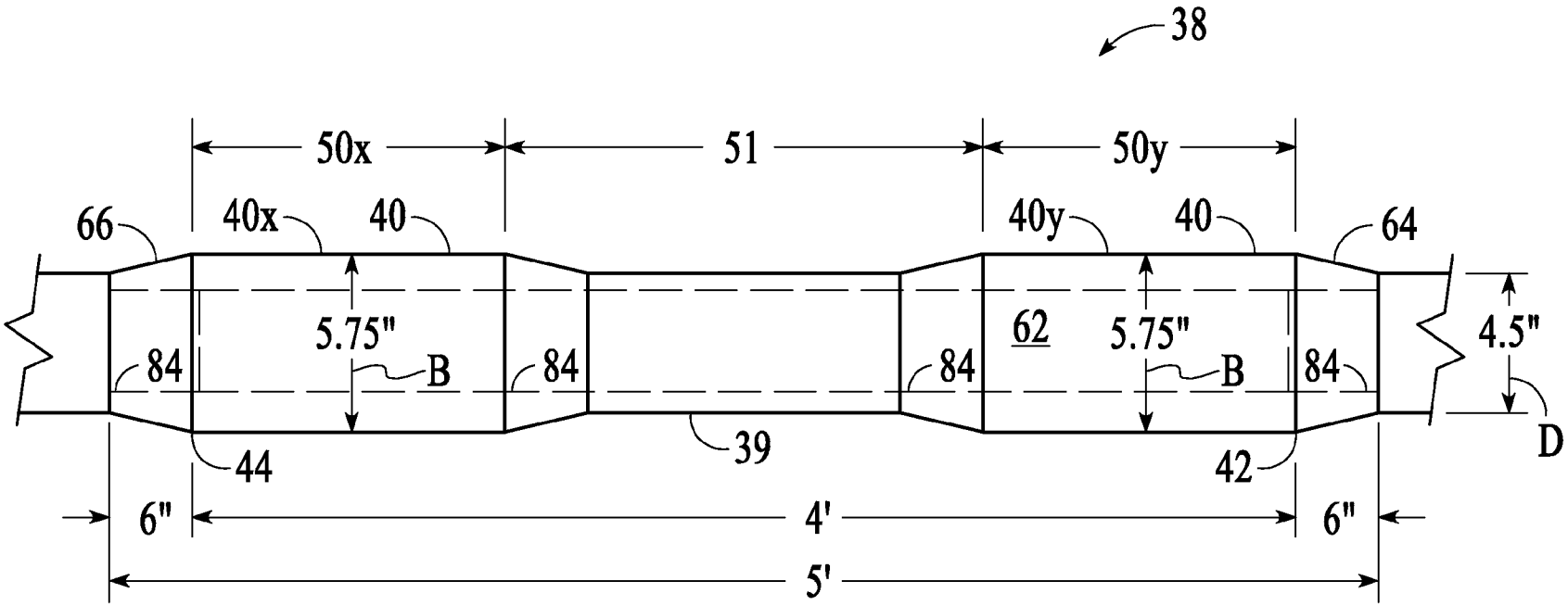
FIG. 7 is a side view (in a plan parallel to the axis) (not to scale) of a tubular member 38 including a Venturi section 40 for use according to an embodiment of the invention. In this embodiment, the nominal outside diameter B of the Venturi section 40 is axially discontinuous along the length thereof, which axial portions 50*x* and 50*y* are summed to provide a summational axial length.

FIG. 7 is a side view (in a plan parallel to the axis) (not to scale) of a tubular member 38 including a Venturi section 40 for use according to an embodiment of the invention. This embodiment is similar to the embodiment illustrated in FIG. 6C, except the nominal outside diameter B of the Venturi section 40 is axially discontinuous along the axial length thereof. In other words, the Venturi section 40 can have axially separated Venturi portions 40*x* and 40*y*, each having an axial length 50*x* and 50*y*. The several sections or portions of the Venturi member 38 illustrated in FIG. 7 are connected at connections 84, which can be of any suitable type.

The axial lengths 50*x* and 50*y* are summed to determine a "summational axial length" of the Venturi section 40. The axial length 51 of the tubular portion 39 of the Venturi member 38 has a nominal tubular outside diameter that is smaller than the Venturi outside diameter B. The nominal tubular outside diameter of the tubular portion 39 can be, for example, the same as the outside diameter D of an adjacent joint 30. The axial length 51 does not contribute to the summational axial length of the Venturi section 40 between ends 42 and 44 of Venturi section 40.

According to the method of fracturing an openhole wellbore portion, the summational axial length of a Venturi section is at least seven (7) times the nominal wellbore diameter in which the Venturi section is to be used. For example, if the embodiment of a Venturi section 40 as illustrated in FIG. 7 is to be used in an openhole wellbore having a nominal wellbore diameter of 6", the summational axial length of the axial lengths 50*x* plus 50*y* is preferably greater than seven times the nominal wellbore diameter, that is, greater than 42" (3.5').

According to the method of fracturing an openhole wellbore portion, preferably the summational axial length of a Venturi section is within an axial span that is equal to or less than twenty (20) times the nominal wellbore diameter in which the Venturi section is to be used. For example, if the embodiment of a Venturi section 40 as illustrated in FIG. 7 is to be used in an openhole wellbore having a nominal wellbore diameter of 6", the total sum of the axial lengths 50*x* plus 51 plus 50*y* is preferably less than twenty (20) times the nominal wellbore diameter, that is, the total sum of the axial lengths 50*x* plus 51 plus 50*y* is preferably less than 120" (10').

A Venturi section does not have any opening in the tubular wall along the axial span of the summational axial length thereof that would allow fluid to flow from the passageway to outside the tubular string. For example, in the embodiment of a Venturi section 40 as illustrated in FIG. 7, there is no opening in the tubular wall along the total sum of the axial lengths 50*x* plus 51 plus 50*y* that would allow fluid to flow from the passageway 62 to outside a tubular string including the Venturi section 40.

It is to be understood that although two axial lengths 50*x* and 50*y* are employed, three or any other number of such axial lengths can be summed to provide the desired summational axial length for a Venturi section 40 of an Venturi member 38. It is also to be understood that the axial lengths such as 50*x* and 50*y* of a Venturi section 40 can be on different tubular members, provided that the desired summational axial length is achieved.

Figure 8A:
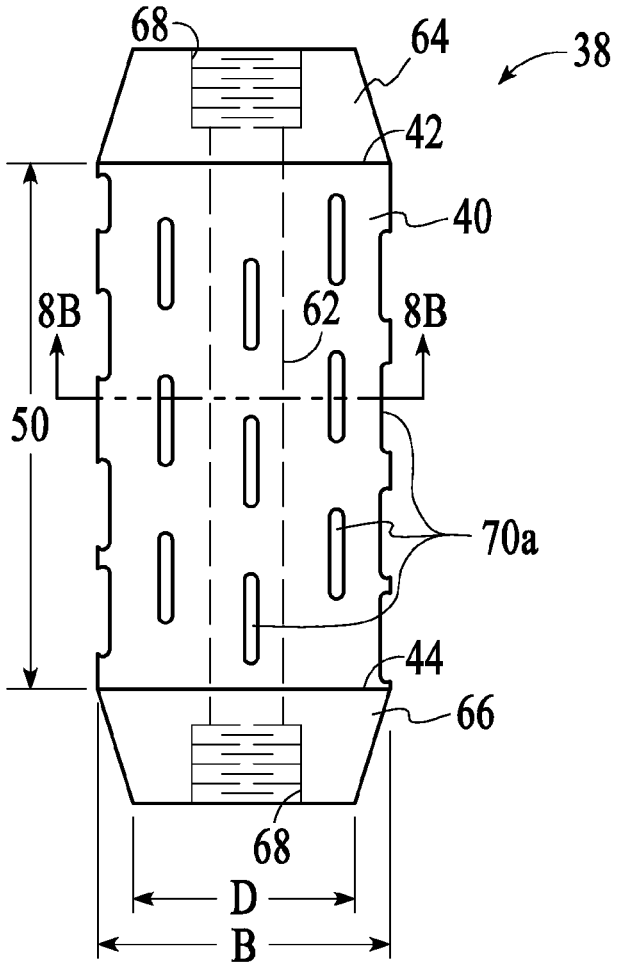
FIG. 8A is a side view (in a plane parallel to the axis) (not to scale) of a tubular member 38 including a Venturi section 40 for use according to an embodiment of the invention. In this embodiment, the outside surface of the Venturi section 40 of the tubular member 38 has a plurality of lengthwise grooves 70*a*.

FIG. 8A is a side view (in a plane parallel to the axis) (not to scale) of a tubular member 38 including a Venturi section 40 for use according to an embodiment of the invention. The Venturi section 40 has nominal outside diameter along B a summational axial length 50 between ends 42 and 44. In this embodiment, the outside surface of the Venturi section 40 of the tubular member 38 has a plurality of lengthwise grooves 70*a*. The tubular member 38 has an axial passageway 62, illustrated in dashed lines. According to this embodiment, each end 64 and 66 of the tubular member 38 has female threads 68, illustrated in dashed lines. The tubular member 38 preferably includes tapered portions 64 and 66 adjacent the downhole and uphole ends 42 and 44, respectively, of the Venturi section 40, as shown.

In the embodiment illustrated in FIG. 8A, the outside surface of the Venturi section 40 of the tubular member 38 has a plurality of lengthwise grooves 70*a*. These grooves 70*a* are inside the nominal outside diameter B along the Venturi section 40 of the tubular member. The grooves 70*a* are radially staggered and lengthwise so as not to allow fluid flow inside the nominal outside diameter along the entire summational axial length 50 of the outside tubular wall of the Venturi section 40. It is believed that such grooves 70*a* may provide eddy currents in fluid flow between the outside wall of the Venturi section and a wellbore portion, which may help build up particulate in the constricted cross-sectional flow area and help block additional fluid flow.

Figure 8B:
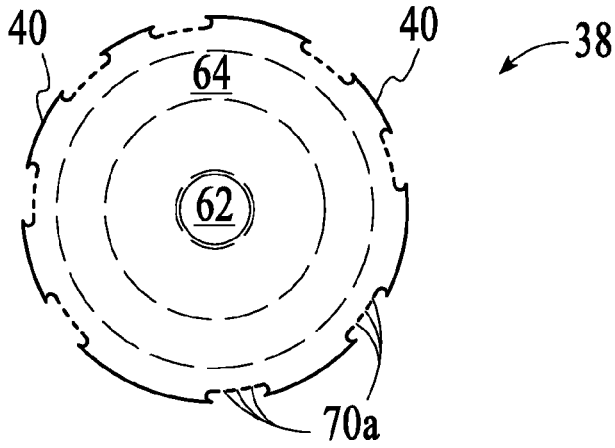
FIG. 8B is a cross-sectional view (in a plane perpendicular to the axis) (approximately to scale) taken along lines 8B-8B through the embodiment of the tubular member 38 shown in FIG. 8A.

FIG. 8B is a cross-sectional view (in a plane perpendicular to the axis) (approximately to scale) taken along lines 8B-8B through the embodiment of tubular member 38 shown in FIG. 8A. The axial passageway 62 is shown on the interior of the tubular member 38. FIG. 8B includes the cross-sectional profile (in a plane perpendicular to the axis) of the surface of the tubular member shown in FIG. 8A. The grooves 70*a* are radially staggered and lengthwise so as not to allow fluid flow inside the nominal outside diameter B along the summational axial length 50 of the outside tubular wall of the Venturi section 40. Accordingly, the cross-sectional profile could optionally vary along the summational axial length 50 of the Venturi section 40.

Figure 9A:
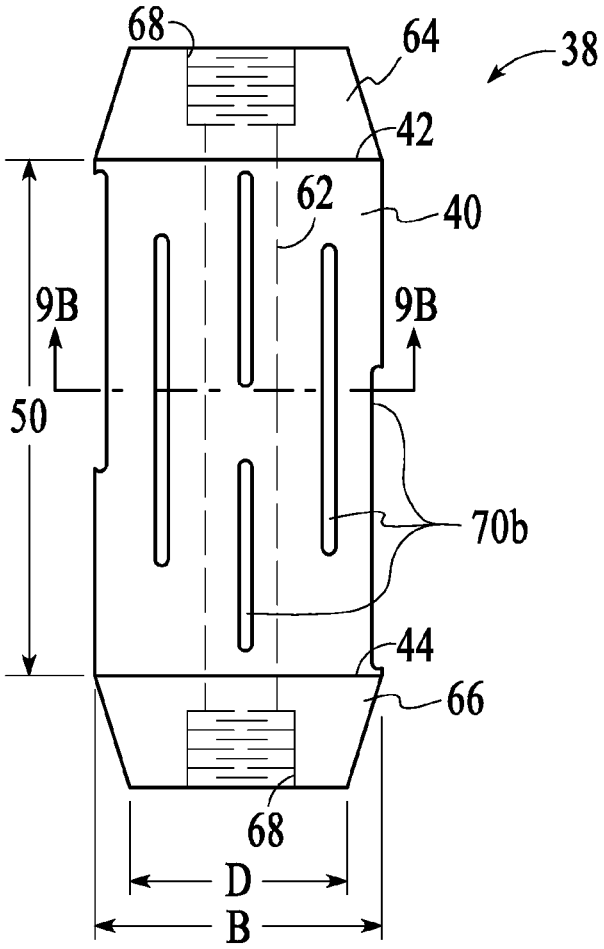
FIG. 9A is a side view (in a plane parallel to the axis) (not to scale) of another variation of a tubular member 38 including a Venturi section 40 for use according to an embodiment of the invention (similar to the embodiment of a tubular member 38 illustrated in FIG. 8A, but having a different design for the Venturi section). The grooves 70*b* illustrated for the embodiment of FIG. 9A are longer and fewer than the grooves 70*a* illustrated for the embodiment of FIG. 8A.

FIG. 9A is a side view (in a plane parallel to the axis) (not to scale) of another variation of a tubular member 38 including a Venturi section 40 for use according to an embodiment of the invention. The embodiment of FIG. 9A is similar to the tubular member 38 illustrated in FIG. 8A, but has a different design for outside surface of the Venturi section 40. In this embodiment, the Venturi section 40 has nominal outside diameter along B a summational axial length 50 between ends 42 and 44. The tubular member 38 shown in FIG. 9A has an axial passageway 62. Similar to the embodiment of FIG. 8A, in this embodiment in FIG. 9A the tubular member 38 has female threads 68 in tapered portions 64 and 66.

In the embodiment of FIG. 9A, the outside surface of a Venturi section 40 of the tubular member 38 has a plurality of lengthwise grooves 70*b*. These grooves are inside the nominal outside diameter B along the Venturi section 40 of the tubular member. The grooves 70*b* are radially staggered and lengthwise so as not to allow fluid flow inside the nominal outside diameter along the entire length of the outside tubular wall. The grooves 70*b* illustrated for the embodiment of FIG. 9A are longer and fewer than the grooves 70*a* illustrated for the embodiment of FIG. 8A. It is believed that such grooves 70*b* may provide eddy currents in fluid flow between the outside wall of the Venturi section 40 and the wellbore, which may help build up particulate in the constricted cross-sectional flow area and help block additional fluid flow.

Figure 9B:
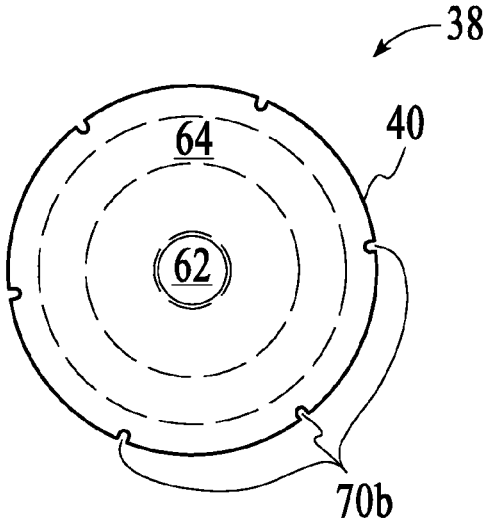
FIG. 9B is a cross-sectional view (in a plane perpendicular to the axis) (approximately to scale) taken along lines 9B-9B through the embodiment of the tubular member 38 shown in FIG. 9A.

FIG. 9B is a cross-sectional view (in a plane perpendicular to the axis) (approximately to scale) taken along lines 9B-9B through the embodiment of the tubular member 38 shown in FIG. 9A. The axial passageway 62 is shown on the interior of the tubular member. FIG. 9B includes the cross-sectional profile (in a plane perpendicular to the axis) of the surface of the tubular member shown in FIG. 9A. The cross-sectional profile can vary along the summational axial length 50 of the Venturi section 40.

Figure 10:
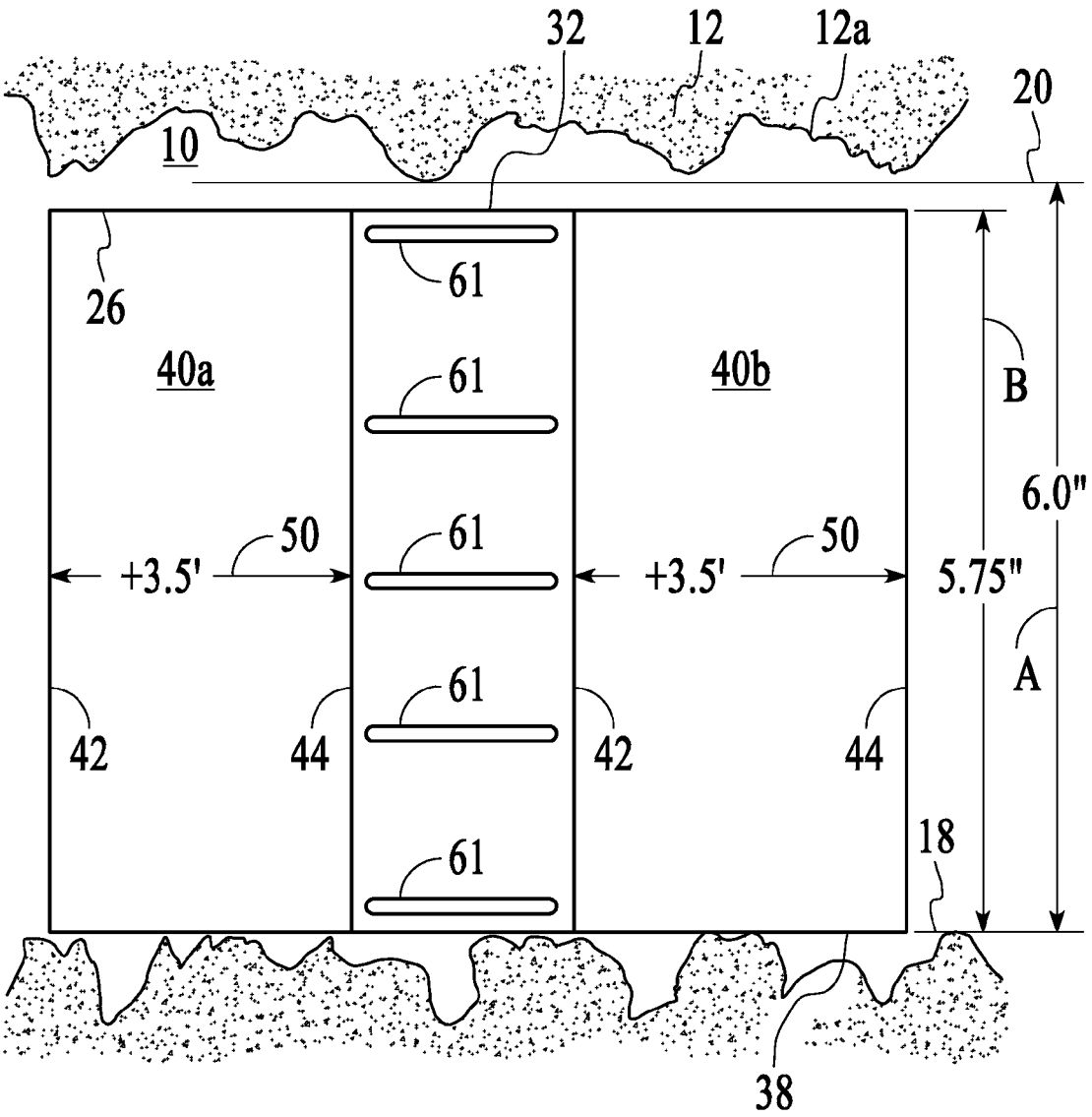
FIG. 10 is side view (in a vertical plane parallel to the axis) (roughly to scale) of a portion of a openhole wellbore portion 10 that is horizontally formed in a subterranean formation 12. Positioned in the openhole wellbore portion is a tubular string 26 that includes a downhole first Venturi section 40*a*, a fracturing sleeve type of treatment section 32, and an uphole second Venturi section 40*b*. The Venturi member 38 of the portion of the tubular string 26 illustrated in FIG. 10 have a common nominal outside diameter B of 5.75 inches.

FIG. 10 is side view (in a vertical plane parallel to the axis) (roughly to scale) of a portion of a openhole wellbore portion 10 formed substantially horizontally in a subterranean formation 12. Positioned in the horizontal openhole wellbore is a tubular string 26 that includes a downhole first Venturi section 40*a*, a fracturing sleeve type of treatment section 32, and an uphole second Venturi section 40*b*. The Venturi member 38 of the portion of the tubular string 26 illustrated in FIG. 10 have a common nominal outside diameter B of 5.75 inches. The treatment section 32 can have any suitable number and design of openings 61.

The treatment section 32 has one or more tubular string openings 61. The treatment section 32 can be of any suitable treatment length, provided it is not too long for the entire tubular section of the first Venturi section 40*a*, the treatment section 32, and the second Venturi section 40*b* to be practically run in the openhole wellbore portion 10. Each of the uphole and downhole Venturi sections 40*a* and 40*b* is at least 3.5 feet (42 inches long), which is at least equal to seven (7) times the nominal wellbore diameter A of 6 inches (6"). In this illustrated embodiment of FIG. 10, the first Venturi section 40*a*, the treatment section 32, and the second Venturi section 40*b* are integrally formed into a single Venturi member 38. The sections 40*a*, 32, and 40*b* can be separate and then connected into a tubular string 26 with threaded connections or collars (not shown in FIG. 10). In addition, each of the sections 40*a*, 32, and 40*b* can be a single, integrally formed section or can be formed of separate sub-sections that are connected into a tubular string 26 with threaded connections or collars (not shown in FIG. 10).

Figure 11A:
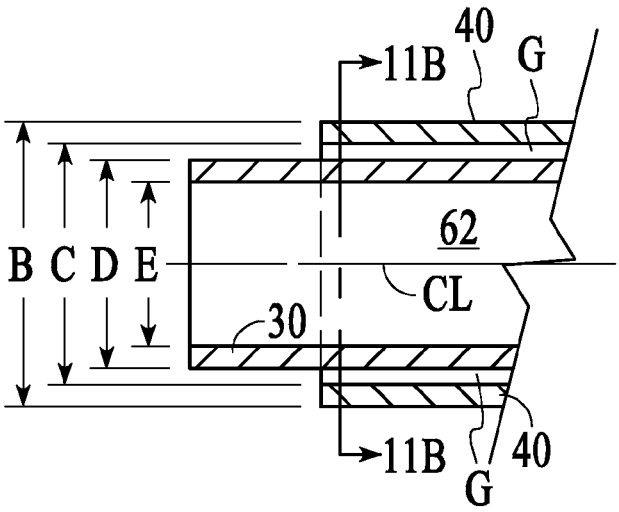
FIGS. 11A-C illustrate another embodiment of a Venturi section according to the invention, wherein an axially-elongated Venturi member 38, in the form of a slip-on Venturi member, is illustrated as being slipped over the outside tubular wall a typical tubular string portion, such as a length of a joint 30. The Venturi member 38 providing a Venturi section 40 can slide along the length of the tubular joint 30. In particular.
Figure 11B:
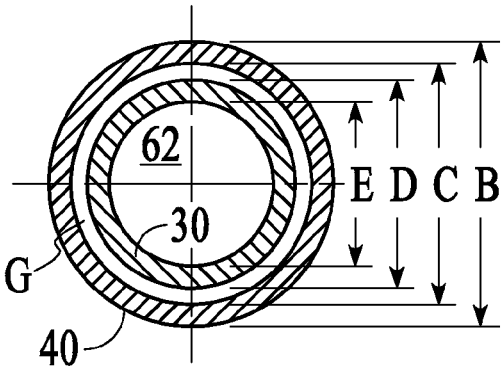
Figure 11C:
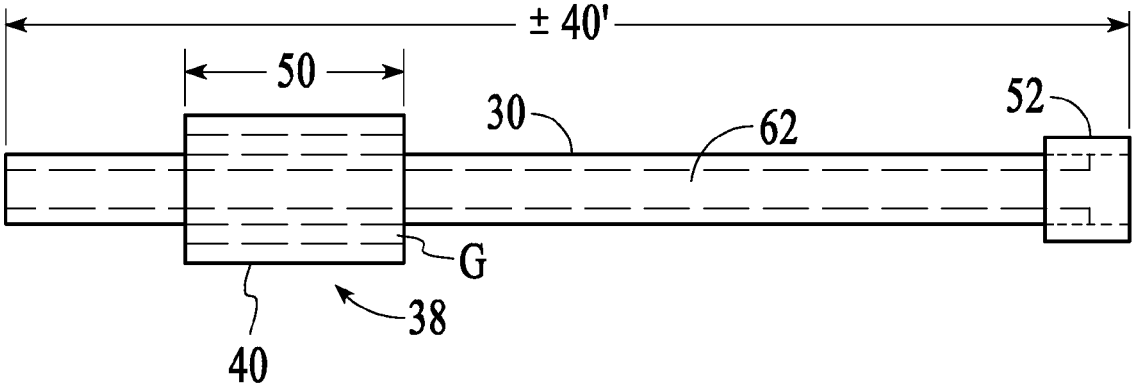

FIGS. 11A-C illustrate another embodiment of a Venturi section according to the invention, wherein an axially-elongated Venturi member 38, in the form of a slip-on Venturi member, is illustrated as being slipped over the outside tubular wall a typical tubular string portion, such as a length of a joint 30. The Venturi member 38 providing a Venturi section 40 can slide along the length of the tubular joint 30.

In particular, FIG. 11A is a cross-sectional view (in a plane including the axis axis) (not to scale) of a Venturi member 38 in the form of a sleeve adapted to slide over a non-perforated joint 30. FIG. 11B is a cross-sectional view (in a plane perpendicular to the axis) (not to scale) taken along lines 11B-11B of FIG. 11A. As indicated in FIGS. 11A and 11B, the Venturi member 38 in the form of a sleeve has Venturi section 40 with a nominal outside diameter B and a nominal inside diameter C. A length of a portion of a tubular string joint 30 has an outside diameter D and an inside diameter E. An axial passageway 62 extends through the center of the tubular joint 30. A clearance or gap G is shown between the inside diameter C of the Venturi member 38 and the outside diameter D of the tubular string joint 30. The length of the portion of a tubular string joint 30 is illustrated with a pin connector 80 having male threaded ends, but any suitable connector can be used. Preferably, as illustrated in FIGS. 11A-B, the Venturi member in the embodiment of a sleeve can slide over at least the connector at one end of the length of portion of the tubular string. In FIGS. 11A-B, the Venturi section 40 and the tubular string joint 30 are illustrated having common, concentric axes along a center line CL.

FIG. 11C illustrates a side view of the Venturi member 38 of FIGS. 11A and 11B in a slidable position on the tubular string, such as a 40-foot long joint 30. Preferably, as illustrated in FIG. 11C, when formed as a sleeve, the Venturi member 38 can slide over at least the pin connector 80 at one end of the length of portion of the tubular string joint 30. Preferably, however, as illustrated in FIG. 11C, the Venturi member 38 cannot slide beyond a connector, collar 52, or other structure at another portion or end of the tubular string joint 30.

Referring to all of FIGS. 11A-C, a small clearance or gap G is engineered between the inside diameter C of the Venturi member and the outside diameter D of the length portion of the tubular joint 30. The small clearance or gap G is adapted to allow the Venturi member to slide over the outside diameter D of outer tubular wall of the tubular joint 30, but preferably does not provide an appreciable flow path for fluid flow across the summational axial length 50 of the Venturi section 40.

In addition, as will be appreciated by a person of skill in the art, two (2) times the clearance or gap G is preferably subtracted from the nominal outside diameter B of such a Venturi section 40 for the determination of whether the nominal outside diameter of such a Venturi section 40 is effectively equal to or greater than 93% of the nominal wellbore diameter. This effective diameter relates to an effectively blocked cross-sectional area. The cross-sectional area of any such flow path outside the tubular string for fluid flow across the summational axial length 50 of the Venturi section 40 would diminish the Venturi effect. If the tubular string 26 is run in the openhole wellbore portion (not shown in FIGS. 11A-C) such that the Venturi section 40 would be expected to abut the connector or collar 52 at the end of the joint shown in FIG. 11C, however, it would be expected that such an abutment would block fluid flow through the gap G. Nevertheless, unless the Venturi member is pinned or otherwise held in such an abutting position, such a closure of the gap G may not be obtained.

Figure 12:
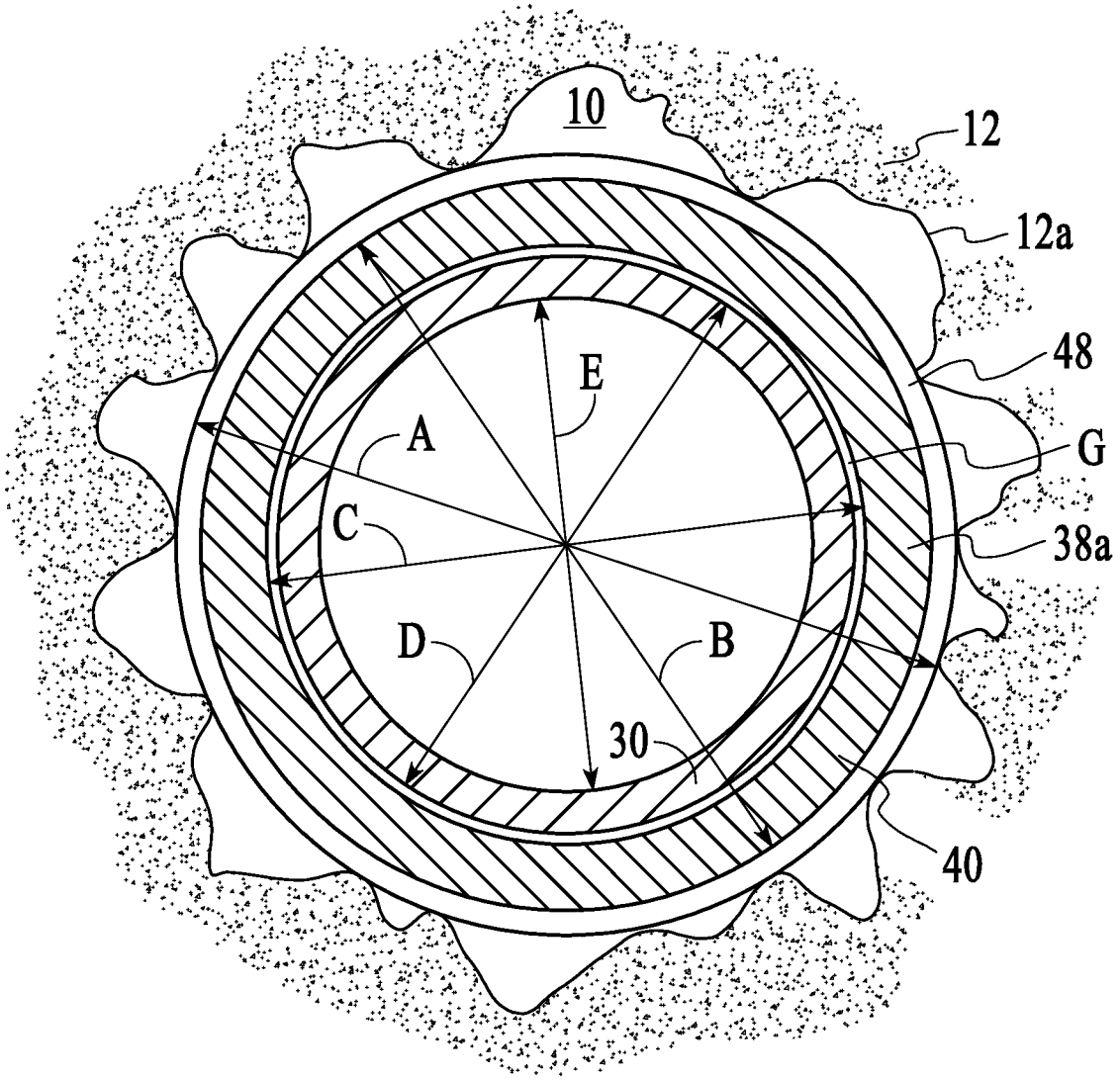
FIG. 12 is a cross-sectional view (in a plane perpendicular to the axis) (approximately to scale) of a profile of a Venturi member 38 having a Venturi section 40 positioned over a tubular joint 30 according to the embodiment illustrated in FIG. 11A.

FIG. 12 is a cross-sectional view (in a plane perpendicular to the axis) (approximately to scale) of a profile of a Venturi member 38 having a Venturi section 40 positioned over a tubular joint 30 according to the embodiment illustrated in FIG. 11A. FIG. 12 additionally illustrates the assembly concentrically positioned in an openhole wellbore portion 10 having a nominal wellbore diameter A. In FIG. 12, the Venturi member 38 is illustrated positioned on a joint 30 of a tubular string.

In addition, FIG. 12 is a cross-sectional view illustrating a Venturi member 38 according to the sleeve embodiment of FIGS. 11A-C as run in an openhole wellbore portion 10. FIG. 12 illustrates a nominal wellbore diameter A, a nominal Venturi section outside diameter B, a nominal Venturi section inside diameter C, a nominal joint outside diameter D, and a nominal joint inside diameter E. The cross-sectional area between the nominal wellbore diameter A and the nominal Venturi section outside diameter B defines a constricted flow area 48. The cross-sectional area between the nominal Venturi section inside diameter C and the nominal joint outside diameter D defines a clearance or gap G. It will be appreciated by one of skill in the art that both the constricted flow area 48 between the outer surface of the Venturi section 40 and the area of gap G should be taken into account as the effective cross-sectional area of the potential fluid flow around the Venturi section 40 of this embodiment.

Methods of Fracturing a Cased Wellbore Portion

According to a third invention, a method of fracturing a cased wellbore portion of a well is provided, the method comprising the steps of:

(A) obtaining a fracturing job design having at least one treatment interval for the cased wellbore portion, wherein the treatment interval:

(1) has a nominal cross-sectional area defined by the nominal casing inside diameter of the casing of the cased wellbore portion; and (2) has an uphole end and a downhole end;

(B) running a tubular string into the treatment interval, wherein the tubular string has an axial passageway;

(C) before or after the step of running, forming one or more tubular string openings in the tubular string, wherein after the step of running, the one or more tubular string openings are positioned in the treatment interval;

(D) before or after the step of running, forming one or more casing openings in the casing of the treatment interval;

(E) except for the axial passageway of the tubular string, blocking at least 86% of the nominal cross-sectional area of the treatment interval that is between one of the ends of the treatment interval and the axially closest of the one or more tubular string openings, wherein the blocking is along a summational axial length that is at least one inch, and, except for the axial passageway of the tubular string, leaving unblocked at least 4% of the nominal cross-sectional area of the treatment interval that is along an entire axial length between the end of the treatment interval and the axially closest of the one or more tubular string openings; and (F) pumping a fracturing fluid through the tubular string, through the one or more tubular string openings, and through the one or more casing openings at a rate and pressure sufficient to initiate at least one fracture in the subterranean formation surrounding the treatment interval, wherein prior to the step of pumping, no packing of the tubular string is set uphole within 1,500 feet of the treatment interval.

The step of obtaining a fracturing job design can further comprise the step of designing the fracturing job design. In other situations, a fracturing job design can be obtained from another party, such as an engineering firm or a consultant.

Preferably, the step of blocking a cased wellbore portion:

extends for a summational axial length that is continuous for at least 2 times the nominal casing inside diameter; and does not have any opening in the tubular wall along the summational axial length thereof that would allow fluid to flow from the passageway to outside the tubular string.

Preferably, the step of blocking a cased wellbore portion is with a Venturi section. This is preferably adapted to create a Venturi effect.

Preferably, the step of blocking comprises blocking at least 92% of the nominal cross-sectional area of the treatment interval that is between the one of the ends of the treatment interval and the axially closest of the one or more tubular string openings to the one of the ends, wherein the blocking is along a summational axial length that is at least 2 times the nominal casing inside diameter.

Preferably, the step of blocking is with a Venturi section.

Preferably, this method further includes the step of: blocking at least 86% of the nominal cross-sectional area of the treatment interval that is between the other of the ends of the treatment interval and the axially closest of the one or more tubular string openings to the other of the ends, wherein the blocking is along a summational axial length that is at least one inch, and, except for the axial passageway of the tubular string, leaving unblocked at least 4% of the nominal cross-sectional area of the treatment interval that is along an entire axial length between the other of the ends of the treatment interval and the axially closest of the one or more tubular string openings to the other of the ends.

Preferably, prior to the step of pumping, no packing of the tubular string is set downhole within 1,500 feet of the treatment interval.

Preferably, the step of blocking of the treatment interval that is between the other of the ends of the treatment interval and the axially closest of the one or more tubular string openings comprises blocking at least 92% of the nominal cross-sectional area of the treatment interval that is between the other of the ends of the treatment interval and the axially closest of the one or more tubular string openings to the other of the ends, wherein the blocking is along a summational axial length that is at least one inch.

Preferably, wherein the step of blocking of the treatment interval that is between the other of the ends of the treatment interval and the axially closest of the one or more tubular string openings is with a Venturi section.

According to a fourth invention, a method of fracturing a cased wellbore portion of a well is provided. The cased wellbore portion has a nominal casing inside diameter defining a nominal cross-sectional area of the cased wellbore portion. The method comprises the steps of:

(A) running a tubular string having a Venturi section into the cased wellbore portion of the well;

(B) before or after the step of running, forming one or more tubular string openings in the tubular string to be located downhole relative to the upper end of the Venturi section of the tubular string, wherein:

(1) the one or more tubular string openings allow fluid to flow from the tubular string to outside the tubular string;

(2) the Venturi section has a generally tubular wall that has a passageway extending axially therein, wherein the passageway of the Venturi section is in fluid communication with the one or more tubular string openings;

(3) the one or more tubular string openings and the Venturi section are not axially separated by a closed internal plug within the tubular string; and (C) before or after the step of running, forming one or more casing openings in the casing to be located downhole relative to the upper end of the Venturi section of the tubular string; and (D) pumping a fracturing fluid through the tubular string, through the one or more tubular string openings, and through the one or more casing openings at a rate and pressure sufficient to initiate at least one fracture in the subterranean formation surrounding the cased wellbore portion, wherein prior to the step of pumping, no packing of the tubular string is set uphole within 1,500 feet of the Venturi section.

Preferably, the generally tubular wall of the Venturi section:

extends for a summational axial length that is continuous for at least 2 times the nominal casing inside diameter; and does not have any opening in the tubular wall along the summational axial length thereof that would allow fluid to flow from the passageway to outside the tubular string.

Preferably, no tubular string opening is formed uphole relative to the Venturi section.

According to a first embodiment of the fourth invention, the generally tubular wall of the Venturi section:

(a) has a nominal outside diameter that:

(i) during the step of running, is equal to or greater than 93% of the nominal casing inside diameter; and (ii) before the step of pumping, is not increased by greater than 1% from the nominal outside diameter during the step of running; and (b) has a cross-sectional profile that is circular.

According to a second embodiment of the fourth invention, the generally tubular wall of the Venturi section:

(a) has a cross-sectional profile that:

(i) during the step of running, defines an area equal to or greater than 86% of the nominal cross-sectional area of the inside of the casing of the cased wellbore portion; and (ii) before the step of pumping, is not increased by greater than 1% from the cross-sectional profile during the step of running;

(b) does not allow contiguous fluid flow that is between the passageway and the outside surface of the generally tubular wall.

According to a third embodiment of the fourth invention, the generally tubular wall of the Venturi section:

(a) has a cross-sectional area including the cross-sectional area of the passageway that:

(i) during the step of running, blocks an area equal to or greater than 86% of the nominal cross-sectional area of the inside of the casing of the cased wellbore portion; and (ii) before the step of pumping, is not increased by greater than 1% from the cross-sectional area during the step of running.

According to a fourth embodiment of the fourth invention, the generally tubular wall of the Venturi section is adapted to provide at least a sufficient Venturi effect between the tubular string and the inside casing wall of the cased wellbore portion so that during the step of pumping a fracturing fluid, the Venturi effect contains a sufficient pressure of the fracturing fluid in the casing of the cased wellbore to initiate the at least one fracture in the subterranean formation surrounding the cased wellbore portion.

Creating Venturi Effect in a Cased Wellbore Portion

The method of fracturing a cased wellbore portion can employ a Venturi section similar in design to one used for a method of fracturing an openhole wellbore portion. The main difference in context is that the inside diameter of a casing is relatively smooth and highly regular compared to the wall of an openhole wellbore portion. Accordingly, unless otherwise specified, the Venturi section for use in a method of fracturing a cased wellbore portion can use a Venturi section that is similar in design to one used for a method of fracturing an openhole wellbore portion, and the similar description thereof is not repeated.

Preferred Embodiments of a Venturi Section for Use in a Cased Wellbore Portion

Preferably, according to any of the embodiments of the methods of fracturing a cased wellbore portion of a well, the generally tubular wall of the Venturi section extends for a summational axial length that is continuous for at least 2 times the nominal casing inside diameter; and does not have any opening in the tubular wall along the summational axial length thereof that would allow fluid to flow from the passageway to outside the tubular string. This helps prevent the Venturi section from becoming trapped or hung in a casing string at the connection between two tubular members of the casing.

More preferably, according to the method of fracturing a cased wellbore portion, a longer axial length of a constricted cross-sectional area through which fluid can flow provides a back pressure due to fluid flow resistance, which also increases as the viscosity of the fluid increases. For this reason, it is preferable that the length factor for summational length of the Venturi section be at least 10 relative to the nominal inside diameter of the casing.

Figure 13:
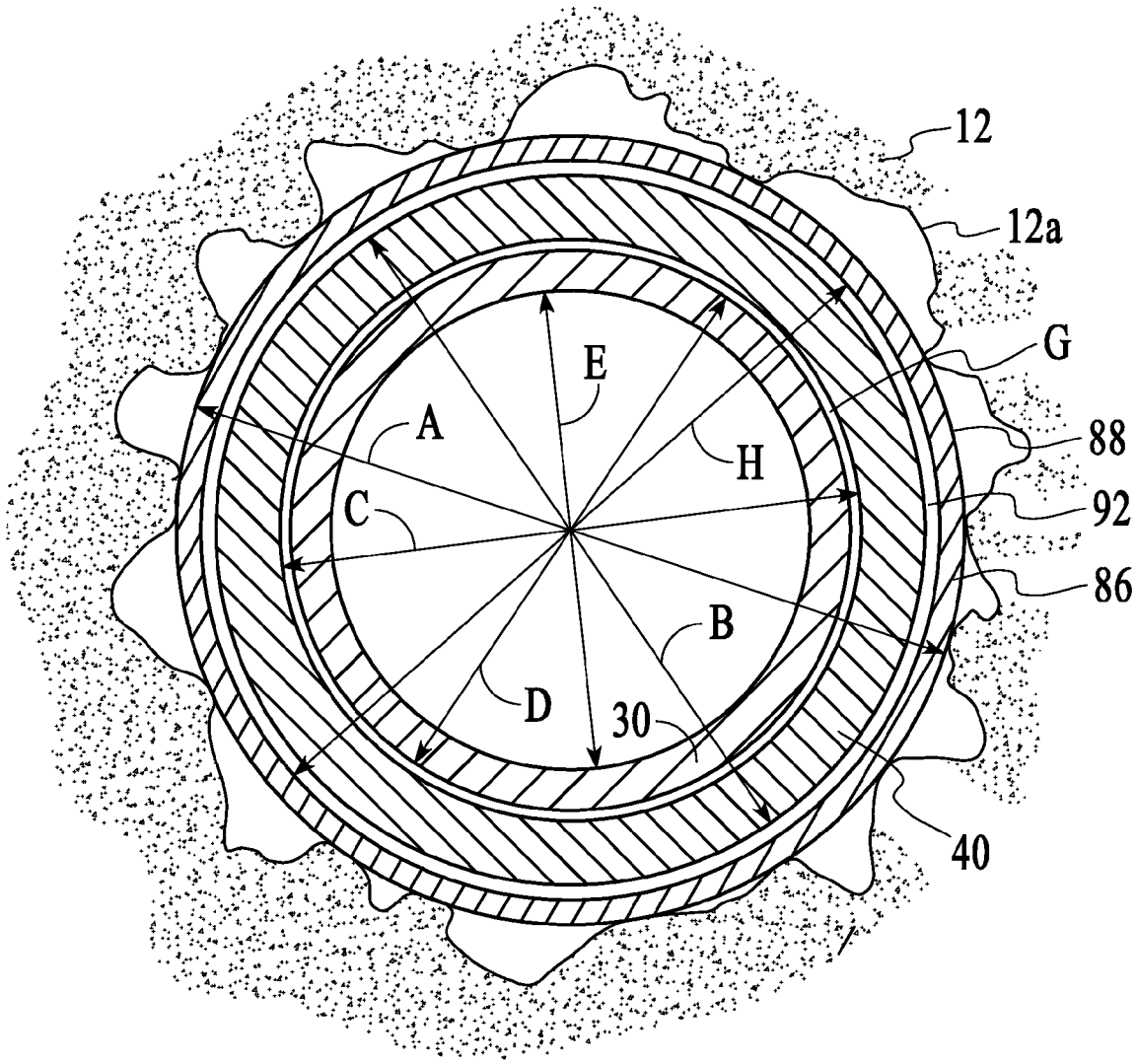
FIG. 13 is a cross-sectional view (in a plane perpendicular to the axis) (approximately to scale) of a profile of the Venturi section 40 of a Venturi member 38 according to the embodiment illustrated in FIGS. 11A-C positioned in a cased wellbore portion 88. The casing may or may not be cemented in position in the cased wellbore portion 88. The casing 86 provides a cased wellbore portion 88. The casing 86 has a nominal casing inside diameter H.

For example, FIG. 13 is a cross-sectional view (in a plane perpendicular to the axis) (approximately to scale) of a profile of the Venturi section 40 of a Venturi member 38 according to the embodiment illustrated in FIGS. 11A-C positioned in a cased wellbore portion 88. The casing 86 may or may not be cemented in position in the cased wellbore portion 88. The casing 86 provides a cased wellbore portion 88. The casing 86 has a nominal casing inside diameter H. In FIG. 13, the Venturi section 40 (as a Venturi member in the form of a sleeve) is illustrated positioned on a tubular string joint 30 in the cased wellbore portion 86. The cased wellbore portion 86 can be a vertical wellbore portion such that the tubular string joint 30 and Venturi section 40 of a Venturi member 38 are illustrated in this FIG. 13 as being in a substantially concentric position in the cased wellbore 86 penetrating a subterranean formation 12. The Venturi section 40 and the tubular joint 30 can be off-center, regardless of whether the cased wellbore portion 88 is vertical or horizontal.

In addition, FIG. 13 illustrates a nominal wellbore diameter A, a nominal casing inside diameter H, a nominal Venturi section outside diameter B, a nominal Venturi section inside diameter C, a nominal joint outside diameter D, and a nominal joint inside diameter E. The cross-sectional area between the nominal casing inside diameter H and the nominal Venturi member outside diameter B defines a constricted flow area 92. The cross-sectional area between the nominal Venturi section inside diameter C and the nominal joint outside diameter D defines a clearance or gap G. It will be appreciated by one of skill in the art that both the constricted flow area 92 between the outer surface of the Venturi section and the gap G between the Venturi section 40 and the joint 30 should be taken into account as the effective cross-sectional area of the potential fluid flow around the Venturi section 40.

As illustrated in FIG. 13, a cased wellbore portion 86 of a particular nominal casing inside diameter 92 should be expected to have a well-defined and circular cross-section. Except at threaded connections, this inside diameter should be relatively constant. As will be hereinafter explained, in the methods for treating a cased wellbore portion, the summational axial length of the Venturi section (not shown in FIG. 13) is less critical than for the methods for treating an openhole wellbore portion.

Figure 14:
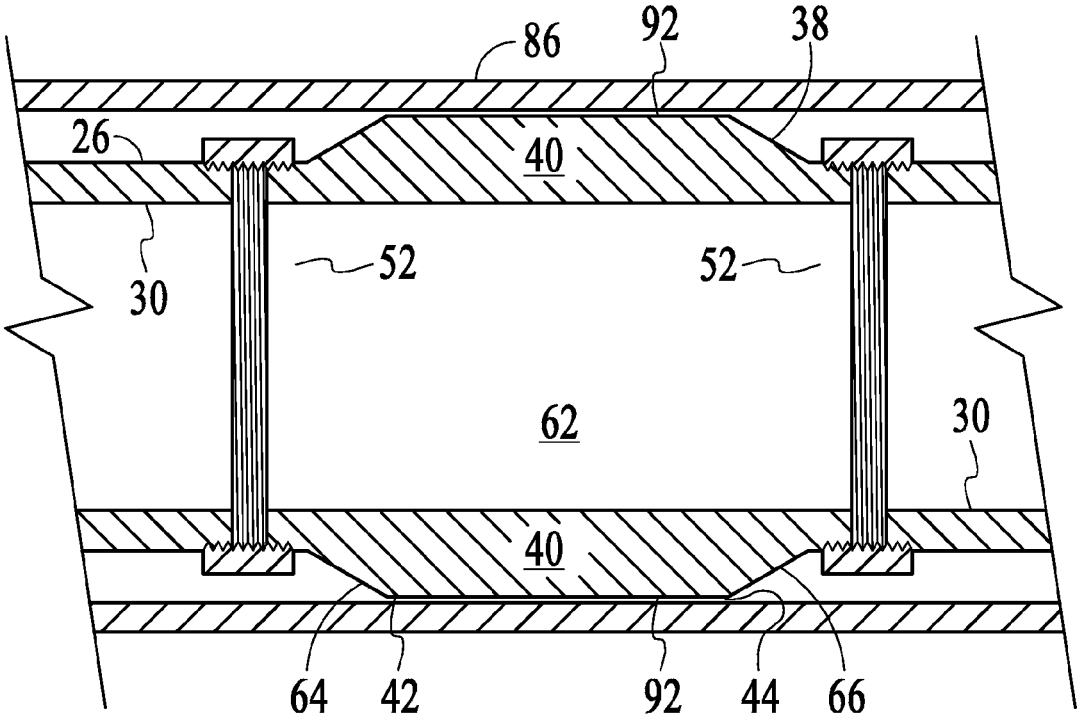
FIG. 14 is a cross-sectional view (in a plane including the axis) (not to scale) illustrating an example of a Venturi section 40 positioned in the casing 86 of a cased wellbore (the wellbore is not shown).

FIG. 14 is a cross-sectional view (in a plane including the axis) (not to scale) illustrating an example of a Venturi section 38 including a Venturi section 40 positioned in the casing 86 of a cased wellbore portion (the wellbore is not shown in FIG. 14). In this embodiment, the Venturi member 38 is generally similar to the embodiment of a Venturi member previously described with reference to FIG. 6C. The Venturi member 38 illustrated in FIG. 14 includes tapered portions 64 and 66 adjacent the downhole and uphole ends 42 and 44, respectively, of the Venturi section 40, as shown. The tapers help the Venturi section be run into a wellbore portion, either openhole or cased as shown in FIG. 14. At either axial end, the Venturi member 38 is connected into and as part of a tubular string 26. The ends of the Venturi member 38 can be connected to tubular joints 30 via threaded connections. For example, an end of the Venturi section can be connected to a tubular joint 30 through a collar 52, as illustrated in FIG. 14; however, any suitable connector can be used at either end of the Venturi section. A restricted annulus or area 92 is created between the interior wall of the casing 86 and the exterior wall of the Venturi section. The restricted annulus or area 92 is adapted to provide a sufficient Venturi effect across the summational axial length of the Venturi section 40 between the Venturi section 40 and the inside wall of the casing 86. Although the Venturi section 40 is illustrated as being concentric to the casing 86, the Venturi section 40 can be off-center and still provide the desired Venturi effect through the restricted area 92.

Preferred Embodiments for Methods of Fracturing a Cased Wellbore Portion

Figure 15A:
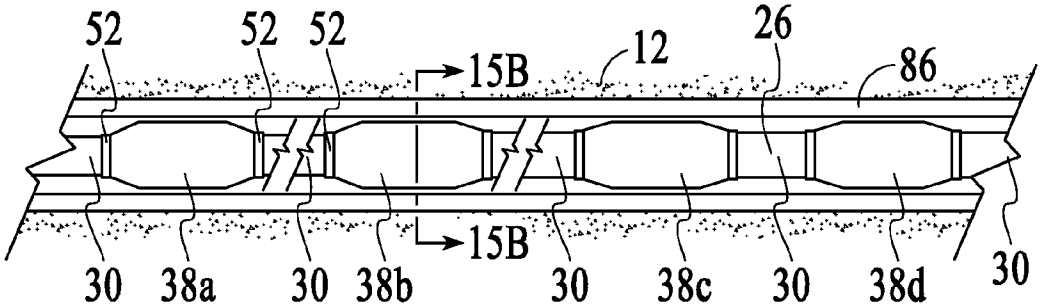
FIG. 15A is a side view (in a plane parallel to the axis) (not to scale) of a tubular string 26 with a plurality of Venturi members shown run in and positioned in a casing 86 of a cased wellbore portion. According to this embodiment, the casing 86 is not pre-perforated before running in the tubular string 26. The Venturi members illustrated in FIG. 15A are similar to the Venturi member 38 illustrated in FIG. 14. The tubular string 26 has an axial passageway (not shown in FIG. 15A).

FIG. 15A is a side view (in a plane parallel to the axis) (not to scale) of a tubular string 26 with a plurality of Venturi members shown run in and positioned in a casing 86 of a cased wellbore portion. According to this embodiment, the casing 86 is not pre-perforated before running in the tubular string 26. More particularly, the tubular string 26 includes a plurality of non-perforated joints 30 and a plurality of Venturi members 38*a*, 38*b*, 38*c*, and 38*d* connected with threaded connections or collars 52. The one or more joints 30 between the Venturi members can provide a treatment section for the tubular string 26. The joints 30 between the Venturi members can be of any suitable axial length, as illustrated by the break-apart lines in FIG. 15A. The Venturi members illustrated in FIG. 15A are similar to the Venturi member 38 illustrated in FIG. 14. The tubular string 26 has an axial passageway (not shown in FIG. 15).

Figure 15B:
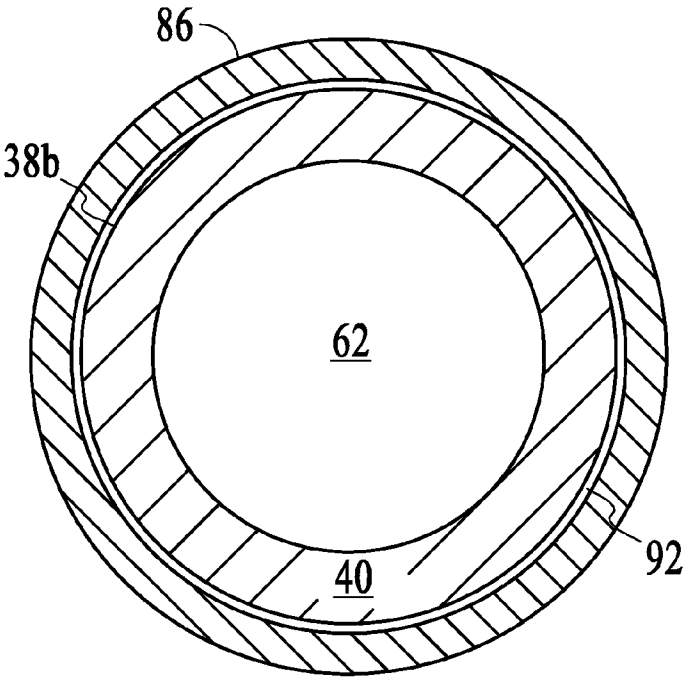
FIG. 15B is a cross-sectional view (in a plane perpendicular to the axis) (not to scale) taken along lines 15B-15B through the Venturi member 38*b* of the tubular string 26 shown in FIG. 15A. The cross-sectional view in FIG. 15B is enlarged relative to the lengthwise view shown in FIG. 15A.

FIG. 15B is a cross-sectional view (in a plane perpendicular to the axis) (not to scale) taken along lines 15B-15B through the Venturi member 38*b* of the tubular string 26 shown in FIG. 15A. The cross-sectional view in FIG. 15B is enlarged relative to the lengthwise view shown in FIG. 15A. FIG. 15B illustrates an axial passageway 62 through a Venturi section 40 of the Venturi member 38*b*, a Venturi annulus or area 92, and the casing 86.

Continuing to refer to FIGS. 15A-B, as will be hereinafter described in detail, after running in the tubular string 26 openings can be created or opened in the tubular string 26 and the casing 86. For example, a perforating gun can be run into the tubular string 26 and used to create perforated openings (not shown in FIGS. 15A-B) through both the tubular wall of the tubular string 26 and the tubular wall of the casing 86. This creates fluid communication between the axial passageway 62 extending through the tubular string 26 and through the casing 86 to the surrounding subterranean formation 12 adjacent to the newly-created perforations.

Figure 16A:
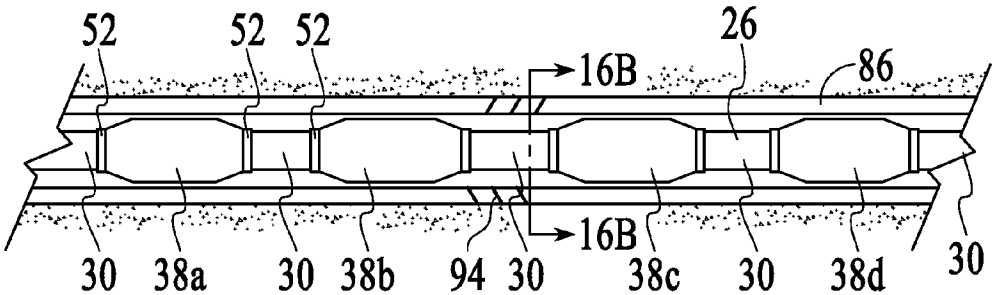
FIG. 16A is a side view (in a plane parallel to the axis) (not to scale) of a tubular string 26 with a plurality of Venturi members shown run in and positioned in a casing 86 of a cased wellbore portion. According to this embodiment, the casing 86 has pre-existing casing perforations 94 before running in the tubular string 26. In this case, the Venturi members 38*b* and 38*c* are illustrated as axially bracketing the pre-existing casing perforations 94. This embodiment is otherwise similar to the embodiment illustrated in FIG. 15A.

FIG. 16A is a side view (in a plane parallel to the axis) (not to scale) of a tubular string 26 with a plurality of Venturi members shown run in and positioned in a casing 86 of a cased wellbore portion. According to this embodiment, the casing 86 has pre-existing casing perforations 94 before running in the tubular string 26. In this case, the Venturi members 38*b* and 38*c* are illustrated as axially bracketing the pre-existing casing perforations 94. This embodiment is otherwise similar to the embodiment illustrated in FIG. 15A.

Figure 16B:
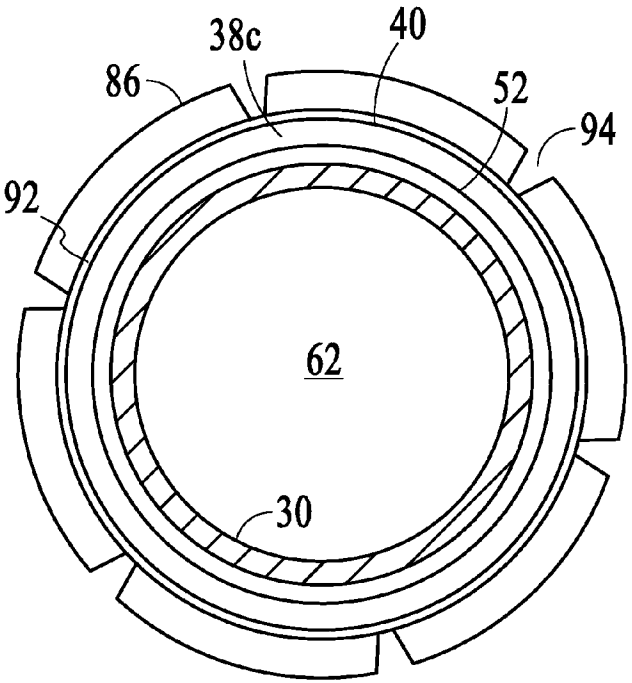
FIG. 16B is a cross-sectional view (in a plane perpendicular to the axis) (not to scale) taken along lines 16B-16B through a joint 30 of the tubular string 26 shown in FIG. 16A. The cross-sectional view in FIG. 16B is enlarged relative to the lengthwise view shown in FIG. 16A.

FIG. 16B is a cross-sectional view (in a plane perpendicular to the axis) (not to scale) taken along lines 16B-16B through a joint 30 of the tubular string 26 shown in FIG. 16A. The cross-sectional view in FIG. 16B is enlarged relative to the lengthwise view shown in FIG. 16A. FIG. 16B illustrates an axial passageway 62 through the joint 30, the end view of a collar 52, an end view a Venturi section 40 of the Venturi member 38*c*, an end view of a Venturi annulus or area 92, and the cross-section of the casing 86 with casing perforations 94.

Continuing to refer to FIGS. 16A-B, as will be hereinafter described in detail, after running in the tubular string 26, openings can be created or opened in the tubular string 26. For example, a sliding sleeve (not shown) can be used to uncover openings in a joint 30 of the tubular string 26. This allows fluid communication between the axial passageway 62 extending through the tubular string 26 and into the casing 86 of the wellbore. The pre-existing casing perforations 94 allow fluid communication from inside the casing 86 to the surrounding subterranean formation 12.

Figure 17A:
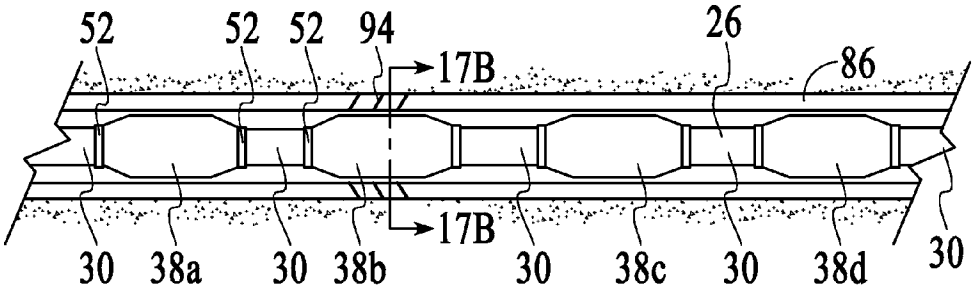
FIG. 17A is a side view (in a plane parallel to the axis) (not to scale) of a tubular string 26 with a plurality of Venturi members shown run in and positioned in a casing 86 of a wellbore. According to this embodiment, the casing 86 has pre-existing casing perforations 94 before running in the tubular string 26. In this case, however, the axial length of a Venturi section, such as the Venturi section of Venturi member 38*b*, may axially overlap with the axial location of a plurality of pre-existing casing perforations 94. This embodiment is otherwise similar to the embodiment illustrated in FIG. 15A.

FIG. 17A is a side view (in a plane parallel to the axis) (not to scale) of a tubular string 26 with a plurality of Venturi members shown run in and positioned in a casing 86 of a wellbore. According to this embodiment, the casing 86 has pre-existing casing perforations 94 before running in the tubular string 26. In this case, however, the axial length of a Venturi section, such as the Venturi section of Venturi member 38*b*, may axially overlap with the axial location of a plurality of pre-existing casing perforations 94. Depending on exactly where the Venturi effect is maximized along the summational axial length of the Venturi section of the Venturi member 38*b*, the Venturi effect will restrict fluid flow to some of the pre-existing casing perforations or openings 94. This will restrict fluid flow either uphole or downhole, as the case may be, of the maximum Venturi effect of the Venturi section provided by the area 92. This embodiment is otherwise similar to the embodiment illustrated in FIG. 15A.

Figure 17B:
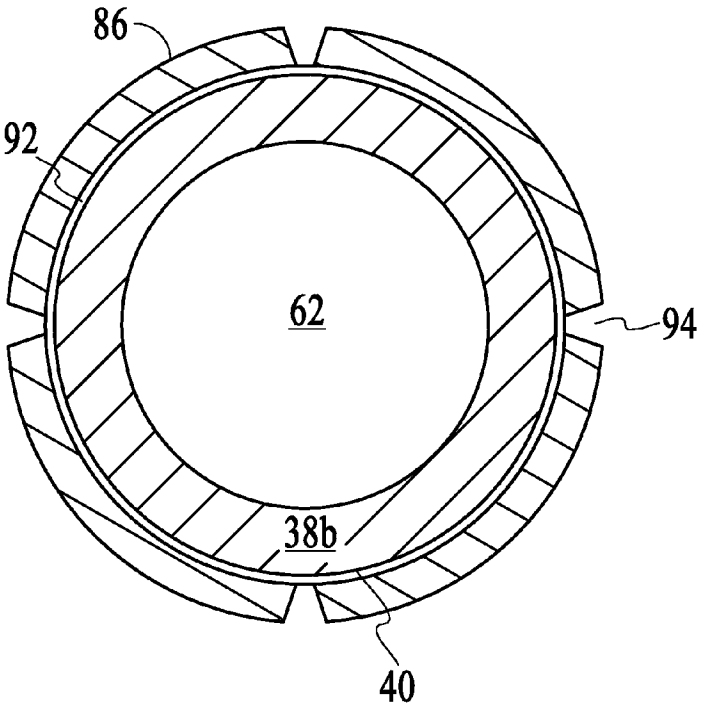
FIG. 17B is a cross-sectional view (in a plane perpendicular to the axis) (not to scale) taken along lines 17B-17B through the Venturi member 38*b* of the tubular string 26 shown in FIG. 17A. The cross-sectional view in FIG. 17B is enlarged relative to the lengthwise view shown in FIG. 17A.

FIG. 17B is a cross-sectional view (in a plane perpendicular to the axis) (not to scale) taken along lines 17B-17B through the Venturi member 38*b* of the tubular string 26 shown in FIG. 17A. The cross-sectional view in FIG. 17B is enlarged relative to the lengthwise view shown in FIG. 17A. FIG. 17B illustrates an axial passageway 62 through a Venturi section 40 of the Venturi member 38*b*, a Venturi annulus or area 92, and the casing 86 with casing perforations 94.

Continuing to refer to FIGS. 17A-B, as will be hereinafter described in detail, after running in the tubular string 26 openings can be created or opened in the tubular string 26. For example, a sliding sleeve (not shown) can be used to uncover openings in a joint 30 of the tubular string 26. This allows fluid communication between the axial passageway 62 extending through the tubular string 26 and into the casing 86 of the wellbore. The pre-existing casing perforations 94 allow fluid communication from inside the casing 86 to the surrounding subterranean formation 12.

Figure 18A:
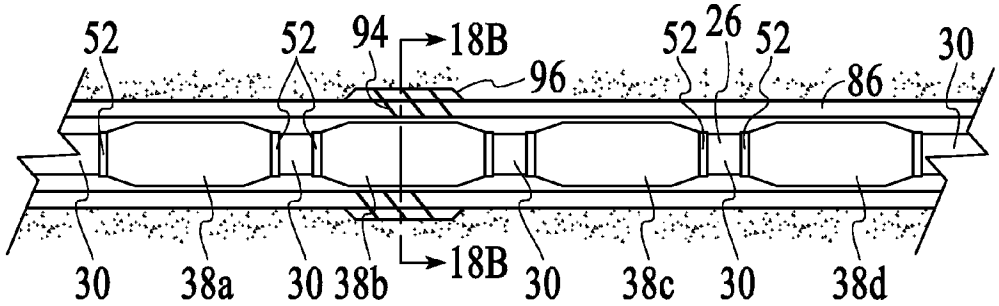
FIG. 18A is a side view (in a plane parallel to the axis) (not to scale) of a tubular string 26 with a plurality of Venturi members shown run in and positioned in a casing 86 of a cased wellbore portion. According to this embodiment, the casing 86 has pre-existing casing perforations 94, similar to the embodiment illustrated in FIGS. 17A-B. In this embodiment of FIG. 18A, however, the pre-existing casing perforations 94 are closed with an external sliding sleeve 96.

FIG. 18A is a side view (in a plane parallel to the axis) (not to scale) of a tubular string 26 with a plurality of Venturi members shown run in and positioned in a casing 86 of a cased wellbore portion. According to this embodiment, the casing 86 has pre-existing casing perforations 94, similar to the embodiment illustrated in FIGS. 17A-B. In this embodiment of FIG. 18A, however, the pre-existing casing perforations 94 are closed with an external sliding sleeve 96.

Figure 18B:
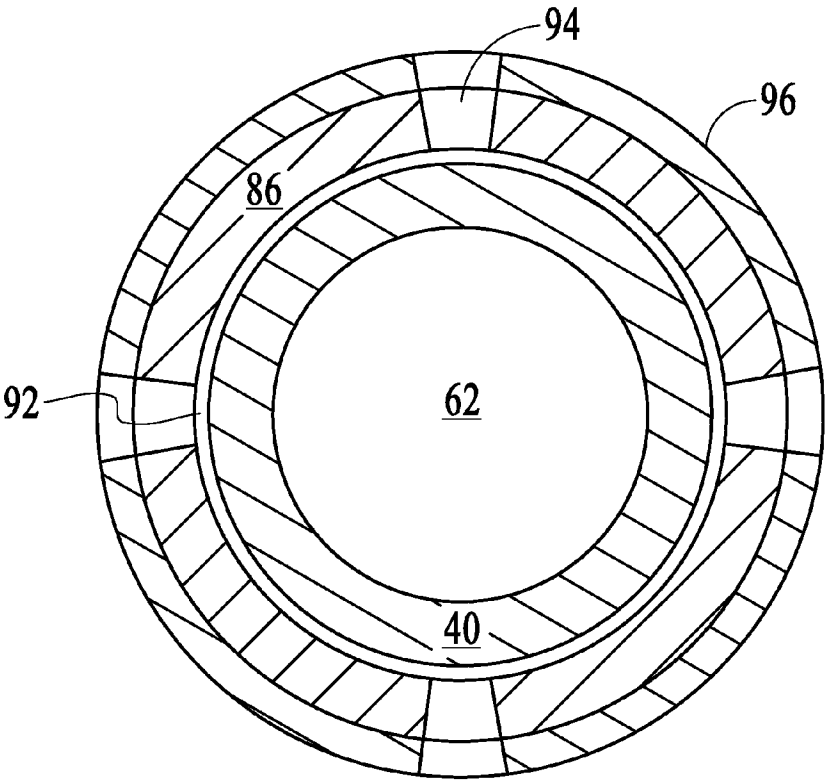
FIG. 18B is a cross-sectional view (in a plane perpendicular to the axis) (not to scale) taken along lines 18B-18B through the Venturi member 38*a* of the tubular string 26 shown in FIG. 18A. The cross-sectional view in FIG. 18B is enlarged relative to the lengthwise view shown in FIG. 18A.

FIG. 18B is a cross-sectional view (in a plane perpendicular to the axis) (not to scale) taken along lines 18B-18B through the Venturi member 38*a* of the tubular string 26 shown in FIG. 18A. The cross-sectional view in FIG. 18B is enlarged relative to the lengthwise view shown in FIG. 18A. FIG. 18B is similar to FIG. 17B, except additionally illustrating an external sliding sleeve 96 over the casing perforations 94. As illustrated in FIG. 18B and will be appreciated by a person of skill in the art, the sliding sleeve has previously been moved to uncover and open the casing perforations 94 so that fluid can flow from inside the casing 86 through the casing perforations 94 to outside the casing.

Continuing to refer to FIGS. 18A-B, as will be hereinafter described in detail, after running in the tubular string 26 openings can be created or opened in the tubular string 26. For example, a sliding sleeve (not shown) can be used to uncover pre-formed openings (not shown) in a joint 30 of the tubular string 26. This allows fluid communication between the axial passageway 62 extending through the tubular string 26 and into the casing 86 of the wellbore. As will be appreciated by a person of skill in the art, the sliding sleeve 96 has been previously operated to open pre-existing casing perforations 94. This allows fluid communication from inside the casing 86 to the surrounding subterranean formation 12.

Figure 19A:
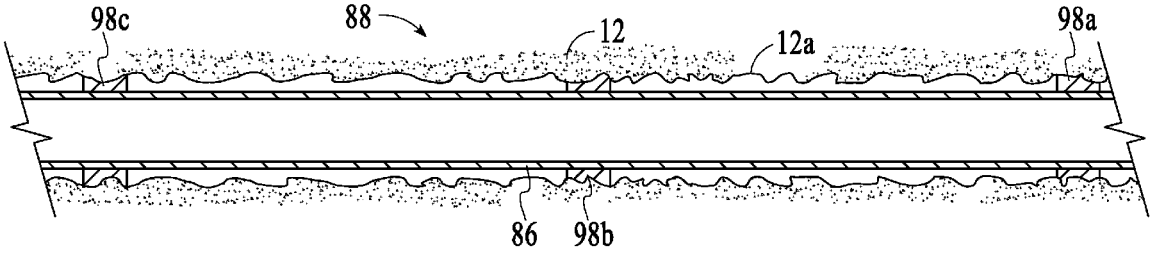
FIGS. 19A-19G are cross-sectional views (in a plane including the axis) (not to scale) illustrating steps according to an embodiment of the method of fracturing a cased wellbore portion 88.

FIGS. 19A-18G are cross-sectional views (in a plane including the axis) (not to scale) illustrating a sequence of steps according to an embodiment of the method for fracturing a cased wellbore portion 88.

More particularly, FIG. 19A illustrates a cased wellbore portion 88, which is a cased wellbore portion 88. Preferably, at least one packer, such as packers 98*a*, 98*b*, and 98*c*, are positioned and set in the annulus between the outside of the casing 86 and the wall 12*a* of the wellbore. If present, these set packers help prevent axial fluid flow along the annulus between outside the casing 86 and the wall of the wellbore 10. If present, the set packers 98*a* and 98*b* define a first treatment interval F1 outside the casing 86. Similarly, the set packers 98*b* and 98*c* define a second treatment interval F2 outside the casing 86.

The packers 98*a*, 98*b*, and 98*c* can be of any conventional design. As will be appreciated by a person of skill in the art, the casing 86 can optionally have been previously perforated (not shown). The casing 86 can have pre-formed openings, such as slots (not shown), with a sliding sleeve (not shown in FIG. 19A) for closing and then opening the pre-formed openings.

According to an embodiment, it is contemplated that the casing 86 and the packers 98*a*, 98*b*, and 98*c* can be of a previously used tubular string including Venturi sections that were used in a previous treatment of the openhole wellbore 10. The previously used tubular string remains in the wellbore to act as the casing 86. See FIG. 1.

It is also contemplated that the casing 86 can be cemented in the wellbore 10, which may be with or without packers. If cemented, the cement in the annulus between the outside of the casing 86 and the wall of the wellbore 10 would help prevent axial fluid flow along the annulus between outside the casing 86 and the wall of the wellbore 10.

Figure 19B:
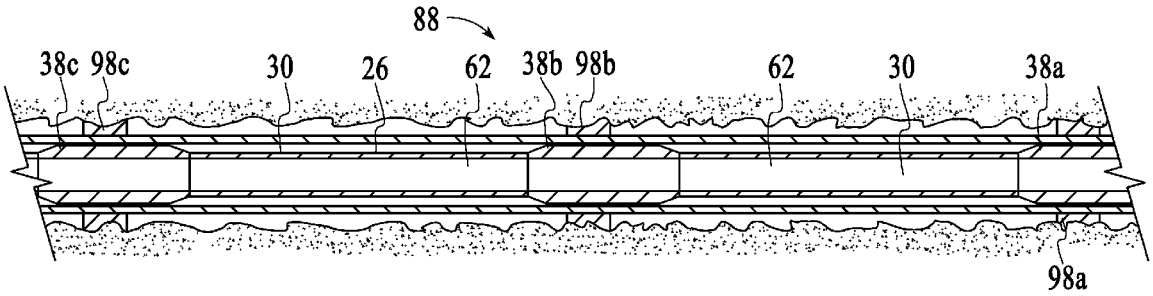

FIG. 19B illustrates a step of running in and positioning a tubular string 26 into the cased wellbore portion 88. The tubular string 26 can include, for example, a plurality of non-perforated joints 30. The tubular string 26 includes at least one Venturi member, such as Venturi members 38*a*, 38*b*, and 38*c*. As will be appreciated by a person of skill in the art, if the uphole Venturi member 38*b* is positioned near the end of a wellbore 10, the downhole Venturi member 38*a* may not be necessary. (See the previous description herein with reference to FIG. 2.) The tubular string 26 has an axial passageway 62.

Figure 19C:
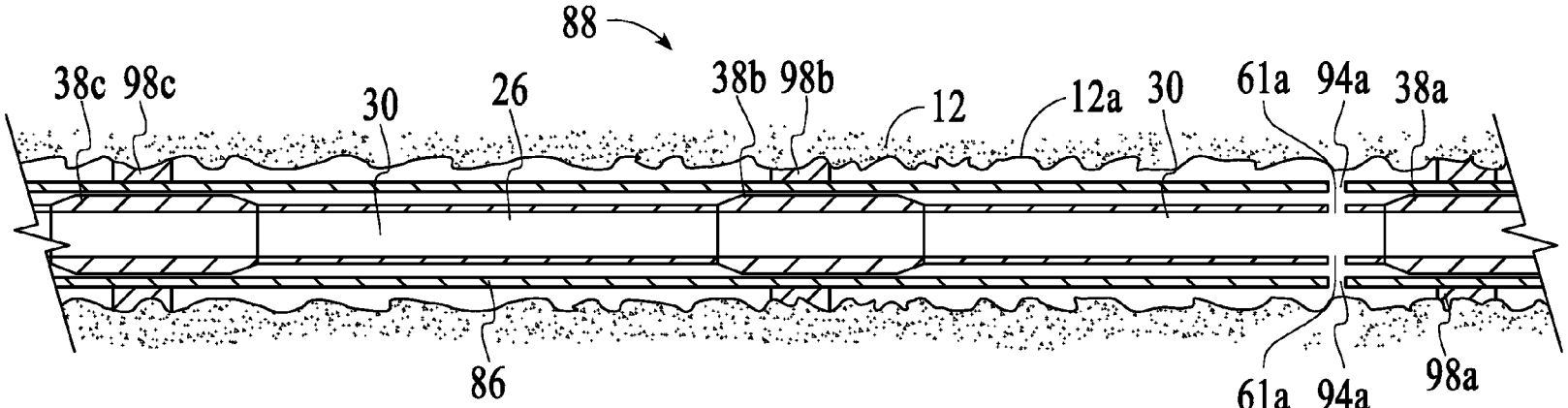

FIG. 19C illustrates a step of perforating or otherwise creating first openings 61*a* through the tubular wall of the tubular string 26. In the illustrated embodiment, the openings 61*a* are perforated or created at a location uphole relative to the Venturi section of Venturi member 38*a* (if present) and downhole of the Venturi section of Venturi member 38*b*. As will be appreciated by a person of skill in the art, although only one axial location of perforations 61*a* are created or opened, a plurality of perforations can be created or opened anywhere between the Venturi sections of Venturi members 38*a* and 38*b*.

As will be appreciated by a person of skill in the art, the step of perforating to create the openings 61*a* can be accomplished, for example, with a perforating charge mounted on a perforating gun (not shown) run into or positioned in the tubular string 26. It is contemplated that the openings 61*a* can be pre-formed before running in the tubular string 26 into the cased wellbore 88. (See the previous description herein with reference to FIG. 1.) Moreover, it is contemplated that the step of opening pre-formed openings 61*a* could be accomplished, for example, by moving a sliding sleeve or bursting a rupture disk to uncover or unblock the pre-formed openings 61*a* in the tubular string 26.

In addition, FIG. 19C illustrates the step of perforating or otherwise creating first casing openings 94*a* through the tubular wall of the casing 88. In the illustrated embodiment, the casing openings 94*a* are perforated or created uphole relative to the packer 98*a* (if present) and downhole of the packer 98*b* (if present).

It is contemplated that the step of perforating or forming the tubular member openings 61*a* and perforating or forming the casing openings 94*a* can be performed simultaneously. For example, as will be appreciated by a person of skill in the art, a perforating charge can create an opening 61*a* through the tubular wall of the tubular string 26 and through the tubular wall of the casing 86, to create substantially aligned openings 61*a* and 94*a* as illustrated in FIG. 19C.

As will be appreciated by a person of skill in the art, the step of perforating to create the openings 94*a* can be accomplished, for example, with a perforating charge mounted on a perforating gun (not shown) run into or positioned in the tubular string 26. It is contemplated that the openings 94*a* can be pre-formed before running in the casing 86 into the wellbore 10. (See FIG. 1.) Moreover, it is contemplated that the step of opening pre-formed openings 94*a* could be accomplished, for example, by moving a sliding sleeve or bursting a rupture disk to uncover or unblock the pre-formed openings 94*a* in the casing 86.

Although illustrated as being aligned in FIG. 19C, it is not necessary that the first casing openings 94*a* be axially or radially aligned with the first openings 61*a* in the tubular string 26. For example, if the casing openings 94*a* are pre-existing in the casing, then the first openings 61*a* may not be aligned with the casing openings 94*a*. Regardless of any alignment, the first casing openings 94*a* and the first tubular string openings 61*a* between Venturi sections of the Venturi members 38*a* and 38*b* will be in fluid communication through the annulus between the outside of the tubular string 26 and the inside of the casing 88.

Figure 19D:
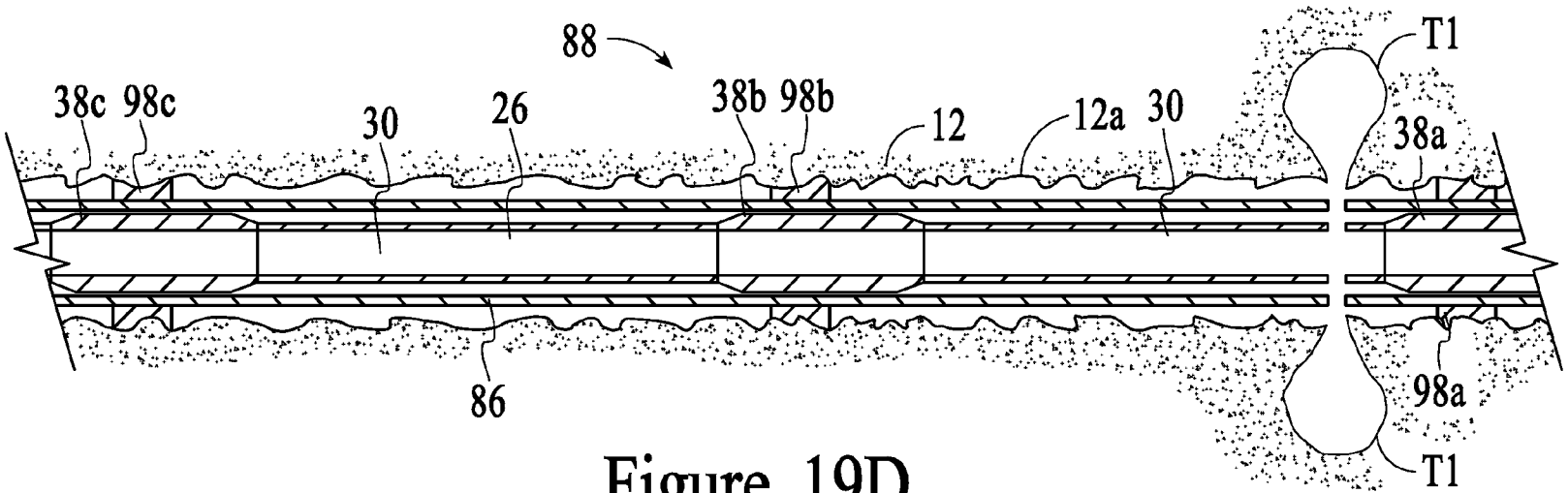

FIG. 19D illustrates a step of pumping a fracturing fluid T1 through the tubular string 26, through the openings 61*a*, through the annulus between the tubular string 26 and the casing 86, through the casing openings 94*a*, and into the surrounding subterranean formation 12. As will be appreciated by a person of skill in the art, the Venturi section of the downhole Venturi member 38*a* (if present) and the Venturi section of the uphole Venturi member 38*b* axially contain the fracturing fluid T1 in the annular space between the tubular string 26 and the casing 86. Preferably, the Venturi section provides a sufficient Venturi effect that helps contain a rate and pressure of pumped fracturing fluid axially in a section of the casing 86. Similarly, the packers 98*a* and 98*b*, if present and set, help axially contain the fracturing fluid T1 in the annular space, if any, between the casing 86 and the wall of the wellbore 10. The rate and pressure of pumping the fracturing fluid and the Venturi effect forces the fracturing fluid T1 into the subterranean formation 12. The rate and pressure of pumping the fracturing fluid T1 is adapted to be sufficiently high such that when axially contained by the Venturi effect, the fracturing fluid is directed outward through casing perforations 94*a* to the subterranean formation 12 at a rate and pressure adapted to be at least sufficient to create at least one fracture in the formation.

Figure 19E:
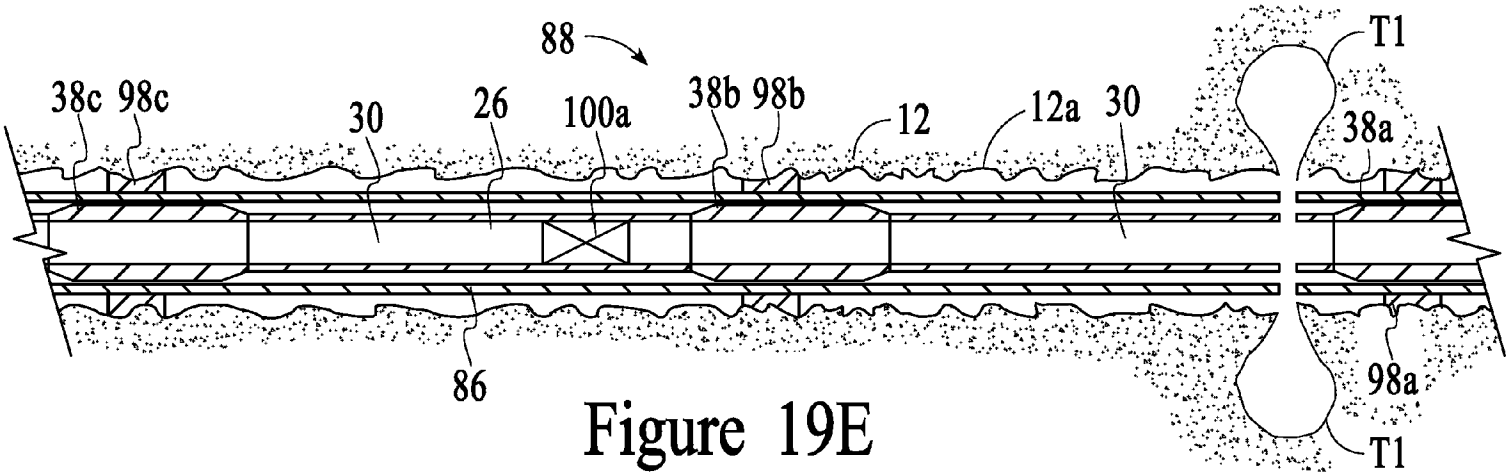

FIG. 19E illustrates a step of positioning a first bridge plug 100*a* in the axial passageway 62 of the tubular string 26. Preferably, the bridge plug 100*a* is temporary or removable. The bridge plug 100*a* prevents fluid from flowing downhole through the passageway 62 past the bridge plug.

Figure 19F:
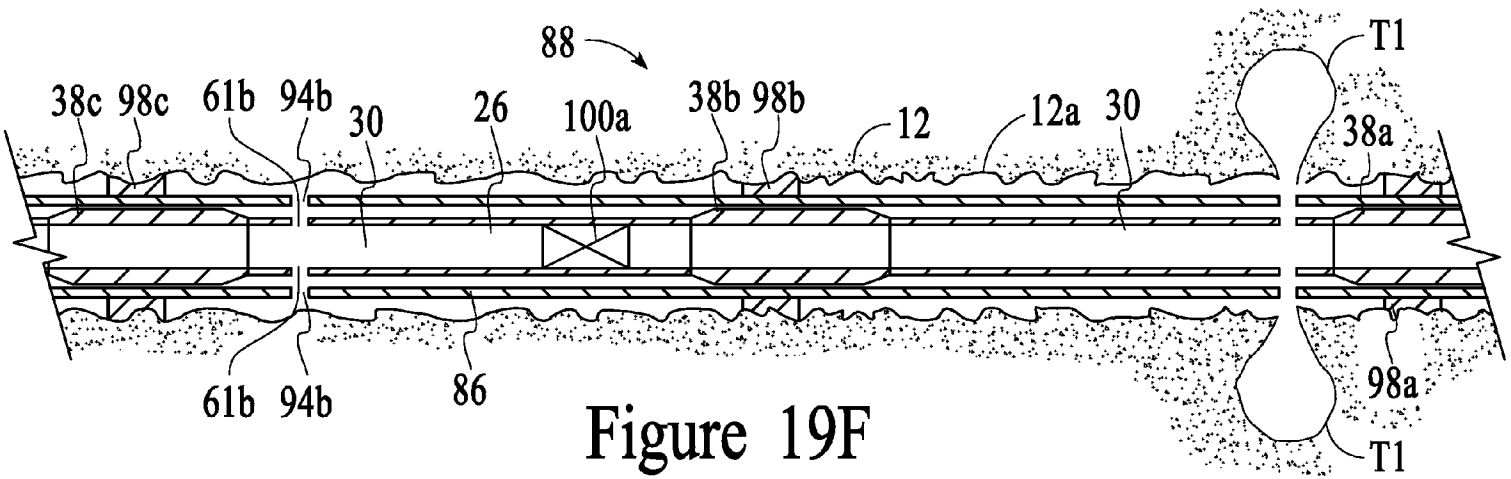

FIG. 19F illustrates a step of perforating or otherwise creating second openings 61*b* through the tubular wall of the tubular string 26. In the illustrated embodiment, the openings 61*b* are perforated or created uphole relative to the Venturi section of Venturi member 38*b* and downhole of the Venturi section of Venturi member 38*c*. As will be appreciated by a person of skill in the art, the step of perforating to create the openings 61*a* can be accomplished, for example, with a perforating charge mounted on a perforating gun (not shown) run into or positioned in the tubular string 26. Moreover, it is contemplated that the step of opening pre-formed openings 61*b* could be accomplished, for example, by moving a sliding sleeve or bursting a rupture disk to uncover or unblock the pre-formed openings 61*b* in the tubular string 26.

In addition, FIG. 19F illustrates the step of perforating or otherwise creating second casing openings 94*b* through the tubular wall of the casing 88. In the illustrated embodiment, the casing openings 94*b* are perforated or created uphole relative to the packer 98*b* (if present) and downhole of the packer 98*c* (if present and set). Although illustrated as being aligned in FIG. 19F, it is not necessary that the first casing openings 94*b* be axially or radially aligned with the first openings 61*b* in the tubular string 26. Regardless of alignment, the first casing openings 94*b* and the first tubular string openings 61*b* will be in fluid communication through the annulus between the tubular string 26 and the casing 88. As will be appreciated by a person of skill in the art, the step of perforating to create the openings 94*b* can be accomplished, for example, with a perforating charge mounted on a perforating gun (not shown) run into or positioned in the tubular string 26. It is contemplated that the openings 94*b* can be pre-formed before running in the casing 86 into the wellbore 10. Moreover, it is contemplated that the step of opening pre-formed openings 94*b* could be accomplished, for example, by moving a sliding sleeve (not shown) or bursting a rupture disk (not shown) to uncover or unblock the pre-formed openings 94*b* in the casing 86.

Further, it is contemplated that the step of perforating or forming the tubular member openings Mb and perforating or forming the casing openings 94*b* can be performed simultaneously. For example, as will be appreciated by a person of skill in the art, a perforating charge can create an opening 61*b* through the tubular wall of the tubular string 26 and through the tubular wall of the casing 86, substantially as illustrated in FIG. 19F.

Figure 19G:
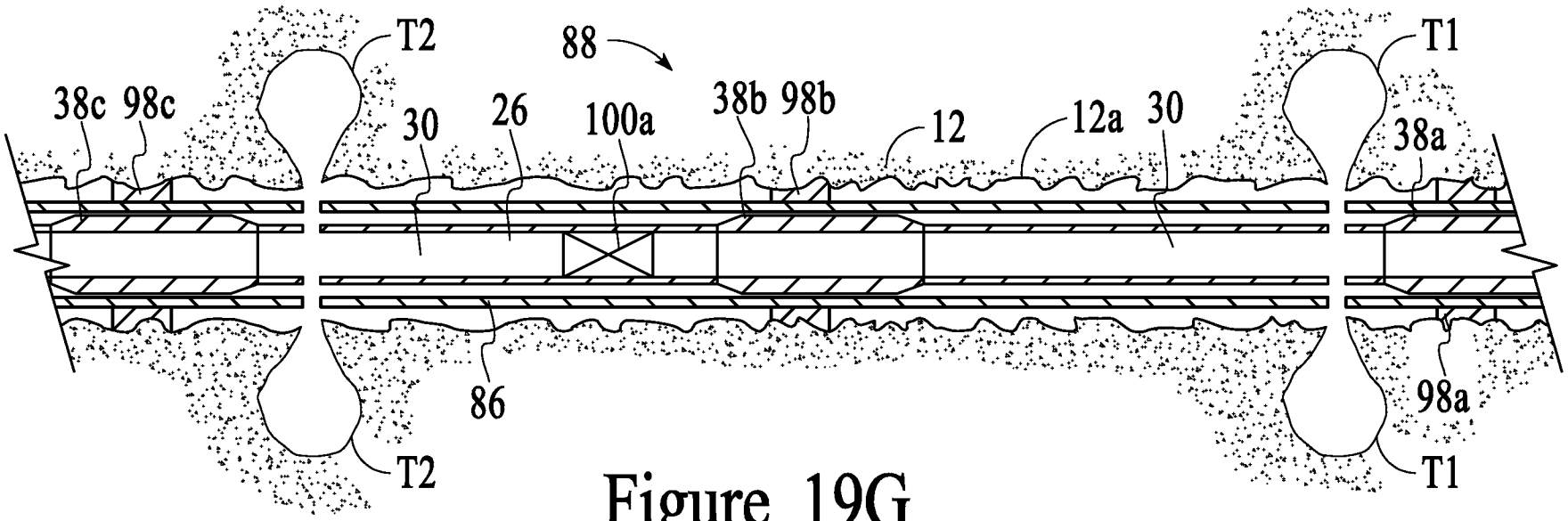

FIG. 19G illustrates a step of pumping a fracturing fluid T2 through the tubular string 26, through the openings 61*b*, through the annulus between the tubular string 26 and the casing 86, through the casing openings 94*b*, and into the surrounding subterranean formation 12. As will be appreciated by a person of skill in the art, the Venturi section of the downhole Venturi member 38*b* and the Venturi section of the uphole Venturi member 38*c* axially contain the fracturing fluid T2 in the annular space between the tubular string 26 and the casing 86. As will be appreciated by a person of skill in the art, no packing in the annular space between the tubular string and the casing of the cased wellbore portion is set downhole relative to the first Venturi section to effect hydraulic isolation of the step of pumping a fracturing fluid T2.

Similarly, the packers 98*b* and 98*c*, if present and previously set, help axially contain the fracturing fluid T2 in the annular space between the casing 86 and the wellbore wall 12*a* of the wellbore 10. The rate and pressure of pumping the fracturing fluid into the annular space forces the fracturing fluid T2 into the subterranean formation 12. Preferably, the rate and pressure of pumping the fracturing fluid T2 is sufficiently high such that combined with at least a sufficient containment of the flow of the fracturing fluid, it is directed into the subterranean formation 12 at a rate and pressure adapted to be at least sufficient to fracture the formation.

As will be appreciated by a person of skill in the art, the various steps according to the method can be repeated in any practical sequence to fracture additional uphole treatment intervals.

General Steps for the Methods

Determining a Treatment Interval

As used herein, a "treatment interval" is an interval (an axial length) of a wellbore portion that is designed to be subjected to a fracturing fluid at or above a fluid pumping rate and pressure sufficient to initiate or extend at least one fracture in the subterranean formation surrounding the wellbore.

Designing a treatment interval is according to currently known and evolving understandings in the art for the engineering of fracturing of various types of subterranean formations. As will be understood by a person of skill in the art, several factors are used according to the invention to design a treatment interval in a wellbore portion. The factors include, without limitation: identification of a producing zone, the formation fracture pressure (the pressure above which injection of fluids will cause the subterranean formation to fracture hydraulically), available pumping capability from the wellhead (maximum available pumping rate and pressure), maximum rate and pressure of pumping the fracturing fluid from the wellhead down through a tubular string to the treatment interval, the leak off rate of the fracturing fluid into the surrounding subterranean formation, and the rate of any axial escape of fracturing fluid from the treatment interval.

As used herein, an uphole or a downhole "end" of a treatment interval is defined as follows.

For an uphole end or a downhole end defined by a set packing of a tubular string run into a wellbore portion, the "end" is the axial middle of the one or more expandable packing elements of the packer, measured uphole or downhole, respectively, from the axially closest of the one or more tubular string openings.

For an uphole end or a downhole end defined by a set cement or other set sealing compound in an annular space for sealing a tubular string run into a wellbore portion, the "end" is axially 12 inches (12") into the set cement or set sealing compound measured uphole or downhole, respectively, from the axially closest of the one or more tubular string openings.

For an uphole end or a downhole end defined by a Venturi section of a tubular string run into an openhole wellbore portion, the "end" is the axial end of a summational axial length of the blocking that extends for at least 7 (seven) times the nominal wellbore diameter of an openhole wellbore portion, measured uphole or downhole, respectively, from the axially closest of the one or more tubular string openings.

For an uphole end or a downhole end defined by a Venturi section of a tubular string run into a cased wellbore portion, the "end" is the axial end of a summational axial length of the blocking that extends for at least one inch (1"), measured uphole or downhole, respectively, from the axially closest of the one or more tubular string openings.

In case an uphole end or a downhole end could possibly be defined by more two or more of a packer, a set cement or other set sealing compound, or a Venturi section, or two or more of any combination of these, the "end" is the axially closest of the possible ends, measured uphole or downhole, respectively, from the axially closest of the one or more tubular string openings. In a special case, a downhole end can be defined by a terminal end of a wellbore, such as the toe end of a horizontal wellbore portion, or plugging of the downhole end of the wellbore portion. In case a downhole end could possibly be defined by a terminal end or plugging, a packer, a set cement or other set sealing compound, or a Venturi section, or any combination of these, the "end" is the axially closest of the possible ends, measured downhole from the axially closest of the one or more tubular string openings.

As explained in detail and as will be understood by a person of skill in the art, according to the inventions a Venturi section is used to partially contain the pumped fracturing fluid in a treatment interval. This helps direct at least a sufficient rate and pressure of the pumped fracturing fluid into the surrounding subterranean formation to initiate or extend at least one fracture in the subterranean formation surrounding the wellbore. According to the inventions and as will hereinafter be explained in detail, it has been recognized that packing of the tubular string is not required to achieve a treatment interval.

Tubular String Openings

As used herein, a "tubular string opening" is for allowing a treatment fluid, such as a fracturing fluid, that is pumped downhole through a tubular string to a treatment section of the tubular string to be released outside the tubular string. One or more tubular string openings can be formed. As will be appreciated by a person of skill in the art, a tubular string opening must be sufficiently large, that is, have a sufficient opening size and shape, to allow the fracturing fluid that is used to be pumped through the opening without becoming blocked or plugged by any material in the fracturing fluid. In addition, the one or more tubular string openings must have at least a sufficient summational size so that the fracturing fluid can be pumped through the one or more openings at a rate and pressure that is at least sufficient to fracture the subterranean formation of the treatment interval. The "summational size" of the one or more tubular string openings is the summed size or sizes of the one or more tubular string openings.

The tubular string opening can be formed in a treatment section of the tubular string or the tubular string opening can be at the end of a Venturi section. For example, referring to FIG. 1A tubular string openings 61*a* can be formed in a treatment section 26*a*, or referring to FIG. 2 a tubular string end opening 63 at the end of the passageway of a tubular Venturi section 40*a*. More than one tubular string opening can be formed in a treatment section of the tubular string. The treatment section is an axial portion of one or more tubular members. According to the invention, a treatment section of a tubular string is axially bounded at least one end thereof by the body of a Venturi section.

If there is a treatment section employed in a method according to the invention, the treatment section has a treatment length defined by the axial span of the one or more tubular string openings through which the fracturing fluid is to be pumped during the step of pumping. The treatment section has a nominal length-weighted outside diameter that is equal to or less than 98% of the nominal wellbore diameter for fracturing of an openhole wellbore portion or the nominal casing inside diameter of the casing for fracturing of a cased wellbore portion. More preferably, the treatment section has a nominal length-weighted outside diameter that is equal to or less than 96% of the nominal wellbore diameter or the nominal inside diameter of the casing, depending on the application to an openhole wellbore portion or to a cased wellbore portion. More preferably still, the treatment section has a nominal length-weighted outside diameter that is equal to or less than 93% of the nominal wellbore diameter or the nominal casing inside diameter, depending on the application. Most preferably, the treatment section has a nominal length-weighted outside diameter that is equal to or less than 80% of the nominal wellbore diameter or the nominal inside diameter, depending on the application.

It is to be understood that a tubular string opening can be formed at the downhole end of a Venturi section without a treatment section of a tubular string.

Step of Forming One or More Tubular String Openings

In general, the step of forming one or more tubular string openings can be accomplished in various ways. For example, referring back to FIG. 2, a tubular string opening can be a pre-formed end opening 63 at the end of the passageway of a tubular Venturi section 40. Referring to FIG. 1A, for example, a tubular string opening can be a pre-formed tubular string opening 61*a* in the tubular wall of a treatment section 26*a*. A pre-formed tubular string opening in the tubular wall of the treatment section can be temporarily covered with a rupture disk or a sleeve (not shown).

The step of forming one or more tubular string openings can include: before the step of running in a tubular string, forming tubular string opening in a treatment section of the tubular string. The step of forming one or more tubular string openings can include: after the step of running in the tubular string, perforating a treatment section of the tubular string to form one or more tubular string openings. As will be appreciated by a person of skill in the all, the step of forming one or more tubular string openings can include: after the step of running in the tubular string, pumping a fluid into the tubular string at a pressure sufficient to rupture a rupture disk covering a pre-formed tubular string opening in the tubular string. In addition, it is to be understood that the step of forming one or more tubular string openings can include: after the step of running in the tubular string, moving a sleeve to open a closed tubular string opening in the tubular string.

Casing Openings

As used herein, a "casing opening" is for allowing a treatment fluid, such as a fracturing fluid, that is pumped downhole through a tubular string and through one or more tubular string openings to be released outside a surrounding casing. One or more casing openings can be formed. As will be appreciated by a person of skill in the art, a casing opening must be sufficiently large, that is, have a sufficient opening size and shape, to allow the fracturing fluid that is used to be pumped through the opening without becoming blocked or plugged by any material in the fracturing fluid. In addition, the one or more casing openings must have at least a sufficient summational size so that the fracturing fluid can be pumped through the one or more casing openings at a rate and pressure that is at least sufficient to fracture the subterranean formation of the treatment interval. The "summational size" of the one or more casing openings is the summed size or sizes of the one or more casing openings.

Step of Forming One or More Casing Openings

As will be appreciated by a person of skill in the art, the step of forming one or more casing openings can be similar to the step of forming one or more tubular string openings. An example is illustrated in the embodiment shown in FIGS. 18A-B for opening pre-formed perforations 94 in a casing 86 with a sliding sleeve 96. Another example is illustrated in FIGS. 19A-G, where the tubular string and the casing are perforated simultaneously with a perforating gun, as described herein.

Downhole Venturi Section and Internal Plug

In general, according to the methods of the invention, a second Venturi section can be positioned downhole relative to the tubular string opening, wherein the tubular string opening and the second Venturi section are not axially separated by a set packing between the tubular string and the openhole wellbore portion to be treated or between the tubular string and the casing of the cased wellbore portion to be treated, as the case may be. In addition, there should be no open passageway to another tubular string opening below the second Venturi section. Preferably, the passageway of the tubular string is internally plugged at a location downhole relative to the second Venturi section. For example, the passageway of the tubular string can be internally plugged with a bridge plug. The bridge plug can be a removable or drillable bridge plug. When a second Venturi section is positioned downhole to a first Venturi section, the treatment interval has a downhole end established by the downhole end of an axial span of a summational axial length of the second Venturi section. It is to be understood that there may be more than two Venturi sections employed in a method according to the inventions.

Step of Pumping

The step of pumping a fracturing fluid is at a rate and pressure that is greater than can be dissipated by the permeability of the subterranean formation surrounding the wellbore portion along the treatment interval and through nominally constricted cross-sectional areas provided by the uphole and downhole Venturi sections.

In the embodiment for fracturing an openhole wellbore portion including the use of the uphole and downhole Venturi sections (also referred to as first and second Venturi sections), the treatment interval need not be, and preferably is not, bounded by a set packing of the tubular string between the tubular string and the openhole wellbore portion.

In the embodiment for fracturing a cased wellbore portion including the use of the uphole and downhole Venturi sections, preferably the treatment interval is additionally bounded by uphole and downhole packers external of the casing. It is also contemplated that the cased wellbore portion can be cemented in addition to or instead of employing packers external of the casing. This helps axially contain the fracturing fluid and the pressure of pumping in the desired interval of the wellbore portion.

As will be appreciated by a person of skill in the art, the fracturing fluid can include: water, water mixtures, hydrocarbon, inert gases, inert gas-water mixtures, polymer, a cross-linked polymer, an acid, a proppant, and any combination thereof in any proportion.

Optional Additional Steps and Combinations

Any of the embodiments according to the inventions can optionally further include, after the step of pumping a fracturing fluid, the steps of: (a) plugging the tubular string at a location uphole of the one or more tubular string openings or uphole of the treatment section; and (b) repeating the steps of forming one or more tubular string openings and pumping a fracturing fluid in a second wellbore portion of the well at an uphole location relative to plugged location. The second wellbore portion can be the same or different as the first wellbore portion.

In the embodiments for fracturing more than one openhole wellbore portions, the second openhole wellbore portion of the well can have a nominal wellbore diameter that is the same as the nominal wellbore diameter of the first openhole wellbore portion. It is to be understood that the second openhole wellbore portion of the well can have a nominal wellbore diameter that is larger than the nominal wellbore diameter of the first openhole wellbore portion.

Similarly, in the embodiments for fracturing more than one cased wellbore portions, the second cased wellbore portion of the well can have a nominal inside diameter of the casing that is the same as the nominal inside diameter of the casing of the first cased wellbore portion. It is also possible that the second cased wellbore portion of the well can have a nominal inside diameter of the casing that is larger than the nominal inside diameter of the casing of the first cased wellbore portion.

Moreover, the method of fracturing an openhole wellbore portion can be combined with the method of fracturing a cased wellbore portion. For example, a well can have an openhole wellbore portion that is downhole of a cased wellbore portion. According to an embodiment of the inventions, the openhole wellbore portion can be treated in a first fracturing stage, and without necessity of removing the tubular string from the wellbore, the cased wellbore portion can be treated in a second fracturing stage.

Any of the methods according to the invention can optionally further include, after the step of pumping a fracturing fluid, any one or more of the steps of: (a) flowing back through the tubular string; (b) flowing back through the annulus around the tubular string; (c) circulating through the tubular string and the annulus around the tubular string; (d) producing through the tubular string; (e) testing the flow from the tubular string. It is to be understood that flowing from the tubular string or the annulus around the tubular string refers to the portion of the tubular string of the treatment interval or across a Venturi section.

In addition, any of the methods can further include, after the step of pumping a fracturing fluid, the step of: pulling the tubular string out of the wellbore.

Examples are Illustrative of Invention

Therefore, the present invention is well adapted to attain the ends and advantages mentioned as well as those that are inherent therein. The particular embodiments disclosed herein are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

While compositions and methods are described in terms of "comprising," "containing," or "including" various components or steps, the compositions and methods also can "consist essentially of" or "consist of" the various components and steps.

Also, the terms in the claims have their plain, ordinary meaning unless otherwise explicitly and clearly defined herein. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of fracturing a cased wellbore portion of a well, the method comprising the steps of:

(A) obtaining a fracturing job design having at least one treatment interval for the cased wellbore portion, wherein the treatment interval:

(1) has a nominal cross-sectional area defined by the nominal casing inside diameter of the casing of the cased wellbore portion; and (2) has an uphole end and a downhole end;

(B) running a tubular string into the treatment interval, wherein the tubular string has an axial passageway;

(C) before or after the step of running, forming one or more tubular string openings in the tubular string, wherein after the step of running, the one or more tubular string openings are positioned in the treatment interval;

(D) before or after the step of running, forming one or more casing openings in the casing of the treatment interval;

(E) except for the axial passageway of the tubular string, blocking at least 86% of the nominal cross-sectional area of the treatment interval that is between one of the ends of the treatment interval and the axially closest of the one or more tubular string openings to the one of the ends, wherein the blocking is along a summational axial length that is at least one inch, and, except for the axial passageway of the tubular string, leaving unblocked at least 4% of the nominal cross-sectional area of the treatment interval that is along an entire axial length between the one of the ends of the treatment interval and the axially closest of the one or more tubular string openings to the one of the ends;

(F) pumping a fracturing fluid through the tubular string, through the one or more tubular string openings, and through the one or more casing openings at a rate and pressure sufficient to initiate at least one fracture in the subterranean formation surrounding the treatment interval, wherein prior to the step of pumping, no packing of the tubular string is set uphole within 1,500 feet of the treatment interval; and (G) after the step of pumping a fracturing fluid, the steps of:

(a) plugging the tubular string at a location uphole of the one or more tubular string openings:

(b) repeating the steps after the step of running at a second treatment interval in the cased wellbore portion of the well at an uphole location relative to the plugged location.

2. The method according to claim 1, wherein the step of obtaining a fracturing job design further comprises the step of designing the fracturing job design.

3. The method according to claim 1, wherein the step of blocking:

extends for a summational axial length that is continuous for at least 2 times the nominal casing inside diameter; and does not have any opening in the tubular wall along the summational axial length thereof that would allow fluid to flow from the passageway to outside the tubular string.

4. The method according to claim 1, wherein the step of blocking comprises blocking at least 92% of the nominal cross-sectional area of the treatment interval that is between the one of the ends of the treatment interval and the axially closest of the one or more tubular string openings to the one of the ends, wherein the blocking is along a summational axial length that is at least one inch.

5. The method according to claim 1, wherein the step of blocking is with a venturi section.

6. The method according to claim 1, further comprising the step of:

blocking at least 86% of the nominal cross-sectional area of the treatment interval that is between the other of the ends of the treatment interval and the axially closest of the one or more tubular string openings to the other of the ends, wherein the blocking is along the summational axial length that is at least 2 times the nominal casing inside diameter, and, except for the axial passageway of the tubular string, leaving unblocked at least 4% of the nominal cross-sectional area of the treatment interval that is along an entire axial length between the other of the ends of the treatment interval and the axially closest of the one or more tubular string openings to the other of the ends.

7. The method according to claim 6, wherein prior to the step of pumping, no packing of the tubular string is set downhole within 1,500 feet of the treatment interval.

8. The method according to claim 6, wherein the step of blocking of the treatment interval that is between the other of the ends of the treatment interval and the axially closest of the one or more tubular string openings comprises blocking at least 92% of the nominal cross-sectional area of the treatment interval that is between the other of the ends of the treatment interval and the axially closest of the one or more tubular string openings to the other of the ends, wherein the blocking is along a summational axial length that is at least 2 times the nominal casing inside diameter.

9. The method according to claim 6, wherein the step of blocking of the treatment interval that is between the other of the ends of the treatment interval and the axially closest of the one or more tubular string openings is with a venturi section.

10. A method of fracturing a cased wellbore portion of a well, wherein the cased wellbore portion has a nominal casing inside diameter defining a nominal cross-sectional area of the cased wellbore portion, the method comprising the steps of:

(A) running a tubular string having a venturi section into the cased wellbore portion of the well;

(B) before or after the step of running, forming one or more tubular string openings in the tubular string to be located downhole relative to the upper end of the venturi section of the tubular string, wherein:

(1) the one or more tubular string openings allow fluid to flow from the tubular string to outside the tubular string;

(2) the venturi section has a generally tubular wall that has a passageway extending axially therein, wherein the passageway of the venturi section is in fluid communication with the one or more tubular string openings;

(3) the one or more tubular string openings and the venturi section are not axially separated by a closed internal plug within the tubular string;

(C) before or after the step of running, forming one or more casing openings in the casing to be located downhole relative to the upper end of the venturi section of the tubular string;

(D) pumping a fracturing fluid through the tubular string, through the one or more tubular string openings, and through the one or more casing openings at a rate and pressure sufficient to initiate at least one fracture in the subterranean formation surrounding the cased wellbore portion, wherein prior to the step of pumping, no packing of the tubular string is set uphole within 1,500 feet of the venturi section; and wherein the generally tubular wall of the venturi section has a cross-sectional are including the cross-sectional area of the passageway that:

(i) during the step of running, blocks an area equal to or greater than 86% of the nominal cross-sectional area of the inside of the casing of the cased wellbore portion, wherein the blocking is along a summational axial length that is at least one inch; and (ii) before or during the step of pumping, is not increased by greater than 1% from the cross-sectional area during the step of running; and (E) after the step of pumping a fracturing fluid, the steps of:

(a) plugging the tubular string at a location uphole of the one or more tubular string opening;

(b) repeating the steps after the step of running at a second treatment interval in the cased wellbore portion of the well at an uphole location relative to the plugged location.

11. A method of fracturing a cased wellbore portion of a well, wherein the cased wellbore portion has a nominal casing inside diameter defining a nominal cross-sectional area of the cased wellbore portion, the method comprising the steps of:

(A) running a tubular string having a venturi section into the cased wellbore portion of the well;

(B) before or after the step of running, forming one or more tubular string openings in the tubular string to be located downhole relative to the upper end of the Venturi section of the tubular string, wherein:

(1) the one or more tubular string openings allow fluid to flow from the tubular string to outside the tubular string;

(2) the venturi section has a generally tubular wall that has a passageway extending axially therein, wherein the passageway of the venturi section is in fluid communication with the one or more tubular string openings; and (3) the one or more tubular string openings and the venturi section are not axially separated by a closed internal plug within the tubular string; and (C) before or after the step of running, forming one or more casing openings in the casing to be located downhole relative to the upper end of the venturi section of the tubular string;

(D) pumping a fracturing fluid through the tubular string, through the one or more tubular string openings, and through the one or more casing openings at a rate and pressure sufficient to initiate at least one fracture in the subterranean formation surrounding the cased wellbore portion, wherein prior to the step of pumping, no packing of the tubular string is set uphole within 1,500 feet of the venturi section;

wherein the generally tubular wall of the venturi section is adapted to provide at least a sufficient venturi effect between the tubular string and the inside casing wall of the cased wellbore portion so that during the step of pumping a fracturing fluid, the venturi effect contains a sufficient pressure of the fracturing fluid in the casing of the cased wellbore to initiate the at least one fracture in the subterranean formation surrounding the cased wellbore portion; and (E) after the step of pumping a fracturing fluid, the steps of:

(a) plugging the tubular string at a location uphole of the one or more tubular string openings;

(b) repeating the steps after the step of running at a second treatment interval in the cased wellbore portion of the well at an uphole location relative to the plugged location.

12. The method according to claim 11, wherein the generally tubular wall of the venturi section:

extends for a summational axial length that is continuous for at least 2 times the nominal casing inside diameter; and does not have any opening in the tubular wall along the summational axial length thereof that would allow fluid to flow from the passageway to outside the tubular string.

13. The method according to claim 11, wherein the step of forming one or more tubular string openings comprises: after the step of running, perforating a treatment section of the tubular string to form the one or more tubular string openings.

14. The method according to claim 11, wherein the cross-sectional area of the venturi section, including the passageway therein, blocks an area equal to or greater than 92% of the nominal cross-sectional area of the inside of the casing.

15. The method according to claim 11, wherein a summational axial length is within an axial span that is equal to or less than 20 times the nominal casing inside diameter.

16. The method according to claim 11, wherein the venturi section of the tubular string is non-swellable, non-inflatable, and non-expandable.

17. The method according claim 11, wherein the summational axial length of the venturi section is contiguous.

18. The method according to claim 11, wherein the tubular string includes a second venturi section is positioned downhole relative to the one or more tubular string openings, wherein the one or more tubular string openings and the second venturi section are not axially separated by a set packing between the tubular string and the cased wellbore portion, and wherein there is no other tubular string opening below the second venturi section or wherein the axial passageway to any other tubular string opening below the second venturi section is plugged.

19. The method according to claim 11, further comprising, after the step of pumping a fracturing fluid, any one or more of the steps of:

(a) flowing back through the tubular string;

(b) flowing back through the annulus around the tubular string;

(c) circulating through the tubular string and the annulus around the tubular string;

(d) producing through the tubular string;

(e) testing the flow from the tubular string.

20. The method according to claim 11, wherein the steps of plugging and repeating are without axially moving the tubing string in the wellbore.

* * * * *